US010814150B2

(12) United States Patent
Conboy

(10) Patent No.: US 10,814,150 B2
(45) Date of Patent: Oct. 27, 2020

(54) METHODS OF AND SYSTEM NETWORKS FOR WIRELESS MANAGEMENT OF GPS-TRACKED SPRAYING SYSTEMS DEPLOYED TO SPRAY PROPERTY AND GROUND SURFACES WITH ENVIRONMENTALLY-CLEAN WILDFIRE INHIBITOR TO PROTECT AND DEFEND AGAINST WILDFIRES

(71) Applicant: M-Fire Holdings LLC, Carlsbad, CA (US)

(72) Inventor: Stephen Conboy, Carlsbad, CA (US)

(73) Assignee: M-FIRE HOLDINGS LLC, Carlsbad, CA (US)

( * ) Notice: Subject to any disclaimer, the term of this patent is extended or adjusted under 35 U.S.C. 154(b) by 157 days.

(21) Appl. No.: 16/104,130

(22) Filed: Aug. 16, 2018

(65) Prior Publication Data

US 2019/0168035 A1 Jun. 6, 2019

Related U.S. Application Data

(63) Continuation-in-part of application No. 15/874,874, filed on Jan. 18, 2018, now Pat. No. 10,430,757, (Continued)

(51) Int. Cl.
*A62C 3/02* (2006.01)
*A62C 35/13* (2006.01)
(Continued)

(52) U.S. Cl.
CPC ..... *A62C 3/0214* (2013.01); *A62C 3/0292* (2013.01); *A62C 35/13* (2013.01); (Continued)

(58) Field of Classification Search
CPC ..... A62C 3/0214; A62C 3/0292; A62C 35/13; A62C 37/50; A62C 2/247; A62C 3/0271; A62C 3/0278; A62C 31/02; A62C 35/15
(Continued)

(56) References Cited

U.S. PATENT DOCUMENTS 25,358 A 9/1859 Wilder
1,185,154 A 5/1916 Wilds
(Continued)

FOREIGN PATENT DOCUMENTS

AU 5986501 11/2001
AU 2001259865 2/2007
(Continued)

OTHER PUBLICATIONS

US 8,460,513 B2, 06/2013, Sealey (withdrawn)
(Continued)

*Primary Examiner* — Steven J Ganey
(74) *Attorney, Agent, or Firm* — Thomas J. Perkowski, ESQ., PC

(57) ABSTRACT

A wireless system network for managing GPS-tracked stationary spraying systems and GPS-tracking mobile spraying systems deployed on a wireless communication network for supporting the defense of property against wildfires. Each GPS-tracking spraying system includes an electronic circuit or device for (i) automatically tracking the spraying of property with environmentally-clean anti-fire (AF) liquid contained in a storage tank, (ii) automatically monitoring the level of environmentally-clean anti-fire liquid in the storage tank, and (iii) generating and transmitting electronic signals to a remote center so that a service can automatically replenish the storage tank of the GPS-tracking spraying system when the level of environmentally-clean anti-fire liquid falls below a predetermined level in the storage tank.
(Continued)

This ensures the systems are ready to spray environmentally-clean anti-fire liquid on property before the incidence of wildfire in a proactive manner.

11 Claims, 34 Drawing Sheets

Related U.S. Application Data which is a continuation-in-part of application No. 15/866,454, filed on Jan. 9, 2018, now Pat. No. 10,311,444, application No. 16/104,130, which is a continuation-in-part of application No. 15/829,914, filed on Dec. 2, 2017, now Pat. No. 10,260,232, and a continuation-in-part of application No. 15/866,456, filed on Jan. 9, 2018, now Pat. No. 10,311,444, and a continuation-in-part of application No. 15/866,451, filed on Jan. 9, 2018, now Pat. No. 10,653,904, and a continuation-in-part of application No. 16/039,291, filed on Jul. 18, 2018, now abandoned, and a continuation-in-part of application No. 15/925,793, filed on Mar. 20, 2018, now abandoned, and a continuation-in-part of application No. 16/039,291, filed on Jul. 18, 2018, now abandoned, and a continuation-in-part of application No. 16/055,001, filed on Aug. 3, 2018, now abandoned.

(51) Int. Cl.

| | |
|---|---|
| ***A62C 37/50*** | (2006.01) |
| *A62C 31/02* | (2006.01) |
| *A62C 2/24* | (2006.01) |
| *A62C 35/15* | (2006.01) |

(52) U.S. Cl.

CPC ..... *A62C 37/50* (2013.01); *A62C 2/247* (2013.01); *A62C 3/0271* (2013.01); *A62C 3/0278* (2013.01); *A62C 31/02* (2013.01); *A62C 35/15* (2013.01)

(58) Field of Classification Search

USPC ..... 169/9, 16, 45, 46, 52; 239/208, DIG. 15; 340/577, 584, 588

See application file for complete search history.

(56) References Cited

U.S. PATENT DOCUMENTS

| | | | |
|---|---|---|---|
| 1,561,193 | A | 11/1925 | Spring |
| 1,665,995 | A | 4/1928 | Wiley |
| 1,817,342 | A | 8/1931 | Beecher |
| 1,995,874 | A | 3/1935 | Van De Mark |
| 2,931,083 | A | 4/1960 | Sidenmark |
| 3,304,675 | A | 2/1967 | Graham-Wood |
| 3,305,431 | A | 2/1967 | Peterson |
| 3,309,824 | A | 3/1967 | Barrett |
| 3,328,231 | A | 6/1967 | Sergovic |
| 3,350,822 | A | 11/1967 | Nachazel |
| 3,362,124 | A | 1/1968 | Cravens |
| 3,383,274 | A | 5/1968 | Craig |
| 3,427,216 | A | 2/1969 | Quinn |
| 3,457,702 | A | 7/1969 | Brown |
| 3,468,092 | A | 9/1969 | Chalmers |
| 3,470,062 | A | 9/1969 | Ollinger |
| 3,501,419 | A | 3/1970 | Bridgeford |
| 3,506,479 | A | 4/1970 | Breens |
| 3,508,872 | A | 4/1970 | Stuetz |
| 3,509,083 | A | 4/1970 | Winebrenner |
| 3,511,748 | A | 5/1970 | Heeb |
| 3,539,423 | A | 11/1970 | Simison |
| 3,607,811 | A | 9/1971 | Hovd |
| 3,639,326 | A | 2/1972 | Kray |
| 3,650,820 | A | 3/1972 | DiPietro |
| 3,663,267 | A | 5/1972 | Moran |
| 3,703,394 | A | 11/1972 | Hemming |
| 3,738,072 | A | 6/1973 | Adrian |
| 3,795,637 | A | 3/1974 | Kandler |
| 3,899,855 | A | 8/1975 | Gadsby |
| 3,934,066 | A | 1/1976 | Murch |
| 3,935,343 | A | 1/1976 | Nuttall |
| 3,944,688 | A | 3/1976 | Inman |
| 3,994,110 | A | 11/1976 | Ropella |
| 4,013,599 | A | 3/1977 | Strauss |
| 4,065,413 | A | 12/1977 | MacInnis |
| 4,092,281 | A | 5/1978 | Bertrand |
| 4,104,073 | A | 8/1978 | Koide |
| 4,172,858 | A | 10/1979 | Clubley |
| 4,176,115 | A | 11/1979 | Hartman |
| 4,197,913 | A | 4/1980 | Korenowski |
| 4,198,328 | A | 4/1980 | Bertelli |
| 4,209,561 | A | 6/1980 | Sawko |
| 4,228,202 | A | 10/1980 | Tjaennberg |
| 4,237,182 | A | 12/1980 | Fulmer |
| 4,248,976 | A | 2/1981 | Clubley |
| 4,251,579 | A | 2/1981 | Lee |
| 4,254,177 | A | 3/1981 | Fulmer |
| 4,265,963 | A | 5/1981 | Matalon |
| 4,266,384 | A | 5/1981 | Orals |
| 4,364,987 | A | 12/1982 | Goodwin |
| 4,382,884 | A | 5/1983 | Rohringer |
| 4,392,994 | A | 7/1983 | Wagener |
| 4,419,256 | A | 12/1983 | Loomis |
| 4,514,327 | A | 4/1985 | Rock |
| 4,530,877 | A | 7/1985 | Hadley |
| 4,560,485 | A | 12/1985 | Szekely |
| 4,563,287 | A | 1/1986 | Hisamoto |
| 4,572,862 | A | 2/1986 | Ellis |
| 4,578,913 | A | 4/1986 | Eich |
| 4,659,381 | A | 4/1987 | Walters |
| 4,661,398 | A | 4/1987 | Ellis |
| 4,663,226 | A | 5/1987 | Vajs |
| 4,666,960 | A | 5/1987 | Spain |
| 4,690,859 | A | 9/1987 | Porter |
| 4,714,652 | A | 12/1987 | Poletto |
| 4,720,414 | A | 1/1988 | Burga |
| 4,724,250 | A | 2/1988 | Schubert |
| 4,737,406 | A | 4/1988 | Bumpus |
| 4,740,527 | A | 4/1988 | Von Bonin |
| 4,743,625 | A | 5/1988 | Vajs |
| 4,756,839 | A | 7/1988 | Curzon |
| 4,770,794 | A | 9/1988 | Cundasawmy |
| 4,810,741 | A | 3/1989 | Kim |
| 4,824,483 | A | 4/1989 | Bumpus |
| 4,824,484 | A | 4/1989 | Metzner |
| 4,861,397 | A | 8/1989 | Hillstrom |
| 4,871,477 | A | 10/1989 | Dimanshteyn |
| 4,879,320 | A | 11/1989 | Hastings |
| 4,888,136 | A | 12/1989 | Chellapa |
| 4,895,878 | A | 1/1990 | Jourquin |
| 4,965,296 | A | 10/1990 | Hastings |
| 5,021,484 | A | 6/1991 | Schreiber |
| 5,023,019 | A | 6/1991 | Bumpus |
| 5,032,446 | A | 7/1991 | Sayles |
| 5,039,454 | A | 8/1991 | Policastro |
| 5,053,147 | A | 10/1991 | Kaylor |
| 5,055,208 | A | 10/1991 | Stewart |
| 5,130,184 | A | 7/1992 | Ellis |
| 5,156,775 | A | 10/1992 | Blount |
| 5,162,394 | A | 11/1992 | Trocino |
| 5,182,049 | A | 1/1993 | Von Bonin |
| 5,185,214 | A | 2/1993 | Levan |
| 5,214,894 | A | 6/1993 | Glesser-Lott |
| 5,250,200 | A | 10/1993 | Sallet |
| 5,283,998 | A | 2/1994 | Jong |
| 5,284,700 | A | 2/1994 | Strauss |
| 5,356,568 | A | 10/1994 | Levine |
| 5,371,986 | A | 12/1994 | Guditis |
| 5,383,749 | A | 1/1995 | Reisdorff |
| 5,391,246 | A | 2/1995 | Stephens |
| 5,393,437 | A | 2/1995 | Bower |

(56) References Cited

U.S. PATENT DOCUMENTS

| | | | |
|---|---|---|---|
| 5,405,661 | A | 4/1995 | Kim |
| 5,491,022 | A | 2/1996 | Smith |
| 5,534,301 | A | 7/1996 | Shutt |
| 5,605,767 | A | 2/1997 | Fuller |
| 5,609,915 | A | 3/1997 | Fuller |
| 5,631,047 | A | 5/1997 | Friloux |
| 5,709,821 | A | 1/1998 | Von Bonin |
| 5,729,936 | A | 3/1998 | Maxwell |
| 5,738,924 | A | 4/1998 | Sing |
| 5,815,994 | A | 10/1998 | Knight |
| 5,833,874 | A | 11/1998 | Stewart |
| 5,834,535 | A | 11/1998 | Abu-Isa |
| 5,840,413 | A | 11/1998 | Kajander |
| 5,968,669 | A | 10/1999 | Liu |
| 6,000,189 | A | 12/1999 | Breuer |
| 6,042,639 | A | 3/2000 | Valso |
| 6,073,410 | A | 6/2000 | Schimpf |
| 6,146,557 | A | 11/2000 | Inata |
| 6,150,449 | A | 11/2000 | Valkanas |
| 6,153,682 | A | 11/2000 | Bannat |
| 6,167,971 | B1 | 1/2001 | Van Lingen |
| 6,245,842 | B1 | 6/2001 | Buxton |
| 6,271,156 | B1 | 8/2001 | Gleason |
| 6,415,571 | B2 | 7/2002 | Risser |
| 6,423,129 | B1 | 7/2002 | Fitzgibbons, Jr. |
| 6,423,251 | B1 | 7/2002 | Blount |
| 6,442,912 | B1 | 9/2002 | Phillips |
| 6,444,718 | B1 | 9/2002 | Blount |
| 6,453,636 | B1 | 9/2002 | Ritz |
| 6,464,903 | B1 | 10/2002 | Blount |
| 6,491,254 | B1 | 12/2002 | Walkinshaw |
| 6,517,748 | B2 | 2/2003 | Richards |
| 6,608,123 | B2 | 8/2003 | Galli |
| 6,613,391 | B1 | 9/2003 | Gang |
| 6,629,392 | B1 | 10/2003 | Harrel |
| 6,706,774 | B2 | 3/2004 | Muenzenberger |
| 6,713,411 | B2 | 3/2004 | Cox |
| 6,772,562 | B1 | 8/2004 | Dadamo |
| 6,800,352 | B1 | 10/2004 | Hejna |
| 6,869,669 | B2 | 3/2005 | Jensen |
| 6,881,247 | B2 | 4/2005 | Batdorf |
| 6,881,367 | B1 | 4/2005 | Baker |
| 6,897,173 | B2 | 5/2005 | Bernard |
| 6,930,138 | B2 | 8/2005 | Schell |
| 6,982,049 | B1 | 1/2006 | Mabey |
| 7,210,537 | B1 | 5/2007 | McNeil |
| 7,261,165 | B1 | 8/2007 | Black |
| 7,273,634 | B2 | 9/2007 | Fitzgibbons, Jr. |
| 7,323,248 | B2 | 1/2008 | Ramsey |
| 7,331,399 | B2 | 2/2008 | Multer |
| 7,337,156 | B2 | 2/2008 | Wippich |
| 7,341,113 | B2 | 3/2008 | Fallis |
| 7,478,680 | B2 | 1/2009 | Sridharan |
| 7,479,513 | B2 | 1/2009 | Reinheimer |
| 7,482,395 | B2 | 1/2009 | Mabey |
| 7,487,841 | B1 | 2/2009 | Gonci |
| 7,504,449 | B2 | 3/2009 | Mazor |
| 7,560,041 | B2 | 7/2009 | Yoon |
| 7,587,875 | B2 | 9/2009 | Kish |
| 7,588,087 | B2 | 9/2009 | Cafferata |
| 7,614,456 | B2 | 11/2009 | Twum |
| 7,673,696 | B1 | 3/2010 | Gunn |
| 7,686,093 | B2 | 3/2010 | Reilly |
| 7,744,687 | B2 | 6/2010 | Moreno G |
| 7,748,662 | B2 | 7/2010 | Hale |
| 7,754,808 | B2 | 7/2010 | Goossens |
| 7,766,090 | B2 | 8/2010 | Mohr |
| 7,767,010 | B2 | 8/2010 | Curzon |
| 7,785,712 | B2 | 8/2010 | Miller |
| 7,789,165 | B1 | 9/2010 | Yen |
| 7,815,157 | B2 | 10/2010 | Knight |
| 7,820,736 | B2 | 10/2010 | Reinheimer |
| 7,824,583 | B2 | 11/2010 | Gang |
| 7,828,069 | B2 | 11/2010 | Lee |
| 7,832,492 | B1 | 11/2010 | Eldridge |
| 7,837,009 | B2 | 11/2010 | Gross |
| 7,849,542 | B2 | 12/2010 | DeFranks |
| 7,863,355 | B2 | 1/2011 | Futterer |
| 7,886,836 | B2 | 2/2011 | Haaland |
| 7,886,837 | B1 | 2/2011 | Helfgott |
| 7,897,070 | B2 | 3/2011 | Knocke |
| 7,897,673 | B2 | 3/2011 | Flat |
| 7,900,709 | B2 | 3/2011 | Kotliar |
| 7,934,564 | B1 | 5/2011 | Stell |
| 8,006,447 | B2 | 8/2011 | Beele |
| 8,080,186 | B1 | 12/2011 | Pennartz |
| 8,088,310 | B2 | 1/2012 | Orr |
| 8,206,620 | B1 | 6/2012 | Bolton |
| 8,217,093 | B2 | 7/2012 | Reinheimer |
| 8,226,017 | B2 | 7/2012 | Cohen |
| 8,263,231 | B2 | 9/2012 | Mesa |
| 8,273,813 | B2 | 9/2012 | Beck |
| 8,276,679 | B2 | 10/2012 | Bui |
| 8,281,550 | B1 | 10/2012 | Bolton |
| 8,286,405 | B1 | 10/2012 | Bolton |
| 8,291,990 | B1 | 10/2012 | Mohr |
| 8,344,055 | B1 | 1/2013 | Mabey |
| 8,366,955 | B2 | 2/2013 | Thomas |
| 8,403,070 | B1 | 3/2013 | Lowe |
| 8,409,479 | B2 | 4/2013 | Alexander |
| 8,453,752 | B2 | 6/2013 | Katsuraku |
| 8,458,971 | B2 | 6/2013 | Winterowd |
| 8,465,833 | B2 | 6/2013 | Lee |
| 8,534,370 | B1 | 9/2013 | Al Azemi |
| 8,586,657 | B2 | 11/2013 | Lopez |
| 8,603,231 | B2 | 12/2013 | Wagh |
| 8,646,540 | B2 | 2/2014 | Eckholm |
| 8,647,524 | B2 | 2/2014 | Rueda-Nunez |
| 8,662,192 | B2 | 3/2014 | Dunster |
| 8,663,427 | B2 | 3/2014 | Sealey |
| 8,663,774 | B2 | 3/2014 | Fernando |
| 8,663,788 | B2 | 3/2014 | Oh |
| 8,668,988 | B2 | 3/2014 | Schoots |
| 8,685,206 | B2 | 4/2014 | Sealey |
| 8,698,634 | B2 | 4/2014 | Guedes Lopes Da Fonseca |
| 8,746,355 | B2 | 6/2014 | Demmitt |
| 8,746,357 | B2 | 6/2014 | Butz |
| 8,789,769 | B2 | 7/2014 | Fenton |
| 8,808,850 | B2 | 8/2014 | Dion |
| 8,820,421 | B2 | 9/2014 | Rahgozar |
| 8,871,053 | B2 | 10/2014 | Sealey |
| 8,871,058 | B2 | 10/2014 | Sealey |
| 8,893,814 | B2 | 11/2014 | Bui |
| 8,944,174 | B2 | 2/2015 | Thomas |
| 8,973,669 | B2 | 3/2015 | Connery |
| 8,980,145 | B2 | 3/2015 | Baroux |
| 9,005,396 | B2 | 4/2015 | Baroux |
| 9,005,642 | B2 | 4/2015 | Mabey |
| 9,027,303 | B2 | 5/2015 | Lichtinger |
| 9,089,730 | B2 | 7/2015 | Shalev |
| 9,120,570 | B2 | 9/2015 | Hoisington |
| 9,174,074 | B2 | 11/2015 | Medina |
| 9,187,674 | B2 | 11/2015 | Ulcar |
| 9,199,108 | B2 | 12/2015 | Guo |
| 9,249,021 | B2 | 2/2016 | Mundheim |
| 9,265,978 | B2 | 2/2016 | Klaffmo |
| 9,328,317 | B2 | 5/2016 | Peng |
| 9,382,153 | B2 | 7/2016 | Fisher |
| 9,409,045 | B2 | 8/2016 | Berezovsky |
| 9,498,787 | B2 | 11/2016 | Ishizuka |
| 9,597,538 | B2 | 3/2017 | Langselius |
| 9,616,590 | B2 | 4/2017 | Birkeland |
| 9,663,943 | B2 | 5/2017 | Dimakis |
| 9,776,029 | B2 | 10/2017 | Izumida |
| 9,777,500 | B1 | 10/2017 | Reisdorff |
| 9,782,944 | B2 | 10/2017 | Martin |
| 9,851,718 | B2 | 12/2017 | Booher |
| 9,920,250 | B1 | 3/2018 | Vuozzo |
| 9,931,648 | B2 | 4/2018 | Fenton |
| 9,956,446 | B2 | 5/2018 | Connery |
| 9,986,313 | B2 | 5/2018 | Schwarzkopf |
| 2001/0025712 | A1 | 10/2001 | Pagan |
| 2001/0029706 | A1 | 10/2001 | Risser |
| 2001/0029750 | A1 | 10/2001 | Kotliar |

(56) References Cited

U.S. PATENT DOCUMENTS

2002/0005288 A1 1/2002 Haase
2002/0011593 A1 1/2002 Richards
2002/0023762 A1 2/2002 Kotliar
2002/0045688 A1 4/2002 Galli
2002/0079379 A1 6/2002 Cheung
2002/0096668 A1 7/2002 Vandersall
2002/0110696 A1 8/2002 Slimak
2002/0125016 A1 9/2002 Cofield
2002/0130294 A1 9/2002 Almagro
2002/0139056 A1 10/2002 Finnell
2002/0168476 A1 11/2002 Pasek
2003/0029622 A1 2/2003 Clauss
2003/0047723 A1 3/2003 Santoro
2003/0051886 A1 3/2003 Adiga
2003/0066990 A1 4/2003 Vandersall
2003/0132425 A1 7/2003 Curzon
2003/0136879 A1 7/2003 Grabow
2003/0146843 A1 8/2003 Dittmer
2003/0155133 A1 8/2003 Matsukawa
2003/0159836 A1 8/2003 Kashiki
2003/0160111 A1 8/2003 Multer
2003/0168225 A1 9/2003 Denne
2003/0170317 A1 9/2003 Curzon
2004/0003569 A1 1/2004 Frederickson
2004/0051086 A1 3/2004 Pasek
2004/0099178 A1 5/2004 Jones
2004/0109853 A1 6/2004 McDaniel
2004/0134378 A1 7/2004 Batdorf
2004/0163825 A1 8/2004 Dunster
2004/0173783 A1 9/2004 Curzon
2004/0175407 A1 9/2004 McDaniel
2004/0194657 A1 10/2004 Lally
2004/0209982 A1 10/2004 Horacek
2004/0231252 A1 11/2004 Benjamin
2005/0009965 A1 1/2005 Schell
2005/0009966 A1 1/2005 Rowen
2005/0011652 A1 1/2005 Hua
2005/0022466 A1 2/2005 Kish
2005/0045739 A1 3/2005 Multer
2005/0058689 A1 3/2005 McDaniel
2005/0066619 A1 3/2005 McDonald
2005/0092502 A1* 5/2005 Thompson ..... A62C 5/02 169/52
2005/0103507 A1 5/2005 Brown
2005/0139363 A1 6/2005 Thomas
2005/0229809 A1 10/2005 Lally
2005/0269109 A1 12/2005 Maguire
2005/0279972 A1 12/2005 Santoro
2006/0037277 A1 2/2006 Fitzgibbons, Jr.
2006/0048466 A1 3/2006 Darnell
2006/0083920 A1 4/2006 Schnabel
2006/0131035 A1 6/2006 French
2006/0157668 A1 7/2006 Erdner
2006/0167131 A1 7/2006 Mabey
2006/0168906 A1 8/2006 Tonyan
2006/0175067 A1 8/2006 Cover
2006/0196681 A1 9/2006 Adiga
2006/0208236 A1 9/2006 Gang
2006/0213672 A1 9/2006 Mohr
2007/0084554 A1 4/2007 Miller
2007/0090322 A1 4/2007 Yoon
2007/0119334 A1 5/2007 Atkinson
2007/0125880 A1 6/2007 Palle
2007/0176156 A1 8/2007 Mabey
2007/0193753 A1 8/2007 Adiga
2007/0194289 A1 8/2007 Anglin
2007/0197112 A1 8/2007 Mazor
2007/0227085 A1 10/2007 Mader
2007/0232731 A1 10/2007 Knocke
2007/0289709 A1 12/2007 Chong
2007/0289752 A1 12/2007 Beck
2007/0295046 A1 12/2007 Cassan
2008/0000649 A1 1/2008 Guirguis
2008/0050578 A1 2/2008 Sinclair, Sr.
2008/0054230 A1 3/2008 Mabey
2008/0115949 A1 5/2008 Li
2008/0128145 A1 6/2008 Butz
2008/0168798 A1 7/2008 Kotliar
2008/0179067 A1 7/2008 Ho
2008/0184642 A1 8/2008 Sebastian
2008/0289831 A1 11/2008 Kaimart
2008/0314601 A1 12/2008 Cafferata
2009/0039660 A1 2/2009 Gonzalez
2009/0044484 A1 2/2009 Berger
2009/0065646 A1 3/2009 Hale
2009/0075539 A1 3/2009 Dimanshteyn
2009/0090520 A1 4/2009 Lee
2009/0120653 A1 5/2009 Thomas
2009/0126951 A1 5/2009 Baek
2009/0188567 A1 7/2009 McHugh
2009/0194605 A1 8/2009 Lepeshinsky
2009/0212251 A1 8/2009 Taylor
2009/0215926 A1 8/2009 Kozlowski
2009/0249556 A1 10/2009 Dermeik
2009/0266025 A1 10/2009 Toas
2009/0280345 A1 11/2009 Maynard
2009/0301001 A1 12/2009 Kish
2009/0313931 A1 12/2009 Porter
2009/0314500 A1 12/2009 Fenton
2009/0326117 A1 12/2009 Benussi
2010/0000743 A1* 1/2010 Cohen ..... A01G 25/167 169/16
2010/0018725 A1 1/2010 Ramos Rodriguez
2010/0032175 A1 2/2010 Boyd
2010/0062153 A1 3/2010 Curzon
2010/0069488 A1 3/2010 Mabey
2010/0175897 A1 7/2010 Crump
2010/0176353 A1 7/2010 Hanna
2010/0181084 A1 7/2010 Carmo
2010/0200819 A1 8/2010 Mans Fibla
2010/0218959 A1 9/2010 Adiga
2010/0263886 A1 10/2010 Rahgozar
2010/0267853 A1 10/2010 Edry
2010/0281784 A1 11/2010 Leo
2010/0314138 A1 12/2010 Weatherspoon
2010/0326677 A1 12/2010 Jepsen
2011/0000142 A1 1/2011 Bui
2011/0005780 A1 1/2011 Rennie
2011/0061336 A1 3/2011 Thomas
2011/0073331 A1 3/2011 Xu
2011/0089386 A1 4/2011 Berry
2011/0091713 A1 4/2011 Miller
2011/0146173 A1 6/2011 Visser
2011/0203813 A1 8/2011 Fenton
2011/0266486 A1 11/2011 Orr
2011/0284250 A1 11/2011 Thomas
2011/0315406 A1 12/2011 Connery
2012/0045584 A1 2/2012 Dettbarn
2012/0067600 A1 3/2012 Bourakov
2012/0121809 A1 5/2012 Vuozzo
2012/0138319 A1 6/2012 Demmitt
2012/0145418 A1 6/2012 Su
2012/0168185 A1 7/2012 Yount
2012/0199781 A1 8/2012 Rueda-Nunez
2012/0241535 A1 9/2012 Carriere
2012/0256143 A1 10/2012 Ulcar
2012/0258327 A1 10/2012 McArthur
2012/0279731 A1 11/2012 Howard, Sr.
2012/0295996 A1 11/2012 Wang
2012/0308631 A1 12/2012 Shirley
2013/0000239 A1 1/2013 Winterowd
2013/0001331 A1 1/2013 Palle
2013/0101839 A1 4/2013 Dion
2013/0111839 A1 5/2013 Efros
2013/0239848 A1 9/2013 Fisher
2013/0264076 A1 10/2013 Medina
2013/0288031 A1 10/2013 Labock
2013/0312985 A1 11/2013 Collins
2014/0027131 A1 1/2014 Kawiecki
2014/0079942 A1 3/2014 Lally
2014/0123572 A1 5/2014 Segall
2014/0202716 A1 7/2014 Klaffmo
2014/0202717 A1 7/2014 Klaffmo
2014/0206767 A1 7/2014 Klaffmo

(56) References Cited

U.S. PATENT DOCUMENTS

| | | | | |
|---|---|---|---|---|
| 2014/0231106 | A1 | 8/2014 | Lewis | |
| 2014/0239123 | A1 | 8/2014 | Hoisington | |
| 2014/0245693 | A1 | 9/2014 | Efros | |
| 2014/0245696 | A1 | 9/2014 | Anderson | |
| 2014/0246509 | A1 | 9/2014 | Fenton | |
| 2014/0284067 | A1 | 9/2014 | Klaffmo | |
| 2014/0284511 | A1 | 9/2014 | Klaffmo | |
| 2014/0284512 | A1 | 9/2014 | Klaffmo | |
| 2014/0290970 | A1 | 10/2014 | Izumida | |
| 2014/0295164 | A1 | 10/2014 | Parker | |
| 2014/0299339 | A1 | 10/2014 | Klaffmo | |
| 2014/0322548 | A1 | 10/2014 | Boldizsar | |
| 2014/0366598 | A1 | 12/2014 | Carmo | |
| 2015/0020476 | A1 | 1/2015 | Winterowd | |
| 2015/0021053 | A1 | 1/2015 | Klaffmo | |
| 2015/0021055 | A1 | 1/2015 | Klaffmo | |
| 2015/0129245 | A1 | 5/2015 | Weber | |
| 2015/0147478 | A1 | 5/2015 | Shutt | |
| 2015/0167291 | A1 | 6/2015 | Bundy | |
| 2015/0224352 | A1 | 8/2015 | Klaffmo | |
| 2015/0314564 | A1 | 11/2015 | Mancini | |
| 2015/0335926 | A1 | 11/2015 | Klaffmo | |
| 2015/0335928 | A1 | 11/2015 | Klaffmo | |
| 2015/0352385 | A1 | 12/2015 | Fenton | |
| 2015/0368560 | A1 | 12/2015 | Pascal | |
| 2016/0051850 | A1* | 2/2016 | Menard | A62C 35/58 169/16 |
| 2016/0082298 | A1 | 3/2016 | Dagenhart | |
| 2016/0096053 | A1 | 4/2016 | Beechy | |
| 2016/0107014 | A1 | 4/2016 | Klaffmo | |
| 2016/0132714 | A1 | 5/2016 | Pennypacker | |
| 2016/0137853 | A1 | 5/2016 | Lopez | |
| 2016/0243789 | A1 | 8/2016 | Baroux | |
| 2016/0313120 | A1 | 10/2016 | Shishalov | |
| 2017/0007865 | A1 | 1/2017 | Dor-El | |
| 2017/0029632 | A1 | 2/2017 | Couturier | |
| 2017/0056698 | A1 | 3/2017 | Pai | |
| 2017/0059343 | A1 | 3/2017 | Spinelli et al. | |
| 2017/0072236 | A1 | 3/2017 | Cordani | |
| 2017/0121965 | A1 | 5/2017 | Dettbarn | |
| 2017/0138049 | A1 | 5/2017 | King | |
| 2017/0182341 | A1 | 6/2017 | Libal | |
| 2017/0210098 | A1 | 7/2017 | Moore | |
| 2018/0089988 | A1 | 3/2018 | Schwarzkopf | |
| 2018/0339180 | A1* | 11/2018 | Weber | A62C 3/0292 |
| 2019/0262637 | A1* | 8/2019 | Statter | A62C 37/04 |

FOREIGN PATENT DOCUMENTS

| | | | |
|---|---|---|---|
| AU | 2005220194 | | 4/2007 |
| AU | 2005220196 | | 4/2007 |
| AU | 2002240521 | | 12/2007 |
| AU | 2002241169 | | 7/2008 |
| AU | 2011244837 | | 5/2012 |
| CA | 2212076 | | 7/1997 |
| CA | 2294254 | | 1/1999 |
| CA | 2442148 | | 10/2002 |
| CA | 2409879 | | 4/2003 |
| CA | 2593435 | | 8/2006 |
| CA | 2653817 | | 12/2007 |
| CA | 2705140 | | 5/2009 |
| CA | 2974796 | | 7/2010 |
| CA | 2811358 | | 1/2013 |
| CA | 2792793 | | 4/2013 |
| CA | 2846076 | | 9/2014 |
| CA | 2862380 | | 4/2015 |
| CA | 2868719 | | 6/2015 |
| CN | 1397613 | | 2/2003 |
| CN | 101293752 | | 10/2008 |
| CN | 101434760 | | 5/2009 |
| CN | 2020/45944 | | 11/2011 |
| CN | 102300610 | | 12/2011 |
| CN | 102337770 | | 2/2012 |
| CN | 103562079 | | 2/2014 |
| CN | 104540556 | | 4/2015 |
| EP | 173446 | A1 | 3/1986 |
| EP | 173446 | B1 | 3/1986 |
| EP | 2898925 | | 7/2015 |
| EP | 2902077 | | 8/2015 |
| GB | 429207 | A | 5/1935 |
| GB | 831720 | A | 3/1960 |
| GB | 832691 | | 4/1960 |
| GB | 2301122 | | 11/1996 |
| GB | 2370766 | | 7/2002 |
| GB | 2370769 | | 7/2002 |
| GB | 2370769 | A | 7/2002 |
| GB | 2375047 | | 11/2002 |
| GB | 2375047 | A | 11/2002 |
| GB | 2375047 | B | 11/2002 |
| GB | 2386835 | | 10/2003 |
| GB | 2386835 | A | 10/2003 |
| GB | 2386835 | B | 10/2003 |
| GB | 2486959 | A | 7/2012 |
| GB | 2533262 | | 6/2016 |
| GB | 2549980 | | 11/2017 |
| GB | 2555067 | | 4/2018 |
| KR | 101675486 | | 5/2012 |
| TW | I471153 | | 2/2015 |
| TW | 201714639 | | 5/2017 |
| WO | 8704145 | | 7/1987 |
| WO | 9010668 | | 9/1990 |
| WO | 9100327 | | 1/1991 |
| WO | 9109649 | | 7/1991 |
| WO | 9420169 | | 9/1994 |
| WO | 0022255 | | 4/2000 |
| WO | 0145932 | | 6/2001 |
| WO | 0166669 | | 9/2001 |
| WO | 0243812 | | 6/2002 |
| WO | 0244305 | | 6/2002 |
| WO | 2005014115 | | 2/2005 |
| WO | 2005119868 | | 12/2005 |
| WO | 2006006829 | | 1/2006 |
| WO | 2006010667 | | 2/2006 |
| WO | 2006013180 | | 2/2006 |
| WO | 2006032130 | | 3/2006 |
| WO | 2006053514 | | 5/2006 |
| WO | 2006056379 | | 6/2006 |
| WO | 2006072672 | | 7/2006 |
| WO | 2006079899 | | 8/2006 |
| WO | 2006081156 | | 8/2006 |
| WO | 2006126181 | | 11/2006 |
| WO | 2007001403 | | 1/2007 |
| WO | 2007030982 | | 3/2007 |
| WO | 2007033450 | | 3/2007 |
| WO | 2007048149 | | 5/2007 |
| WO | 2007065112 | | 6/2007 |
| WO | 2007140676 | | 12/2007 |
| WO | 2008031559 | | 3/2008 |
| WO | 2008100348 | | 8/2008 |
| WO | 2008104617 | | 9/2008 |
| WO | 2008111864 | | 9/2008 |
| WO | 2008150157 | | 12/2008 |
| WO | 2008155187 | | 12/2008 |
| WO | 2009004105 | | 1/2009 |
| WO | 2009012546 | | 1/2009 |
| WO | 2009020251 | | 2/2009 |
| WO | 2009057104 | | 5/2009 |
| WO | 2009061471 | | 5/2009 |
| WO | 2009086826 | | 7/2009 |
| WO | 2009097112 | | 8/2009 |
| WO | 2009139668 | | 11/2009 |
| WO | 2009150478 | | 12/2009 |
| WO | 2010028538 | | 3/2010 |
| WO | 2010041228 | | 4/2010 |
| WO | 2010046696 | | 4/2010 |
| WO | 2010061059 | | 6/2010 |
| WO | 2010078559 | | 7/2010 |
| WO | 2010082073 | | 7/2010 |
| WO | 2010083890 | | 7/2010 |
| WO | 2010089604 | | 8/2010 |
| WO | 2010104286 | | 9/2010 |
| WO | 2010123401 | | 10/2010 |
| WO | 2010139124 | | 12/2010 |

(56) References Cited

FOREIGN PATENT DOCUMENTS

| | | |
|---|---|---|
| WO | 2011016773 | 2/2011 |
| WO | 2011034334 | 3/2011 |
| WO | 2011042609 | 4/2011 |
| WO | 2011042761 | 4/2011 |
| WO | 2011049424 | 4/2011 |
| WO | 2011054345 | 5/2011 |
| WO | 2011078728 | 6/2011 |
| WO | 2011116450 | 9/2011 |
| WO | 2012031762 | 3/2012 |
| WO | 2012060491 | 5/2012 |
| WO | 2012071577 | 5/2012 |
| WO | 2012076905 | 6/2012 |
| WO | 2012147677 | 11/2012 |
| WO | 2012164478 | 12/2012 |
| WO | 2013003097 | 1/2013 |
| WO | 2013030497 | 3/2013 |
| WO | 2013062295 | 5/2013 |
| WO | 2013068260 | 5/2013 |
| WO | 2013098859 | 7/2013 |
| WO | 2013140671 | 9/2013 |
| WO | 2013179218 | 12/2013 |
| WO | 2014001417 | 1/2014 |
| WO | 2014025929 | 2/2014 |
| WO | 2014115036 | 7/2014 |
| WO | 2014115038 | 7/2014 |
| WO | 2014127604 | 8/2014 |
| WO | 2014152528 | 9/2014 |
| WO | 2014179482 | 11/2014 |
| WO | 2015020388 | 2/2015 |
| WO | 2015051917 | 4/2015 |
| WO | 2015055862 | 4/2015 |
| WO | 2015076842 | 5/2015 |
| WO | 2015094014 | 6/2015 |
| WO | 2015126854 | 8/2015 |
| WO | 2015153843 | 10/2015 |
| WO | 2015168456 | 11/2015 |
| WO | 2015172619 | 11/2015 |
| WO | 2016004801 | 1/2016 |
| WO | 2016005650 | 1/2016 |
| WO | 2016071715 | 5/2016 |
| WO | 2016075480 | 5/2016 |
| WO | 2016088026 | 6/2016 |
| WO | 2016131060 | 8/2016 |
| WO | 2016186450 | 11/2016 |
| WO | 2017014782 | 1/2017 |
| WO | 2017015585 | 1/2017 |
| WO | 2017016143 | 2/2017 |
| WO | 2017094918 | 6/2017 |
| WO | 2017116148 | 7/2017 |
| WO | 2017179953 | 10/2017 |
| WO | 2018006000 | 1/2018 |

OTHER PUBLICATIONS

Underwriters Laboratories Inc., "BPVV R7002 Lumber, Treated", Jan. 2011, (pp. 1-5).
Hoover Inc., "LEED and FSC Chain of Custody Information", Feb. 2016, (pp. 1).
Chemical Specialties Inc., "D-Blaze Fire Retardant Treated Wood, The New Generation Building Material", Mar. 2004, (pp. 1-2).
Treated Wood, "TimberSaver", Nov. 2017, (pp. 1-6).
Reed Construction Data, "Osmose Inc., FirePro Fire Retardant", Jan. 2004, (pp. 1-3).
ICC Evaluation Service Inc., "FirePro", Nov. 2005, (pp. 1-4).
Marketwired, "WoodSmart Solutions, Inc. Tests Hartindo AF21 in BluWood Solution", Nov. 2007, (pp. 1-2).
Marketwired, "Megola Announces AF21 Test Results", Aug. 2007, (pp. 1-2).
Marketwired, Megola Updates on Hartindo AF21, a Total Fire Inhibitor, Aug. 2010, (pp. 1-3).
Treated Wood, "Fire Retardant Treated Wood for Commercial and Residential Structures", Jan. 2012, (pp. 1-73).
Fire Retardant Coatings of Texas, "FX Lumber Guard", Nov. 2015, (pp. 1).
Qai Laboratories, "Test Report #T1003-1: FX Lumber Guard", Apr. 2015, (pp. 1-10).
Treated Wood, "D-Blaze: Fire Retardant Treated Wood", Jan. 2015, (pp. 1-13).
Arch Wood Protection Inc., "Dricon: Application Guide", Jan. 2016, (pp. 1-28).
ICC Evaluation Service Inc., "ICC-ES Listing Report: FX Lumber Guard/FX Lumber Guard XT Fire-Retardant Coatings", Oct. 2016, (pp. 1-3).
ICC Evaluation Service Inc., "ICC-ES Report: Pyro-Guard Fire Retardant-Treated Wood", Dec. 2016, (pp. 1-8).
Intelligent Wood Systems, "Treated Timber—Customer Information", Nov. 2016, (pp. 1-8).
Intelligent Wood Systems, "IWS FR Fire Retardant Treated Wood Corrosion Information", Jan. 2016, (pp. 1).
Intelligent Wood Systems, "Treated Timber—Consumer Information", Nov. 2016, (pp. 1-15).
Eco Building Products Inc, "Eco Red Shield Material Safety Data Sheet : Wood Dust", Jun. 2005, (pp. 1-2).
LSU Agcenter Wood Durability Laboratory, "Eco Red Shield:Technical Specifications—Strength Testing", Aug. 2011, (pp. 1-21).
Eco Building Products, "Technical Bulletin: Corrosive Effects From Eco Red Shield Coatings", Jan. 2011, (pp. 1).
Underwriters Laboratories Inc., "Greenguard Certification Test for Eco Building Products, Inc.: Eco Red Shield—01", Mar. 2015, (pp. 1-21).
DRJ, "Technical Evaluation Report: Eco Red Shield Fire Treated Wood Protection Coating", Apr. 2016, (pp. 1-8).
Eco Building Products, "Safety Data Sheet: Eco Red Shield", May 2016, (pp. 1-6).
CSE Inc, "AC479: Proposed AC for Wood Structural Panels with Factory-Applied Fire-Retardant Coating", Feb. 2017, (pp. 1-101).
ASTM International, "Standard Test Method for Hygroscopic Properties of Fire-Retardant Wood and Wood-Based Products", Jul. 2013, (pp. 1-3).
ASTM International, "Standard Test Method for Extended Duration Surface Burning Characteristics of Building Materials (30 min Tunnel Test)," Aug. 2011, (pp. 1-4).
PHOS-CHEK, "Protect Your Home From Wildfire", Nov. 2017, (pp. 1-4).
American Wood Council, "Design for Code Acceptance: Flame Spread Performance of Wood Products Used for Interior Finish", Apr. 2014, (pp. 1-5).
Glenalmond Timber Company, "IWS FR Fire Retardant Treated Wood: Corrosion Information", Nov. 2017, (pp. 1).
Bank Insurance, Michael D. White, "How Benjamin Franklin Became the 'Father of Insurance'", Dec. 1998, (pp. 1-3).
ASTM International, "Standard Test Method for Evaluating the Flexural Properties of Fire-retardant Treated Softwood Plywood Exposed to Elevated Temperatures", May 2001, (pp. 1-7).
Treated Wood "D-Blaze Fire Retardant Treated Wood: The New Generation Building Material", Mar. 2004, (pp. 1-2).
Marketwire, "Megola Updates on Hartindo AF21, a Total Fire Inhibitor", Aug. 4, 2010, (pp. 1-3).
Mike H. Freeman, Paul Kovacs, "Metal and Fastener Corrosion in Treated Wood from an Electrochemical—Thermodynamic Standpoint", Jan. 2011, (pp. 1-22).
D.G. Fraser, "Break the Flame Chain Reaction", Jun. 1962, (pp. 1-3).
National Fire Protection Association, "Standard for Fire Retardant-Treated Wood and Fire-Retardant Coatings for Building Materials", Jan. 2015, (pp. 1-16).
Structural Building Components Association, "Fire Retardants and Truss Design", Jan. 2015, (pp. 1-48).
Western Wood Preservers Institute, "Fire Retardant Wood and the 2015 International Building Code", Jan. 2015, (pp. 1-2).
ASTM International, "Standard Test Method for Evaluating the Effects of Fire-Retardant Treatments and Elevated Temperatures on Strength Properies of Fire-Retardant treated Lumber", Jul. 2010, (pp. 1-6).

(56) References Cited

OTHER PUBLICATIONS

Marketwired, "Megola Obtains Class A Rating for Hartindo AF31", Nov. 2007, (pp. 1-2).
Marketwire, "Megola Inc. Signs 'Hartindo AF21' Licensing Agreement with Eco Blu Products, Inc.", Nov. 2009, (pp. 1-2).
Marketwired, "Megola Sells Hartindo AF21, a Total Fire Inhibitor, to One of the World's Largest Textile and Chemical Manufactures", Aug. 2010, (pp. 1-3).
Marketwired, "Megola Continues Sales of Hartindo AF21 to EcoBlu Products, Inc.", Dec. 2010, (pp. 1-2).
Woodworking Network, "Megola to Buy Wood-Protecting Hartindo AF21 Fire Inhibitor", Aug. 2011, (pp. 1-2).
Hoover Inc., "Exterior Fire-X Treated Wood: Material Safety Data Sheet", Oct. 2005, (pp. 1-9).
Fire Safe Council, "Get Ready for Fire Season—Fire Safe Your Home", Nov. 2017, (pp. 1).
Rossroof Group, "Tilcor: High Performance Roofing Systems", Nov. 2017, (pp. 1-2)).
Western Wood Products Association, "Flame-spread Ratings & Smoke-Developed Indices; Conformance with Model Building codes", Nov. 2017, (pp. 1-2).
Forest Products Laboratory, Robert H. White, Mark A. Dietenberger, "Chapter 17: Fire Safety", Feb. 1999, (pp. 1-17).
Hoover Wood Products, "Exterior Fire-X Material Safety Data Sheet", Oct. 2005, (pp. 1-5).
Honeywell, "Viewguard PIR", Jan. 2007, (pp. 1-2).
Hardwood Plywood & Veneer Association, "Report on Surface Burning Characteristics Determined by ASTM E 84 Twenty-Five Foot Tunnel Furnace Test Method", Jan. 2008, (pp. 1-7).
Insurance Institute for Business & Home Safety, "Protect Your Property from Wildfire", Jan. 2011, (pp. 1-40).
Chemical Online, "Mse Enviro-Tech Corp. Introduces Dectan", May 2007, (pp. 1).
Fike, "MicroMist: the Self Contained Fire Protection Alternative", Aug. 2012, (pp. 1-2).
Thomas Schroeder, Klaus Kruger, Felix Kuemmerlen, "Fast Detection of Deflagrations Using Image Processing", Jan. 2012, (pp. 1-113).
James Hardie Technology, "HardieBacker: With Moldblock Technology", Jan. 2012, (pp. 1-10).
Jerrold E. Winandy, Qingwen Wang, Robert E. White, "Fire-Retardant-Treated Strandboard: Properties and Fire Performance", May 2007, (pp. 1-10).
Tom Toulouse, Lucile Rossi, Turgay Celik, Moulay Akhloufi, "Automatic Fire Pixel Detection Using Image Processing: A Comparative Analysis of Rule-Based and Machine Learning-Based Methods", Jun. 2016, (pp. 1-8).
Col Michael Receniello, "Fire Suppression Systems (FSS) Enhance Tactical Wheeled Vehicle (TWV) Survivability", Jul. 2010, (pp. 1-3).
Charlotte Pipe and Foundry Company, "Technincal Bulletin: Understanding Flame Spread Index (FSI) and Smoke Developed Index (SDI) Ratings", Jan. 2016, (pp. 1-2).
Globe Advisors, "Study of Insurance Costs for Mid-Rise Wood Frame and Conrete Residential Buildings", Jan. 2016, (pp. 1-61).
Calgary Herald, Andrea Cox, "Homebuilder Wants Buyers to be in the Pink", Oct. 2011, (pp. 1-6).
Marioff, "Hi-Fog Water Mist Fire Protection: Fire Protection for Buildings", Jan. 2017, (pp. 1-12).
Inland Marine Underwriters Association, "CLT and Builder's Risk", May 2017, (pp. 1-26).
Asia Pacific Fire, "Approaching the Flame Fire Fighting", Jun. 2017, (pp. 1-2).
Panasonic Corporation, "PIR Motion Sensor 'PaPIRs'", Jul. 2017, (pp. 1-9).
Pillar Technologies Inc., "Pillar Technologies Presentation", Jul. 2018, (pp. 1-16).
Bete, "Low Flow", Nov. 2017, (pp. 1).
Bete, "MicroWhirl: Fine Atomization", Nov. 2017, (pp. 1).
Bete, "P: Fine Atomization", Nov. 2017, (pp. 1).
Bete, "PJ: Fine Atomization", Nov. 2017, (pp. 1).
Bete, "UltiMist", Nov. 2017, (pp. 1).
Marioff, "Hi-Fog System Components", Nov. 2017, (pp. 1-2).
AIG, "AIG Global Property Construction Risk Engineering", Nov. 2017, (pp. 1-6).
Plumis, "Automist Smartscan Handbook" Jan. 2017, (pp. 1-66).
LA Times, Sam Byker, "Fire Retardants That Protect the Home", Nov. 25, 2007, (pp. 1-4).
Firetect, "Safe-T-Guard Product Data Sheet", Apr. 2008, (pp. 1-6).
International Fire Chiefs Association, "Guidelines for Managing Private Resources on Wildland Fire Incidents", Jan. 2016, (pp. 1-2).
ICL Performance Products LP, "Material Safety Data Sheet", Jul. 2014, (pp. 1-6).
Simplex Aerospace, "Spray Systems Overview", Jan. 2016, (pp. 1-3).
Tyco Fire Products, "AquaMist: Watermist Fire Protection", Jan. 2013, (pp. 1-7).
Tyco Fire Products, "AquaMist", Jan. 2016, (pp. 1-5).
Treehugger, Lloyd Alter, "Wood Frame Construction is Safe, Really", Dec. 2014, (pp. 1-5).
Danfoss Semco Fire Protection, "Sem-Safe: High-Pressure Water Mist System", Feb. 2014, (pp. 1-8).
Fike, "Cheetah XI: Intelligent Suppression Control System", Sep. 2012, (pp. 1-6).
Fike, "Intelligent Photoelectric Detector", Mar. 2014, (pp. 1-2).
Cyril N. Hinshelwood, "Chemical Kinetics in the Past Few Decades", Nobel Lecture, Dec. 1956, (pp. 1-11).
Diversified Protection Systems Inc., "Fire Protection Protection Presentation", Jan. 2004, (pp. 1-35).
Joseph W. Mitchell, Oren Patashnik, "Firebrand Protection as the Key Design Element for Structure Survival During Catastrophic Wildland Fires", Aug. 2006, (pp. 1-15).
Joseph W. Mitchell, M-Bar Technologies and Consulting, "Wind-Enabled Ember Dousing: A Comparison of Wildland Fire Protection Strategies", Aug. 2008, (pp. 1-53).
Mike Kirby, Fire Rescue, "Nozzles Types, Pros and Cons", Jun. 2012, (pp. 1-7).
FM Approvals, "American National Standard for Water Mist Systems", Nov. 2017, (pp. 1-191).
FM Approvals, "Approval Standard for Water Mist Systems", Apr. 2016, (pp. 1-314).
Dr. Anthony E. Finnerty, U.S. Army Research Laboratory, "Water-Based Fire-Extinguishing Agents", Jan. 1995, (pp. 1-12).
Clive Buckley and David Rush, Ministry of Defence, "Water Mist Developments for the Royal Navy", Apr. 1996, (pp. 1-14).
Michelle D. King, Jiann C. Yang, Wendy S. Chien, William L. Grosshandler, "Evaporation of a Small Water Droplet Containing an Additive", Aug. 1997, (pp. 1-6).
BETE, "BETE Announces High-Performance Nozzles for Fire Protection Systems", Nov. 2017, (pp. 1-2).
Surfire Services Limited, "UltraGuard: The personal protection system from Surefire", Nov. 2017, (pp. 1-3).
NFPA, "Standard on Water Mist Fire Protection Systems", Feb. 2006, (pp. 1-135).
Roseburg Forest Products, "Wood I-Joists", Jan. 2016, (pp. 1-6).
Conrad Forest Products, "Bluwood: The Color of Protection", http://www.conradfp.com/building-products-bluwood.php, Nov. 2017, (pp. 1-8).
The University of Chicago, Salen Churi, Harrison Hawkes, Noah Driggs, "Internet of Things: Risk Manager Checklist, U.S.", Dec. 2016, (pp. 1-23).
DRJ, "AAF21 Fire Treated Wood Protection Coating Applied to Lumber", Sep. 2017, (pp. 1-8).
FM Approvals, "Approval Standard for Residential Automatic Sprinklers for Fire Protection", Aug. 2009, (pp. 1-68).
FM Approvals, "Approval Standard for Video Image Fire Detectors for Automatic Fire Alarm Signaling", Dec. 2011, (pp. 1-22).
FM Approvals, ANSI, "American National Standard for Radiant Energy-Sensing Fire Detectors for Automatic Fire Alarm Signaling", Feb. 2014, (pp. 1-16).
FM Approvals, "Approval Standard for Spark Detection and Extingushing Systems", Nov. 2015, (pp. 1-32).

(56) References Cited

OTHER PUBLICATIONS

FM Approvals, "Approval Standard for Heat Detectors for Automatic Fire Alarm Signaling", Jan. 2018, (pp. 1-29).
FM Approvals, "Approval Standard for Radiant Energy-Sensing Fire Detectors for Automatic Fire Alarm Signaling", Jan. 2018, (pp. 1-17).
FM Approvals, "Approval Standard for Automatic Sprinklers for Fire Protection", Feb. 2018, (pp. 1-119).
Fire Retardant Coatings of Texas, "FX Lumber Guard XT: Technical Data Submittal Sheet", Aug. 2018, (pp. 1).
Fire Retardant Coatings of Texas, M. Mueller, "Residential Home Builders", Oct. 2016, (pp. 1-5).
Fire Retardant Coatings of Texas, M. Mueller, "Architects", Oct. 2016, (pp. 1-5).
Fire Retardant Coatings of Texas, "FX Lumber Guard: Technical Data Submittal Sheet", Aug. 2018, (pp. 1).
Trusjoist, Weyerhauser, "Fire-Rated Assemblies and Sprinkler Systems", May 2017, (pp. 1-24).
NRCC, Zhigang Liu, Andrew K. Kim, "A Review of Water Mist Fire Suppression Technology: Part II—Application Studies", Feb. 2001, (pp. 1-29).
Defence Research and Development Canada, John A. Hiltz, "Additives for Water Mist Fire Suppression Systems—A Review", Nov. 2012, (pp. 1-40).
Elsevier, Zhang Tianwei, Liu Hao, Han Zhiyue, Du Zhiming, Wang Yong, "Research Paper: Active Substances Study in Fire Extinguishing by Water Mist with Potassium Salt Additives Based on Thermoanalysis and Thermodynamics", May 2017, (pp. 1-10).
Mark L. Robin, FS World, "Fire Detection & Suppression", Apr. 2011, (pp. 1-10).
Robert L. Darwin, Hughes Associates Inc., "Aircraft Carrier Flight and Hangar Deck Fire Protection: History and Current Status", Jan. 2001, (pp. 1-102).
FLIR, "VUE Pro: Thermal Camera for sUAS", Jul. 2009, (pp. 1-2).
FLIR, "FLIR K2 Brochure", May 2015, (pp. 1-2).
FLIR, "FLIR KF6 Datasheet", Jan. 2016, (pp. 1-2).
FLIR, "A65/A35/A15/A5 Brochure", Sep. 2014, (pp. 1-2).
FLIR, "FLIR C3 Brochure", Dec. 2016, (pp. 1-2).
FLIR, "FLIR A65", Jan 2018, (pp. 1-7).
FLIR, "FLIR AX8 Brochure", Nov. 2017, (pp. 1-2).
FLIR, "Application Story: Impact Thermal Imaging Camera From FLIR Continuously Monitors Packaging Quality", Nov. 2017, (pp. 1-2).
NFPA, "Certified Fire Protection Specialist: Candidate Handbook", Apr. 2018, (pp. 1-34).
Flir, "FC-Series R: Fixed Network thermal Cameras", Nov. 2017, (pp. 1-2).
National Instruments, "IMAQ Vision Concepts Manual", Oct. 2000, (pp. 1-313).
FLIR, "IR Automation Guidebook: Temperature Monitoring and Control with IR Cameras", Jan. 2018, (pp. 1-68).
FLIR, "Thermal Imaging for Machine Vision and Industrial Safety Applications", Aug. 2014, (pp. 1-12).
FLIR, "User's Manual: FLIR A3xx Series", May 2016, (pp. 1-126).
FLIR, "FLIR A315/A615", Jan. 2018, (pp. 1-8).
FLIR, "FLIR AA315 f", Jan. 2018, (pp. 1-4).
FLIR, "FLIR FC-Series R (Automation)", Jan. 2018, (pp. 1-5).
FLIR, "Integration AX8 & A-B Overview", Oct. 2017, (pp. 1-9).
FLIR, "M100/M200 Series: Quick Start Guide", Oct. 2017, (pp. 1-5).
FLIR, "M100/M200 Series: Installation & Operation Instructions", Oct. 2017, (pp. 1-112).
FLIR, "FLIR ONE Pro Series: Professional-Level Thermal Imaging for Your Smartphone", Jun. 2018, (pp. 1-2).
FLIR, "FLIR ONE Pro Series Datasheet", Jun. 2018, (pp. 1-2).
Hoover Inc., "Pyro-Guard, Exterior Fire-X", Dec. 2017, (pp. 1-12).
FLIR, "FLIR Saros: Multi-Spectral Intrusion Solution", Jan. 2018, (pp. 1-3).
Firefy AB, "Firefly Conveyer Guard: Fire Protection Solution for Conveyers", Nov. 2017, (pp. 1-4).
Firefly AB, "Firefly EXIMO Brochure", Nov. 2017, (pp. 1-8).
Firefly AB, "Firefly Training Brochure", Nov. 2017, (pp. 1-4).
Firefly AB, "Firefly Spark Detection: Higher Safety with Patented Technology", Jan. 2018, (pp. 1-12).
Hansentek, Model 120 Spark Detector Brochure, Nov. 2017, (pp. 1-2).
Patol, "500 Series: Model 5410 Infra-Red Transit Heat Sensor Infosheet", Nov. 2017, (pp. 1-2).
Boss Products, "EcoMAXX Brochure", Apr. 2016, (pp. 1-2).
Bruker, "S1 Titan Brochure", Nov. 2017, (pp. 1-8).
Hoover, '2hr Fire Resistant Load Bearing Wall'', Nov. 2017, (pp. 1).
ECO Building Products, "ECO Disaster Break: Class A Fire Rated, UV Resistant, High Performance, Non-Toxic, Acrylic Coating", Feb. 2013, (pp. 1).
ECO Building Products, "Affiliate Program Screenshots", Apr. 2013, (pp. 1-3).
Fire Retardant Coatings of Texas, "FlameStop Screenshots", Nov. 2017, (pp. 1-2).
Fire Retardant Coatings of Texas, "Fx Flame Guard Screenshot", Nov. 2017, (pp. 1).
RDR Technologies, "BanFire Screenshot", Nov. 2017, (pp. 1).
Lousiana-Pacific, "LP Solutions Software", Mar. 2012, (pp. 1-8).
RDR Technologies, Fire Retardant Coatings of Texas, "FX Lumber Guard Screenshots", Nov. 2017, (pp. 1-2).
Fire Retardant Coatings of Texas, "Product Certifications & Featured Products Screenshots", Nov. 2017, (pp. 1-4).
Fire Retardant Coatings of Texas, "Product Certifications Screenshot", Nov. 2017, (pp. 1).
Fire Retardant Coatings of Texas, "Safety Data Sheet Screenshot", Nov. 2017, (pp. 1).
Fire Retardant Coatings of Texas, "Fx Lumber Guard Screenshot", (pp. 1).
Newstar Chemicals, Hartindo Anti Fire Products, Nov. 2017, (pp. 1).
Natural Fire Solutions, "Website Screenshots", Nov. 2017, (pp. 1-4).
Wikipedia, "Phos-Chek Screenshots", Nov. 2017, (pp. 1-3).
Carole Walker, Director Rmiia, Presentation—"Wildfire & Insurance: Insurance Communications Challenges & Opportunities", Sep. 2018 (8 Pages).
Insurance Institute for Business & Home Safety (IBHS), Oct. 22, 2018, "Colorado Property & Insurance WildfirePreparedness Guide", 2018 (2 Pages).
Sam Baker, "Fire Retardants That Protect the Home", LA Times, Nov. 25, 2007, https://www.latimes.com/business/realestate/la-re-fire25nov25-story.html, (4 Pages).
Louisiana-Pacific, "FlameBlock: Assemblies and Applications", Aug. 2017, (pp. 1-8).
Marketwired, "MSE Enviro-Tech Corp.'s AF31 Fire Extinguishing Agent Addresses Need for More Effective Forest Fire Fighting Technology", Jul. 2007, (pp. 1-2).
Globenewswire, "Shazamstocks.com Announces Profile Launch of MSE Enviro-Tech Corp.", Feb. 2008, (pp. 1-3).
Benzinga, "Megola Inc. Files Application to Underwriter Laboratories for Certification", May 2010, (pp. 1-3).
Intertek, "Report of Testing FX Lumber Guard Fire Retardant for I-Joist, Truss Joist (TJI), FLoor Joist, Ceiling Joist, amd OSB", Mar. 2013, (pp. 1-9).
Intertek, "Report of Testing FX Lumber Guard", Nov. 2014, (pp. 1-9).
Intertek, "Report of Testing FX Lumber guard Fire Retardant Coating Applied to I-Joists in a Floor Celing Assembly", Aug. 2014, (pp. 1-6).
Intertek, "Report of Testing FX Lumber Guard on SPF Lumber", Jun. 2012, (pp. 1-6).
Intertek, "Report of Testing FX Lumber Guard (Dimensional Lumber)", Apr. 2015, (pp. 1-10).
Intertek, "Report of Testing FX Lumber Guard", Aug. 2015, (pp. 1-6).
Fire Retardant Coatings of Texas, "FX Lumber Guard", Sep. 2016, (pp. 1).
Fire Retardant Coatings of Texas, "Safety Data Sheet (SDS)" Mar. 2016, (pp. 1-7).

(56) References Cited

OTHER PUBLICATIONS

Intertek, "Building & Construction Information Bulletin: Introduction to Astm E84 & Frequently Asked Questions", Jun. 2017, (pp. 1-2).
Hoover Inc., "Exterior-Fire X", Nov. 2017, (pp. 1).
Hoover Inc., "Pyro-Guard", Nov. 2017, (pp. 1).
Marleyeternit, "JB FireSafe Scaffold Boards", Jan. 2016, (pp. 1-2).
Flamestop, "Flamestop I-DS: Fire Retardant for Foam, Thatch, and Porous Materials", Jan. 2017, (pp. 1-3).
Flamestop, "Flamestop II: Fire Retardant Spray for Wood", Jan. 2017, (pp. 1-3).
Flamestop, "Learn About Flamestop Inc.", Jan. 2017, (pp. 1-3).
Lousiana-Pacific, "FlameBlock: Assemblies and Applications", Aug. 2017, (pp. 1-8).
Magtech, "MagTech OSB", Nov. 2017, (pp. 1-2).
Hoover Inc., "Fasteners for Pyro-Guard: Interior Fire Retardant Treated Wood Products", Oct. 2013, (pp. 1).
Hoover Inc., "Code References: Fire-Retardant-Treated Wood", Mar. 2014, (pp. 1-2).
Hoover Inc., "Guidelines for Finishing and Use of Adhesives with Pyro-Guard Fire Retardant Treated Wood", Jan. 2014, (pp. 1).
Hoover Inc., "Specification for Pyro-Guard: Interior Fire Retardant Treated Wood", Apr. 2014, (pp. 1).
Hoover Inc., "Pyro-Guard Storage, Handling, and Installation Recommendations", Jan. 2014, (pp. 1).
Department of the Navy, "Military Specification: Lumber and Plywood", Jun. 1984, (pp. 1-16).
Underwriters Laboratories, "Report on Structural Stability of Engineered Lumber in Fire Conditions", Sep. 2008, (pp. 1-178).
American Wood Council, "2015 NDS Changes", Jul. 2015, (pp. 1-66).
Intertek, "Report of Testing 7'×7' Floor/Ceiling Assembly", Aug. 2013, (pp. 1-6).
Realfire® Realtors Promoting Community Wildfire Awareness, Eagle County, Colorado, "Wildfire Reference Guide: A Guide for Realtors® to Assist Home Sellers & Buyers With Understanding Wildfire", http: www.REALFire.net , Mar. 2017 (8 Pages).
Megola, "Re: File No. 0-49815—Response to Comments—Form 10K for Fiscal Year Ended Jul. 31, 2009", Sep. 2010, (pp. 1-4).
Carol Walker, Executive Director of RMIIA, "Wildfire & Insurance: Insurance Communications Challenges a& Opportunities", https://www.iii.org/sites/default/files/docs/pdf/cc_presentation_carole_walker_111416.pdf , Oct. 2016, (8 Pages).
3M, Building and Commerical Services Division, "Brochure for 3M FireDam™ Spray 200 Sealing Agent", 2009,(2 Pages).
Wildfire Defense Systems, Inc., Web Brochure on WDSPRo Mobile Application for Wildfire Hazard Property Assessment, 2017, (3 Pages).
Wildfire Defense Systems, Inc., Web Brochure on WDSFire Wildfire Reporting Dashboard Service for Wildfire Risk During an Active Wildfire, 2017, (2 Pages).

* cited by examiner

REMOTELY-CONTROLLED SOLENOID-OPERATED SOFFITT AIR-VENT OF PRESENT INVENTION

REMOTELY-CONTROLLED SOLENOID-OPERATED SOFFITT AIR-VENT

REMOTELY-CONTROLLED SOLENOID-OPERATED
ATTIC LOUVER AIR-VENT OF PRESENT INVENTION

REMOTELY-CONTROLLED SOLENOID-OPERATED WINDOW STRUCTURE OF PRESENT INVENTION

GPS-TRACKED MOBILE ANTI-FIRE (AF) CHEMICAL LIQUID SPRAY SYSTEM

METHODS OF AND SYSTEM NETWORKS FOR WIRELESS MANAGEMENT OF GPS-TRACKED SPRAYING SYSTEMS DEPLOYED TO SPRAY PROPERTY AND GROUND SURFACES WITH ENVIRONMENTALLY-CLEAN WILDFIRE INHIBITOR TO PROTECT AND DEFEND AGAINST WILDFIRES

RELATED CASES

The present patent application is a Continuation-in-Part (CIP) of: copending application Ser. No. 16/055,001 filed Aug. 3, 2018; copending application Ser. No. 15/866,451 filed Jan. 9, 2018; co-pending application Ser. No. 16/039,291 filed Jul. 18, 2018 which is a Continuation-in-Part (CIP) of copending patent application Ser. No. 15/874,874 filed Jan. 18, 2018, which is a Continuation-in-Part (CIP) of copending patent application Ser. No. 15/866,454 filed Jan. 9, 2018 which is a Continuation-in-Part (CIP) of copending patent application Ser. No. 15/829,914 filed Dec. 2, 2017; copending U.S. patent application Ser. No. 15/925,793 filed Mar. 20, 2018; and copending patent application Ser. No. 15/866,456 filed Jan. 9, 2018 which is a Continuation-in-Part (CIP) of copending patent application Ser. No. 15/829,914 filed Dec. 2, 2017, each said Patent Application being incorporated herein by reference as if fully set forth herein.

BACKGROUND OF INVENTION

Field of Invention

The present invention is directed towards improvements in science and technology applied in the defense of private and public property, and human and animal life, against the ravaging and destructive forces of wildfires whether caused by lightening, accident, arson or terrorism.

Brief Description of the State of Knowledge in the Art

The US federal government is spending billions of US dollars annually on wildfire defense, only to lose record numbers of acreage and homes.

In 2017, over 8 million acres were scorched by wildfires. The fires killed more than 40 people and destroyed 8000 structures. Some estimates of the property damage in Northern California fires exceed $3 billion. Governor Brown of California has asked President Trump for $7.5 billion dollars to rebuild Santa Rosa.

Despite extensive news coverage, few recognize that wildfire embers fly long distances based on the relative humidity of the air. If there is low humidity, then these embers can fly from dry grass hillsides, like outside Santa Rosa, and ignite and destroy entire neighborhoods of homes. A primary reason this is possible is because most production houses have attic-ventilation screens, designed as illustrated in FIGS. 2A and 2B, to allow wind-driven hot wildfire embers to fly into hot combustible attics, and burn the entire house down from the attic to the ground.

In recent years, some measures have been made to provide closable attic vents as shown in FIGS. 3A, 3B and 3C, and closable soffit air vents as shown in FIGS. 5A, 5B and 5C. Even attic and roof sprinkler systems as disclosed in US Patent Application Publication No. 2018/0078801, for example, are being proposed for buildings to provide defense against wildfires.

However, even with such measures, most homes and buildings are still very vulnerable to wildfire ember storms when they strike a neighborhood. This is especially true when wildfires are driven by strong prevailing winds, as illustrated in FIG. 6A, attacking homes and buildings by radiant heat, direct flame contact, burning debris (e.g. wildfire embers) and wind. As illustrated in FIG. 6B, the energy and turbulence of a wildfire ember storm will rage furiously especially in very dry, low relative-humidly climates.

Various conventional methods have been used for fighting and defending against wildfires, namely: aerial water dropping; aerial fire retardant chemical (e.g. Phos-Chek® Fire Retardant) dropping; physical fire break by bulldozing, to stall the advance of wildfire; physical fire break by preburning, to stall the advance of wildfire; and chemical fire break by dropping fire retardant chemical such as Phos-Chek® chemical over land, to stall the advance of wildfire. While these methods are used, the results have not been adequate in most instances where wildfires are raging across land under strong winds. And millions of homes have been left completed undefended and vulnerable against wildfire ember storms.

Recently, the State of California deployed its CAL FIRE™ mobile application for smartphones and other mobile computing devices. The purpose of this mobile application is to provide users with (i) notifications on where wildfires are burning at a given moment in time, (ii) notifications on the risks of wildfire in certain regions, (iii) helpful ways of preparing for wildfires, and (iv) other useful information to help people stay out of harm's way during a wildfire. However, in its current state, this wildfire notification system does little to help home and business owners to proactively defend their homes and business against raging forces of wildfires and wildfire ember storms, in any meaningful way.

Clearly, conventional fire suppression methods are not working as needed to protect neighborhoods, homes, businesses and human life from the raging forces of wildfires. While more money is being spent and more people are being deployed to fight wildfires using conventional methods and technologies, the benefits are not being realized.

Therefore, there is a great need for new and improved methods of and apparatus for suppressing wildfires and providing improved defense and protection to property and life alike, while overcoming the shortcomings and drawbacks of prior art methods and apparatus.

OBJECTS AND SUMMARY OF THE PRESENT INVENTION

Accordingly, a primary object of the present is to provide a new and improved wildfire ember suppressing filter system adapted for refitting into the standard size holes formed in the air-flow board mounted between each set of rafter beams in the roof structure of a wood-framed building, wherein the wildfire ember suppressing filter comprises a filter fabric infused with an anti-fire (AF) liquid that breaks or interferes with the free-radical chemical reactions of the combustion phase of fire burning on the outer surface of a combusting wildfire ember.

Another object of the present invention is to provide a novel remotely controlled methods, systems and devices for performing operations around and within a specific building before the occurrence of a wildfire ember storm, including automatically closing air-vents, windows, filtering and extinguishing wildfire embers by clean-chemistry misting as embers are attempting to enter into the attics of such buildings when exposed to ember storms generated during a wildfire.

Another object of the present invention is to provide a new and improved method of and apparatus for automatically producing a cloud of wildfire ember suppressing mist about or in the vicinity of air-inflow entry points in a wood-framed building during a wildfire storm, wherein the cloud of wildfire ember suppressing mist consists of billions of wildfire ember suppressing microscopic droplets continuously generated by forcing environmentally clean aqueous-based anti-fire (AF) liquid through one or more misting nozzles under a predetermined hydraulic pressure so that clouds of wildfire ember suppressing mist are generated for suppressing and extinguishing wildfire embers flying about the building and into the air-inflow entry points, to reduce the risk that such flying wildfire embers do not enter the building and start a fire within the building during the wildfire storm, while avoiding the shortcomings and drawbacks of prior methods and apparatus.

Another object of the present invention is to provide a new and improved automated wildfire ember misting-type suppression system for installation about a wood-framed building so as to automatically detect when a wildfire is in the vicinity of the building and generate a cloud of wildfire ember suppressing mist about the building so as to suppress and/or extinguish flying wildfire embers seeking to find a point of entry into the building during an active wildfire storm.

Another object of the present invention is to provide a new and improved automated and remotely-controllable wildfire ember misting-type suppression system that employs an electronic wildfire ember detection device using infra-red (IR) and other thermal-imaging sensors, and relative humidity sensors, to automatically detect the presence of a wildfire in the vicinity of the wood-framed building and automatically generate a cloud of wildfire ember suppressing mist consisting of microscopic droplets of clean anti-fire (AF) liquid that (i) instantly evaporates into vapor when contacting a flying wildfire ember and (ii) breaks and/or interferes with free-radical chemical reactions supported on the surface of each combusting wildfire ember flying in the wildfire storm moving about the wood-framed building.

Another object of the present invention is to provide a new and improved and remotely-controllable automated wildfire suppression system having a lawn misting subsystem that supports two modes of operation: wherein when no wildfire storm is detected, the lawn misting subsystem automatically mists the lawn with water supplied from a local water supply; and when a wildfire storm is detected, the lawn misting subsystem automatically mists the lawn with an environmentally anti-fire (AF) liquid supplied from a local supply of anti-fire (AF) liquid.

Another object of the present invention is to provide a novel and remotely-controllable method of suppressing hot combusting wildfire embers flying above ground in a wildfire ember storm encircling a wood-framed building, by automatically detecting the presence of a wildfire storm in the vicinity of the wood-framed building, and in response thereto, automatically generating clouds of wildfire ember suppressing mist about the an-inflow entry points of the wood-framed building, wherein the wildfire ember suppressing mist consists of billions of microscopic droplets of environmentally anti-fire (AF) liquid, mixed with water, and forced through misting nozzles under hydraulic pressure to support suitable flow rates required to suppress and extinguish flying wildfire embers seeking to enter into the wood-framed building during the wildfire ember storm, by way of the microscopic misting droplets (i) instantly evaporating into vapor when contacting a flying wildfire ember and (ii) breaking and/or interferes with free-radical chemical reactions supported on the surface of each combusting wildfire ember flying in the wildfire storm moving about the wood-framed building.

Another object of the present invention is to provide a new and improved and remotely-controllable system for wildfire ember suppression and home defense system, wherein each home defense system includes a GPS-tracking and radio-controlled circuit to automatically monitor the anti-fire (AF) liquid level in its storage tank, and automatically generate electronic refill orders sent to a command center, so that a third-party service can automatically replenish the tanks of such home-based systems with anti-fire liquid when the fluid level falls below a certain level in the GPS-tracked tank.

Another object of the present invention is to provide and remotely-controllable method of and system and network for managing the supply, delivery and spraying/misting of environmentally-clean anti-fire (AF) liquid material on private and public properties to reduce the risks of damage and/or destruction to property and life caused by wildfires.

Another object of the present is to provide and remotely-controllable method of reducing the risks of damage to private property due to wildfires by centrally managed application of anti-fire chemical liquid spray to ground cover and building surfaces prior to arrival of the wildfires.

Another object of the present is to provide and remotely-controllable method of reducing the risks of damage to private property due to wildfires using a global positioning satellite (GPS) system and mobile communication messaging techniques, to direct the spray application of clean anti-fire chemical liquid prior to the arrival of a wildfire on a specific parcel of property, and the automated misting application of clean anti-fire chemical liquid during the presence of the wildfire storm on the property.

Another object of the present invention is to provide a new and improved and remotely-controllable system for wildfire suppression and home defense system, wherein each home defense spray system includes a GPS-tracking and radio-controlled circuit board to remotely monitor the location of each location-deployed home defense spray system and automatically monitor the anti-fire chemical liquid level in its storage tank, and automatically generate electronic refill orders sent to the command center, so that a third-party service can automatically replenish the tanks of such home-based systems with anti-fire liquid when the fluid level falls below a certain level in the GPS-tracked tank.

Another object of the present invention is to provide a new and improved and remotely-controllable system for wildfire suppression and home defense system, wherein the mobile application supporting the following functions: (i) sends automatic notifications from the command center to home owners with the mobile application, instructing them to spray their property and home at certain times with anti-fire chemical liquid in their tanks; (ii) the system will automatically monitor consumption of sprayed anti-fire chemical liquid and generate auto-replenish order via its onboard GSM-circuits so as to achieve compliance with the home spray-based wildfire-defense program, and report anti-fire liquid levels in each home-owner tank; and (iii) show status of wildfire risk in the region, and actions to the taken before wildfire outbreak.

Another object of the present invention is to provide a remotely-controllable and monitorable electronic wildfire ember detection network comprising a wireless network of wildfire ember detectors mounted on a network of buildings covering a significantly large area, so that early detection of a GPS-specified wildfire can be transmitted to other electronic wildfire ember detectors on other houses to provide an awareness of a wildfire present in the vicinity and automated preparation for the wildfire, in terms of automated cloud misting operations of clean anti-fire (AF) chemical liquid to inhibit and suppress wildfire embers and fire when they arrived on the premises of the protected building.

Another object of the present invention is to provide a and remotely-controllable wireless system for managing the supply, delivery, spraying/misting-application of environmentally-clean anti-fire (AF) liquid over the surfaces of private and public property to reduce the risks of damage and/or destruction caused by wildfires and wildfire embers.

Another object of the present invention is to provide a new and improved system for spraying a defensive path around a wood-framed building out in front of wildfires to make sure that an environmentally-safe fire break, created by the spray application of anti-fire (AF) liquid, defends homes from the destructive forces of raging wildfires.

Another object of the present invention is to provide a new and improved system and method of mitigating the damaging effects of wildfires by spraying environmentally-clean anti-fire (AF) chemical liquid in advance of wildfires, that do not depend on water to extinguish fire, such that, even after a month or two after spray application on dry brush around the neighborhood, the anti-fire chemical continues to work by stalling the ability of a fire to advance and consume homes.

Another object of the present invention is to provide a new wildfire-protected storage shed for installation near a building for storing and protecting the pumping system, CFIC liquid storage tank, and controller associated with the automatic wildfire ember suppression system of the present invention, during wildfire ember storms.

Another object of the present invention is to provide an environmentally-clean anti-fire chemical lawn spray paint that provides a significant defense against wildfires (i.e. a chemical wildfire break) by providing the dried grass with clean chemicals that break the free-radical chemical reactions in the combustion phase of a burning wildfire, thereby reducing the risks of wildfires to neighboring homes and buildings.

Another object of the present invention is to provide an environmentally-clean anti-fire chemical mulch or ground spray paint that provides a significant defense against wildfires (i.e. a chemical wildfire break) by providing the dried mulch and other organic material with clean chemicals that break the free-radical chemical reactions in the combustion phase of a burning wildfire, thereby reducing the risks of wildfires to neighboring homes and buildings.

These and other benefits and advantages to be gained by using the features of the present invention will become more apparent hereinafter and in the appended Claims to Invention.

BRIEF DESCRIPTION OF THE DRAWINGS

The following Objects of the Present Invention will become more fully understood when read in conjunction of the Detailed Description of the Illustrative Embodiments, and the appended Drawings, wherein.

DETAILED DESCRIPTION OF THE ILLUSTRATIVE EMBODIMENTS OF THE PRESENT INVENTION

Figure 1:
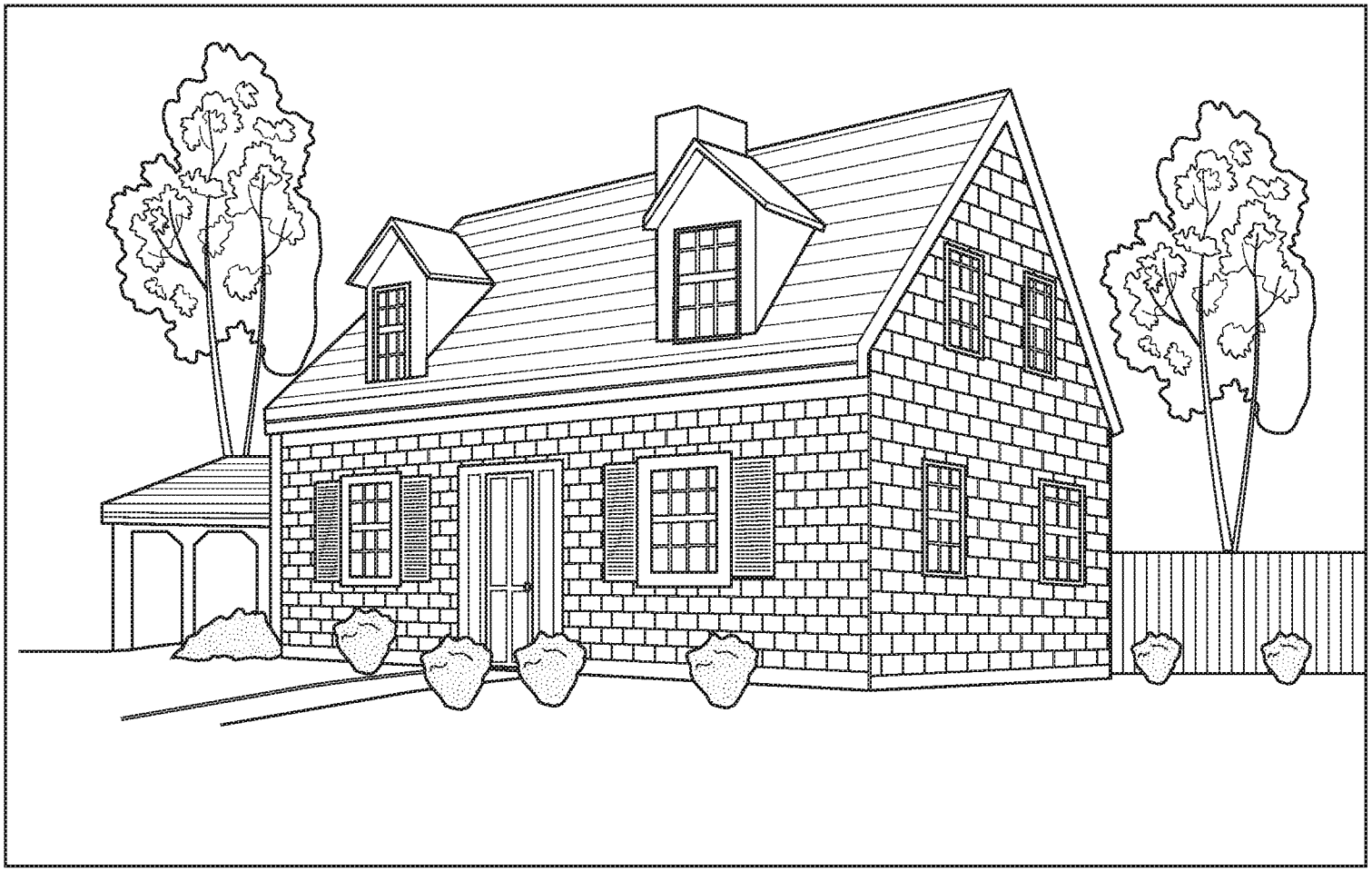
FIG. 1 (PRIOR ART)
FIG. 1 is a graphical image showing a wood-framed house on a parcel of private property surrounded by brush and trees, and vulnerable to a wildfire outbreak.
Figure 2A:
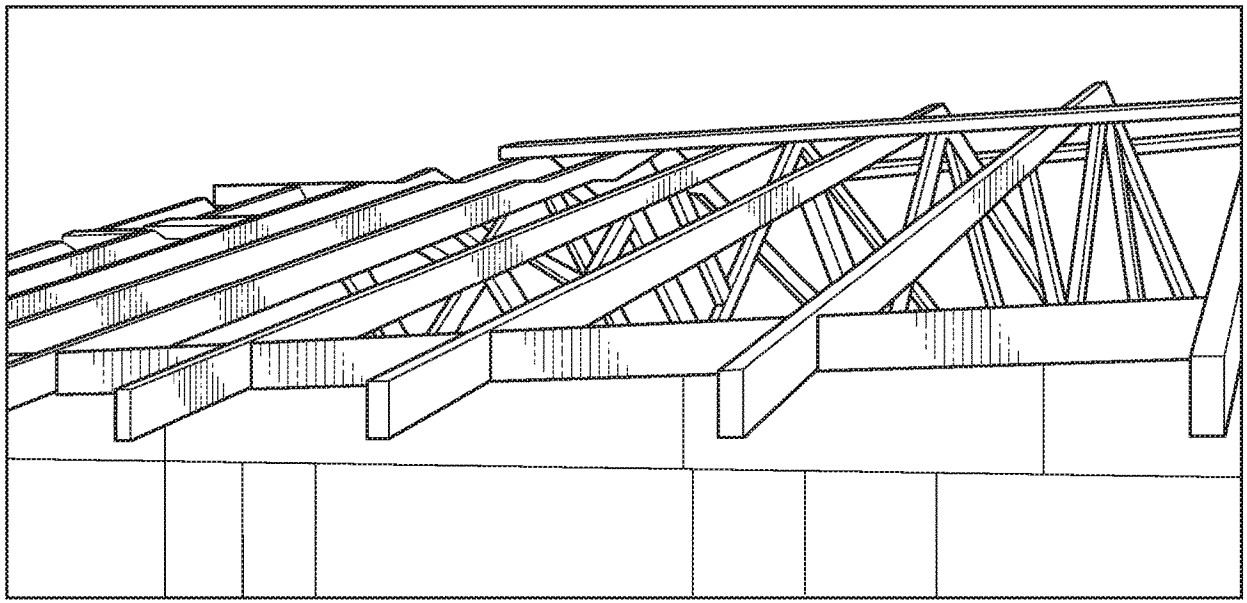
FIG. 2A (PRIOR ART)
FIG. 2A is perspective view of a wood-framed house during construction showing the rafter beams, and the attic air-inflow baffle board with a set of drilled air holes covered by a mesh screen, and mounted between the rafter beams to prevent small animals from entering the attic area of the building, through the soffit region, after construction is completed.
Figure 2B:
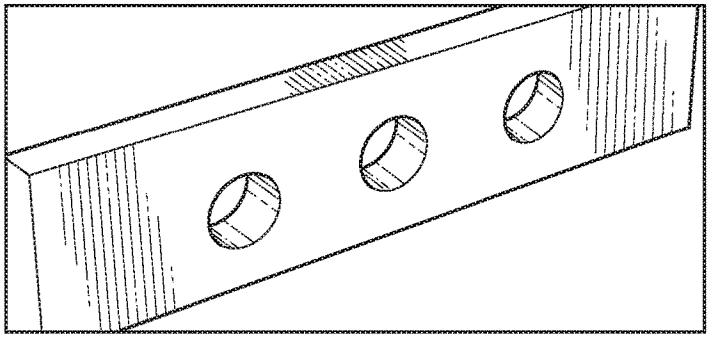
FIG. 2B (PRIOR ART)
FIG. 2B is a perspective view of the attic air-inflow baffle board shown in FIG. 2A, showing its drilled air holes, covered by mesh screen on the rear surface of the board.
Figure 3A:
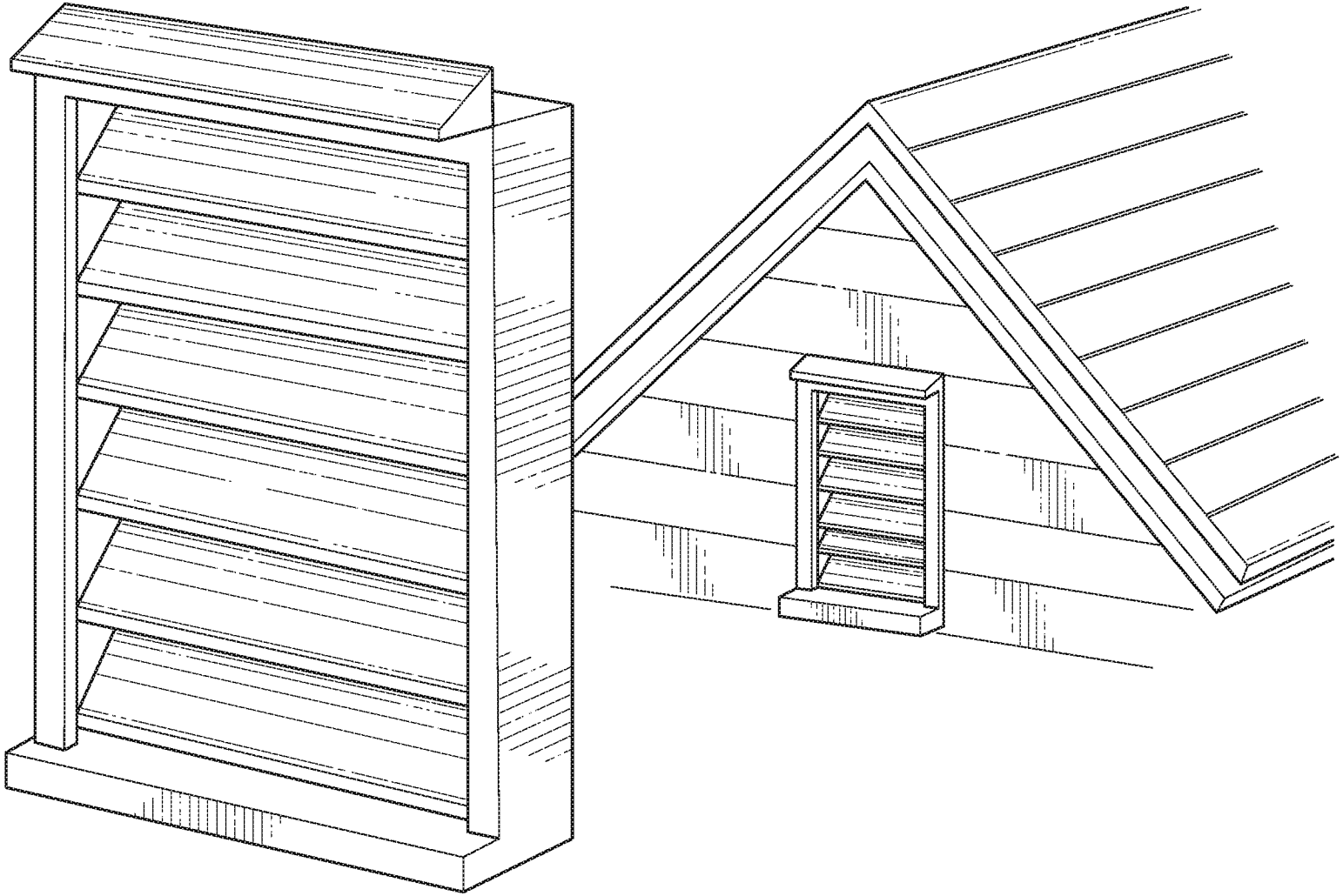
FIG. 3A (PRIOR ART)
FIG. 3A is a conventional closable attic louver vent system that can be opened and closed as required during a wildfire ember storm.
Figure 3B:
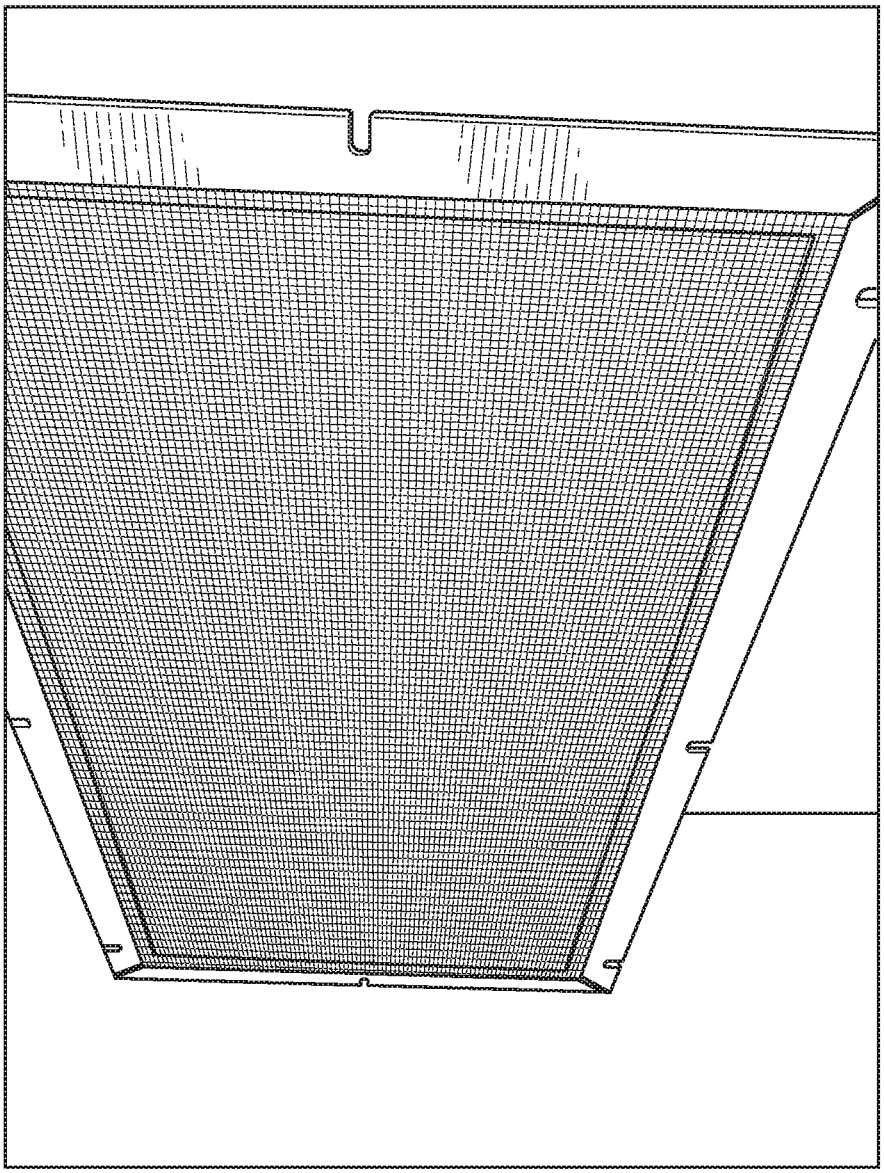
FIG. 3B (PRIOR ART)
FIG. 3B is a front view of the closable attic louver vent system shown in FIG. 3A.
Figure 3C:
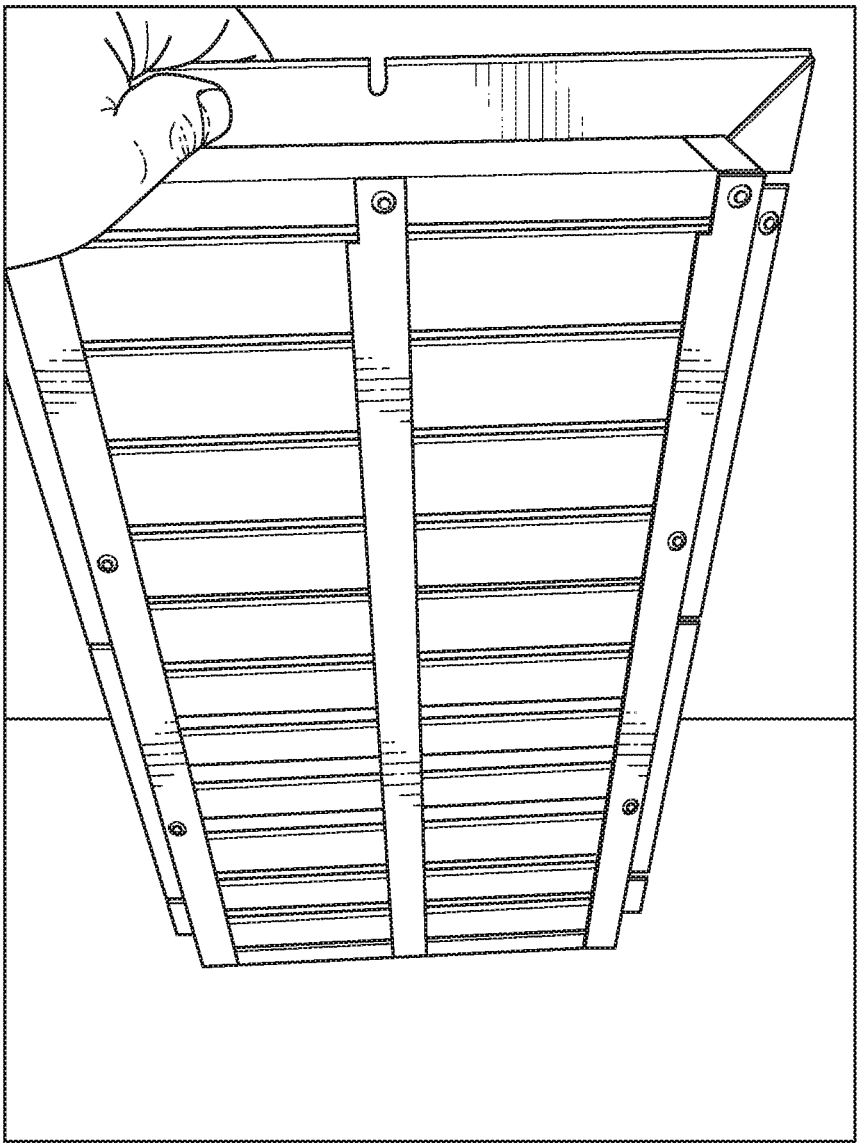
FIG. 3C (PRIOR ART)
FIG. 3C is a rear view of the closable attic louver vent system shown in FIGS. 3B and 3C.

Referring to the accompanying Drawings, like structures and elements shown throughout the figures thereof shall be indicated with like reference numerals.

Figure 6A:
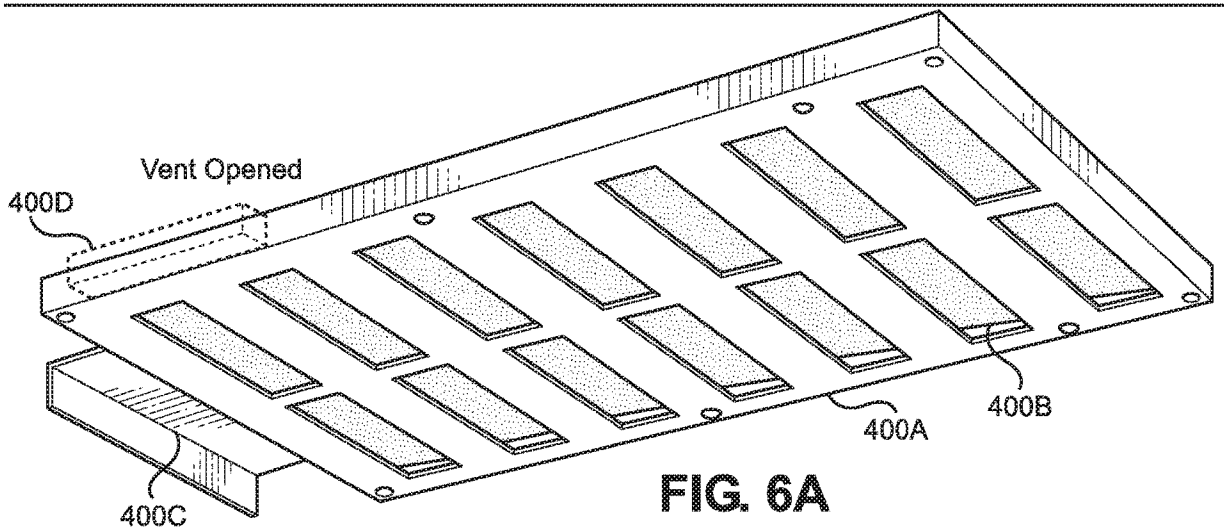
FIG. 6A is a perspective view of a remotely controlled solenoid-operated soffit vent structure of the present invention shown in its vent-open configuration, comprising a vent frame with an set of apertures and a slidable vent-blocking panel that is slidably supported/mounted in the vent frame and operated (i.e. configured in the open or closed position) by a solenoid-operated mechanism that is connected to the system controller of the wildfire ember misting, yard spraying and building air-vent control system of the present invention shown in FIGS. 13A, 13B and 13C.

Specification of a Remotely Controlled Solenoid-Operated Soffit Vent Structure of the Present Invention FIG. 6A shows the remotely-controlled solenoid-operated soffit vent structure of the present invention 400 shown in its vent-open configuration. As shown, remotely-controlled solenoid-operated soffit vent structure 400 comprises: a vent frame 400A with an set of apertures 400B and a slidable vent-blocking panel 400C that is slidably supported/mounted in the vent frame 400 and operated (i.e. configured in the open or closed position) by a solendoid-operated mechanism 400D that is connected to the controller 6B of the wildfire ember misting, yard spraying and building air-vent control system 6 shown in FIGS. 13A, 13B and 13C.

Figure 6B:
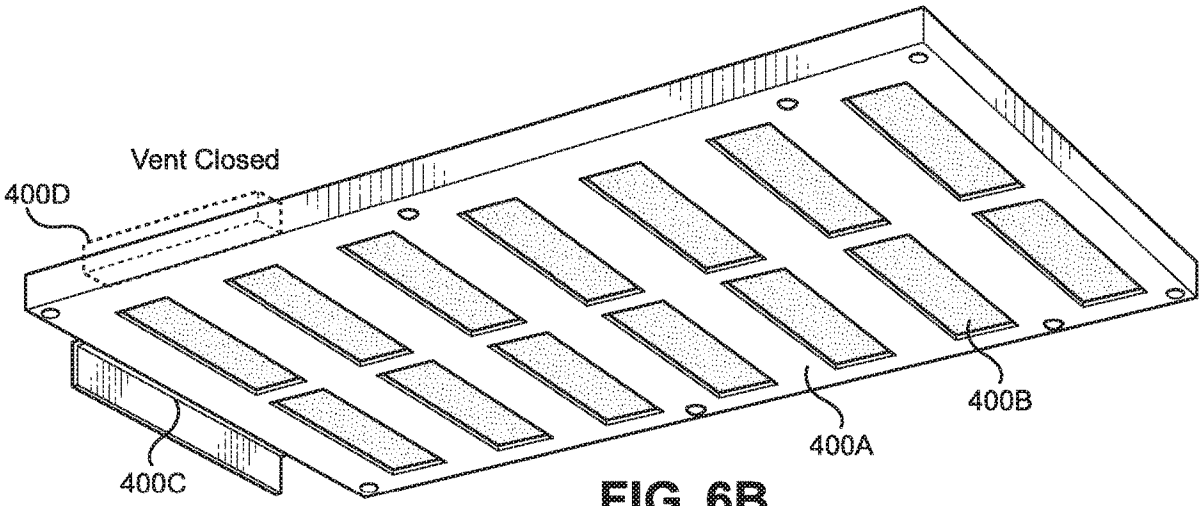
FIG. 6B is a perspective view of a remotely controlled solenoid-operated soffit vent structure of the present invention shown configured in its vent-closed configuration, comprising a vent frame with an set of apertures and a slidable vent-blocking panel that is slidably supported/mounted in the vent frame and operated (i.e. configured in the open or closed position) by a solenoid-operated mechanism that is connected to the system controller of the wildfire ember misting, yard spraying and building air-vent control system of the present invention shown in FIGS. 13A, 13B and 13C.

FIG. 6B shows the remotely-controlled solenoid-operated soffit vent structure 400 shown configured in its vent-closed configuration, to prevent wildfire embers, insects, smoke, ash and other debris from passing through the vent and entering the attic space of the building, and causing fire or other damage during a wildfire storm.

Figure 7A:
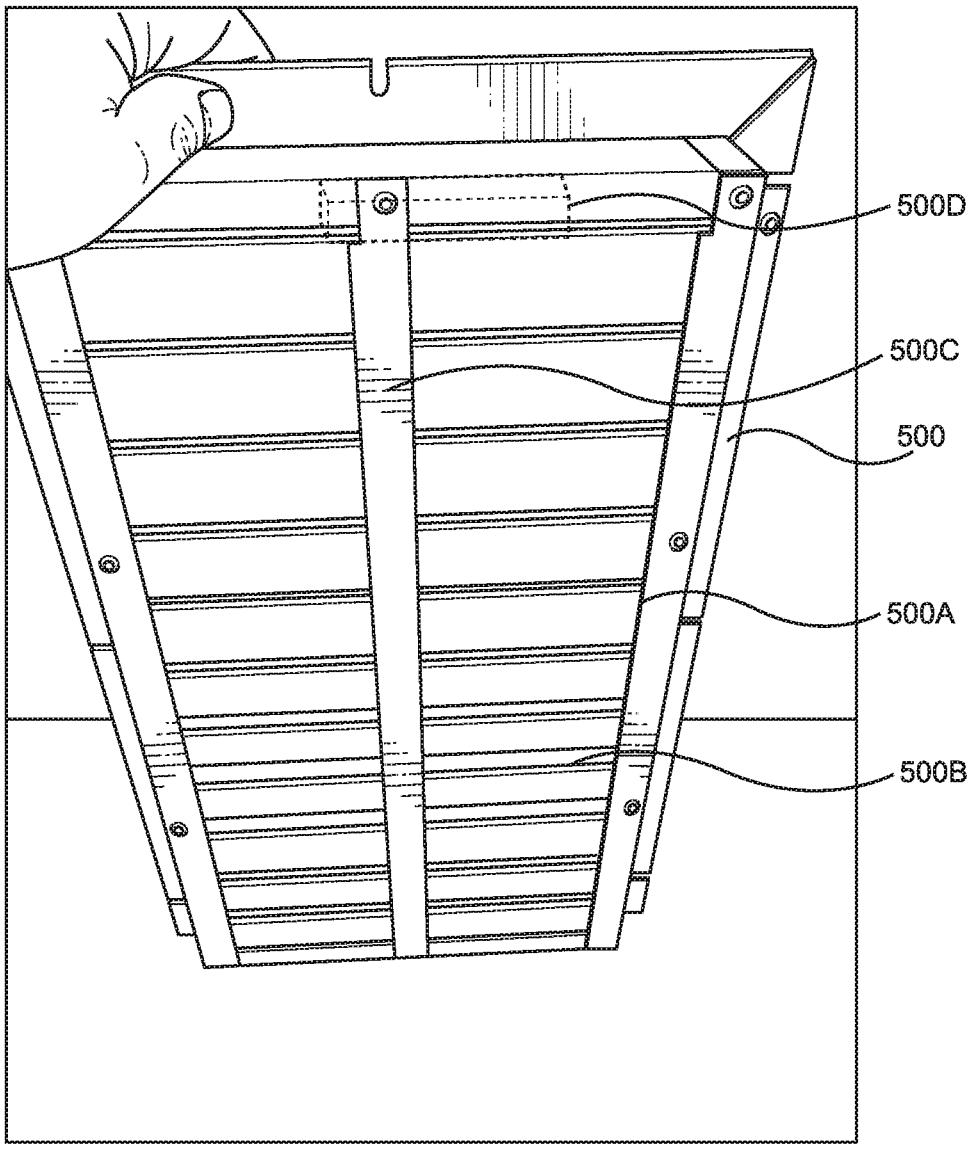
FIG. 7A is a perspective view of a remotely controlled solenoid-operated attic louver vent structure of the present invention, comprising a vent frame with an aperture and a set of louvers supported on a set of hinge structures and connected to an operating bar that is operated (i.e. configured in the open or closed position) by a solendoid-operated mechanism that is connected to the system controller of the wildfire ember misting, yard spraying and building air-vent control system of the present invention shown in FIGS. 13A, 13B and 13C.

Specification of the Remotely Controlled Solenoid-Operated Attic Louver Vent Structure of the Present Invention FIG. 7A shows the remotely-controlled solenoid-operated attic louver vent structure of the present invention 500 shown in its vent-open configuration. As shown, the vent structure 500 comprises: a vent frame 500A with an aperture 500B and a set of louvers 500C supported on a set of hinge structures and connected to an operating bar 500D that is operated (i.e. configured in the open or closed position) by a solendoid-operated mechanism 500E that is connected to the controller 6B of the wildfire ember misting, yard spraying and building air-vent control system of the present invention shown in FIGS. 13A, 13B and 13C.

When the remotely-controlled solenoid-operated soffit vent structure 400 is commanded to reconfigure into its vent-closed configuration, this arrangement will prevent wildfire embers, insects, smoke, ash and other debris from passing through the vent and entering the attic space of the building, and causing fire or other damage during a wildfire storm.

Figure 7B:
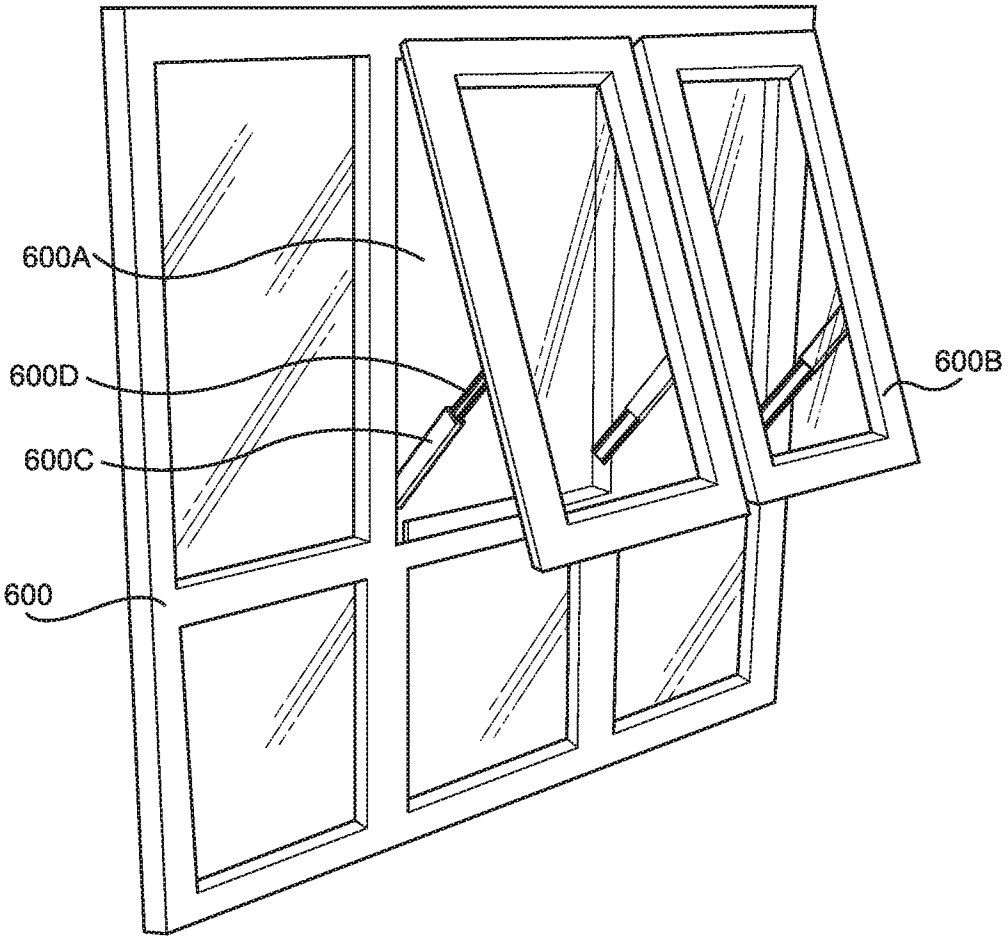
FIG. 7B is a perspective view of a remotely controlled solenoid-operated window structure of the present invention, comprising a window frame with one or more apertures and a movable window panel supported on a set of hinge structures, is operated (i.e. configured in the open or closed position) by a solendoid-operated mechanism that is connected to the system controller of the wildfire ember misting, yard spraying and building air-vent control system of the present invention shown in FIGS. 13A, 13B and 13C.

Specification of the Remotely Controlled Solenoid-Operated Window Structure of the Present Invention FIG. 7B shows the remotely controlled solenoid-operated window structure of the present invention 600 arranged in its window-open configuration. As shown, the window structure comprises: a window frame 600A with one or more apertures 600B and a movable window panel 600C supported on a set of hinge structures, is operated (i.e. configured in the open or closed position) by a solendoid-operated mechanism 600D that is connected to the controller 6B of the wildfire ember misting, yard spraying and building air-vent control system of the present invention 6 shown in FIGS. 13A, 13B and 13C. When the remotely-controlled solenoid-operated window structure 600 is commanded to reconfigure into its window-closed configuration, this arrangement will prevent wildfire embers, insects, smoke, ash and other debris from passing through the window open, or its screen structure, and entering the interior space of the building, and causing fire or other damage during a wildfire storm.

Figure 8:
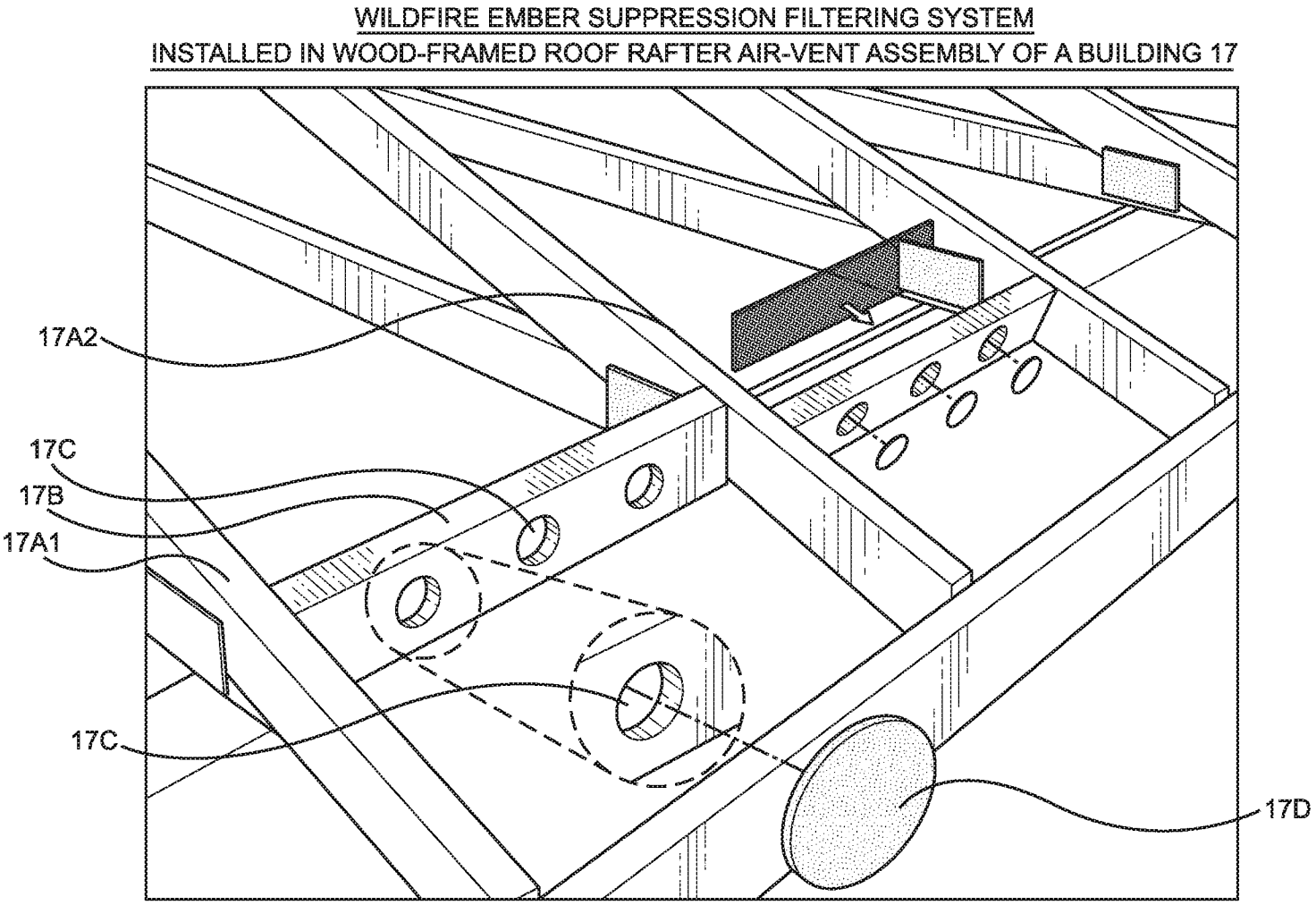
FIG. 8 is a perspective view of the wildfire ember filtering and suppression system of the present invention shown being installed in the air-inflow baffle board mounted between each pair of roof rafter boards of a wood-framed building, wherein the wildfire ember filtering and suppression system of the present invention comprises a thin cylindrical shaped piece of air-passing cloth, fabric or thermally-resistant material, infused with an environmentally anti-fire (AF) chemical liquid which when dried, provides a Class-A fire protective air filtering mechanism through which air can flow, but blocking and suppressing any combusting wildfire embers flowing into the air-vent filter during a wildfire storm.
Figure 8A:
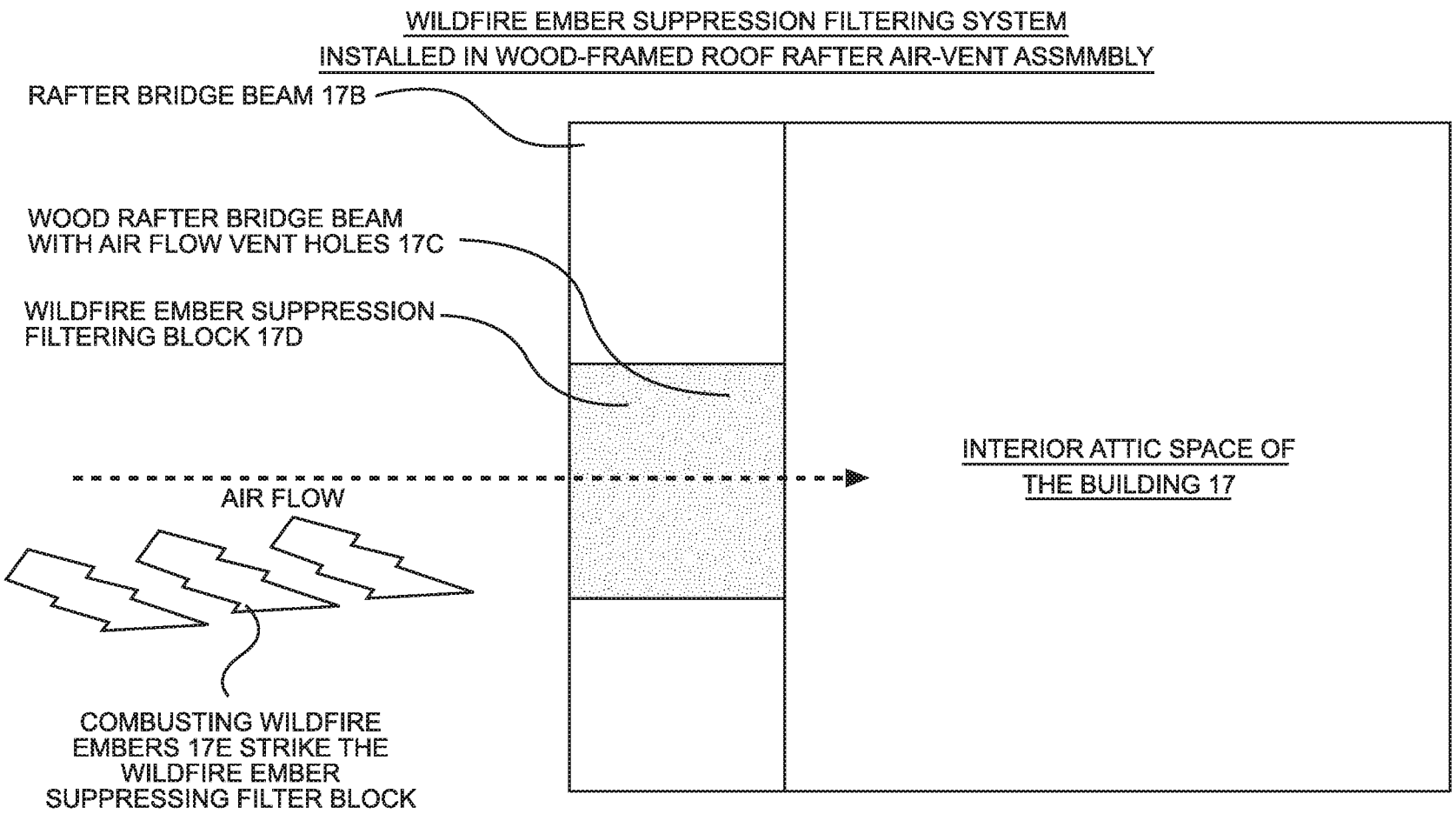
FIG. 8A is a cross-sectional view of the wildfire ember filtering system installed in wood-framed roof rafter air-vent assembly of the building illustrated in FIG. 8.

Specification of the Wildfire Ember Filtering and Suppression System of the Present Invention FIGS. 8 and 8A show the wildfire ember filtering and suppression system of the present invention 17 shown being installed in the air-inflow board mounted between each pair of roof rafter boards 17A1 and 17A2 of a wood-framed building. As shown, the wildfire ember filtering and suppression system 17 comprises: a thin cylindrical shaped piece of air-pervious cloth, fabric or thermally-resistant material 17C infused with a clean-environmentally anti-fire (AF) liquid (i.e. Hartindo AF21 fire inhibitor chemical liquid from Hartindo Chemical, Indonesia) that dries to provide a Class-A fire-protective air filtering mechanism 17D, through which air can freely flow through the filtered vent holes 17C, while blocking and suppressing any combusting/burning wildfire embers 17E during a wildfire storm. This wildfire ember filtering block 17D can serve as a second tier of defense against a raging wildfire in the event that certain flying embers pass through anti-fire chemical misting clouds, as taught herein, without being adequately suppressed or extinguished, as the case may be.

Figure 9:
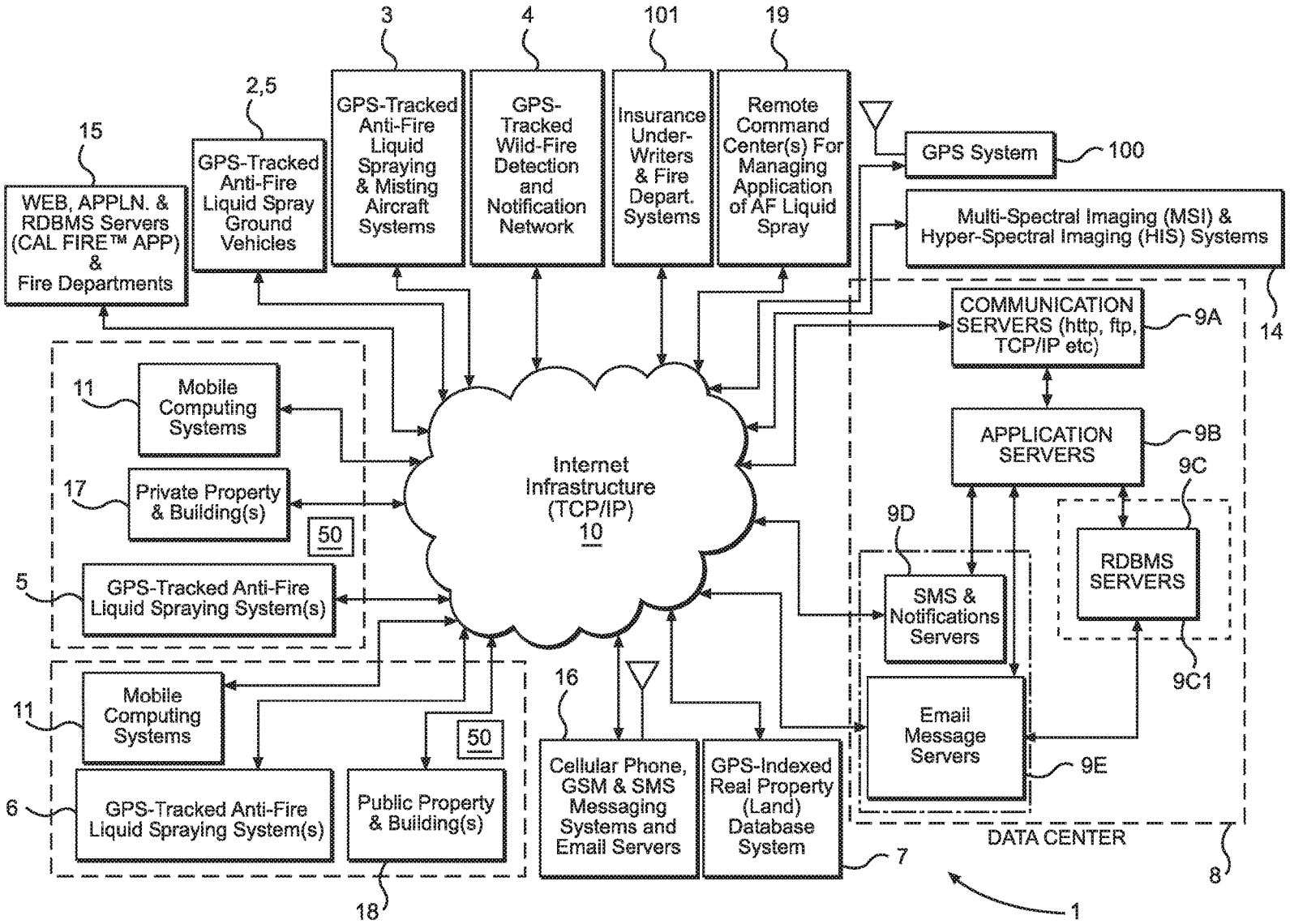
FIG. 9 is a schematic representation of the wireless automated wildfire detection and suppression system network of the present invention designed for managing the supply, delivery and misting-application of environmentally-clean anti-fire (AF) chemical liquid on private and public property to reduce the risks of property damage and/or destruction and harm to life caused by wildfires as disclosed on copending U.S. patent application Ser. No. 15/866,451 filed Jan. 9, 2018, incorporated herein by reference, in its entirety.

Specification of the Wireless System Network of the Present Invention Designed for Managing the Supply, Delivery and Misting of Environmentally-Clean Anti-Fire (AF) Liquid on Private and Public Property FIG. 9 describes the wireless system network of the present invention 1 designed for managing the supply, delivery and misting of environmentally-clean anti-fire (AF) liquid on private and public property to reduce the risks of property damage and/or destruction and harm to life caused by wildfires. As shown, the network 1 comprises: GPS-tracked anti-fire (AF) liquid spray ground vehicles 2; GPS-tracked anti-fire liquid spray air vehicles 3; GPS-tracked anti-fire liquid misting systems 5 for spraying private real property and buildings 17; GPS-tracked liquid misting systems 5 for spraying public real property and buildings 18; mobile computing systems 11 running the mobile application of the present invention and used by property owners, residents, fire departments, insurance underwriters, government officials, medical personal and others, remote data sensing and capturing systems for remotely monitoring land and wildfires wherever they may break out; a GPS system 100 for providing GPS-location services to each and every system components in the system network; and one or more data centers 8 each containing clusters of web, application and database servers 9A, 9B, 9C for supporting wire wild alert and notification systems, and microservices configured for monitoring and managing the system and network of GPS-tracking anti-fire liquid misting systems and mobile computing and communication devices configured in accordance with the principles of the present invention.

FIG. 9 shows the wireless system network of the present invention 1 designed for managing the supply, delivery and spray-application of environmentally-clean anti-fire (AF) liquid on private and public property to reduce the risks of damage and/or destruction caused by wildfires. As shown, the wireless system network 1 comprises a distribution of system components, namely: GPS-tracked anti-fire (AF) liquid spray ground vehicles 2 (e.g. all-terrain vehicles or ATVs) for applying anti-fire chemical liquid spray (e.g. Hartindo AF31 fire inhibitor chemical from Hartindo Chemical, Indonesia) from the ground to ground surfaces, brush, and other forms of organic material; GPS-tracked anti-fire liquid misting and misting air-based vehicles 3 for applying anti-fire chemical liquid spray (e.g. Hartindo AF31 fire inhibitor chemical liquid) from the air to ground surfaces, brush, bushes and other forms of organic material; GPS-tracked automated wildfire (and wildfire ember) detection and notification network 4 for automatically detecting wildfires and wildfire embers 17E in wildfire ember storms passing through a given surrounding vicinity, as shown in FIGS. 10, 11, 12A, 12B and 12C; GPS-tracked/GSM-linked anti-fire liquid misting systems 5 for applying anti-fire chemical liquid spray (e.g. Hartindo AF31 fire inhibitor chemical liquid) to private real property, buildings and surrounding areas; GPS-tracked/GSM-linked liquid misting systems 6 for applying anti-fire chemical liquid spray (e.g. Hartindo AF31 fire inhibitor chemical liquid) to public real property and buildings and surrounding properties; an automated wildfire ember misting suppression system 6 for protecting buildings from wildfire embers, as shown in FIGS. 13A, 13B, 14, 15, 16A, 16B, 17A, 17B, 18A, 18B, 19A and 19B; a GPS-indexed real-property (land) database system 7 for storing the GPS coordinates of the vertices and maps of all land parcels, including private property and building 17 and public property and building 18, situated in every town, county and state in the region over which the system network 1 is used to manage wildfires as they may occur; a cellular phone, GSM, and SMS messaging systems and email servers, collectively 16; and one or more data centers 8 for monitoring and managing GPS-tracking/GSM-linked anti-fire (AF) liquid supply and spray systems, including web servers 9A, application servers 9B and database servers 9C (e.g. RDBMS) operably connected to the TCP/IP infrastructure of the Internet 10, and including a network database 9C1, for monitoring and managing the system and network of GPS-tracking anti-fire liquid misting systems and various functions supported by the command center 19, including the management of wildfire suppression and the GPS-guided application of anti-fire (AF) chemical liquid over public and private property, as will be described in greater technical detail hereinafter. As shown, each data center 8 also includes an SMS server 9D and an email message server 9E for communicating with registered users on the system network 1 who use a mobile computing device (e.g. an Apple® iPhone or iPad tablet) 11 with the mobile application 12 installed thereon and configured for the purposes described herein. Such communication services will include SMS/text, email and push-notification services known in the mobile communications arts.

As shown in FIG. 9, the GPS-indexed real-property (land) database system 7 will store the GPS coordinates of the vertices and maps of all land parcels contained in every town, county and state of the region over which the system network is deployed and used to manage wildfires as they may occur. Typically, databases and data processing methods, equipment and services known in the GPS mapping art, will be used to construct and maintain such GPS-indexed databases 7 for use by the system network of the present invention, when managing GPS-controlled application of clean anti-fire (AF) chemical liquid spray and mist over GPS-specified parcels of land, at any given time and date, under the management of the system network of the present invention. Examples of such GPS-indexed maps of land parcels are reflected by the task report shown in FIG. 16, and examples of GPS-indexed maps are shown in the schematic illustrations depicted in FIGS. 18, 20, 22 and 24.

As shown in FIG. 9, the system network 1 also includes a GPS system 100 for transmitting GPS reference signals transmitted from a constellation of GPS satellites deployed in orbit around the Earth, to GPS transceivers installed aboard each GPS-tracking ground-based or air-based anti-fire (AF) liquid misting system of the present invention, as part of the illustrative embodiments. From the GPS signals it receives, each GPS transceiver aboard such AF liquid misting/misting systems is capable of computing in real-time the GPS location of its host system, in terms of longitude and latitude. In the case of the Empire State Building in NYC, N.Y., its GPS location is specified as: N40° 44.9064', W073° 59.0735'; and in number only format, as: 40.748440, −73.984559, with the first number indicating latitude, and the second number representing longitude (the minus sign indicates "west").

As shown, the system network 1 further includes multi-spectral imaging (MSI) systems and/or hyper-spectral-imaging (HSI) systems 14 for remotely data sensing and gathering data about wildfires, their location and progress. Such MSI and HSI systems may be space/satellite-based and/or drone-based (supported on an unmanned airborne vehicle or UAV). Drone-based systems 14 can be deployed and remotely-controlled by a human operator, or guided under an artificial intelligence (AI) navigation system. Such AI-based navigation systems may be deployed anywhere, provided access is given to such remote navigation system the system network and its various systems. Typically, the flight time will be limited to under 1 hour using currently available battery technology, so there will be a need to provide provisions for recharging the batteries of such drones/UASs in the field, necessitating the presence of human field personnel to support the flight and remote data sensing and mapping missions of each such deployed drone, flying about raging wildfires, in connection with the system network of the present invention.

During each wildfire data sensing and mapping mission, carried out by such UAS, a series of MSI images and HSI images can be captured during a wildfire, and mapped to GPS-specific coordinates, and this mapped data can be transmitted back to the system network for storage, analysis and generation of GPS-specified flight plans for anti-fire (AF) chemical liquid spray and misting operations to stall and suppress such wildfires, and mitigate risk of damage to property and harm to human and animal life.

A suite of MSI and HSI remote sensing and mapping instruments and technology 14, currently being used by the US Geological Survey (USGS) Agency, can be used to collect, monitor, analyze, and provide science about natural resource conditions, issues, and problems on Earth. It is an object of the present invention to exploit such instruments and technology when carrying out and practicing the various methods of the present invention disclosed herein. These MSI/HSI remote sensing technologies 14 include: MODIS (Moderate Resolution Imaging Spectro-radiometer) satellite system for generating MODIS imagery subsets from MODIS direct readout data acquired by the USDA Forest Service Remote Sensing Applications Center, to produce satellite fire detection data maps and the like https://fsapps.nwcg.gov/afm/activefiremaps.php; the World View 2 Satellite System manufacture from the Ball Aerospace & Technologies and operated by DigitalGlobe, for providing commercially available panchromatic (B/W) imagery of 0.46 meter resolution, and eight-band multi-spectral imagery with 1.84 meter resolution; Octocopter UAS (e.g. Onyx-Star Hyra-12 heavy lifting drone) supporting MSI and HSI camera systems for spectral imaging applications, http://www.onyxstar.net and http://www.genidrone.com; and SenseFly eBee SQ UAS for capturing and mapping high-resolution aerial multi-spectral images https://www.sensefly.com/drones/ebee-sq.html.

Any one or more of these types of remote data sensing and capture instruments, tools and technologies can be integrated into and used by the system network 1 for the purpose of (i) determining GPS-specified flight/navigation plans for GPS-tracked anti-fire (AF) chemical liquid spraying and misting aircraft, and ground-based spraying vehicle systems, and (ii) practicing the various GPS-guided methods of wildfire suppression described in detail in pending U.S. patent application Ser. No. 15/866,451, incorporated herein by reference.

Figure 10:
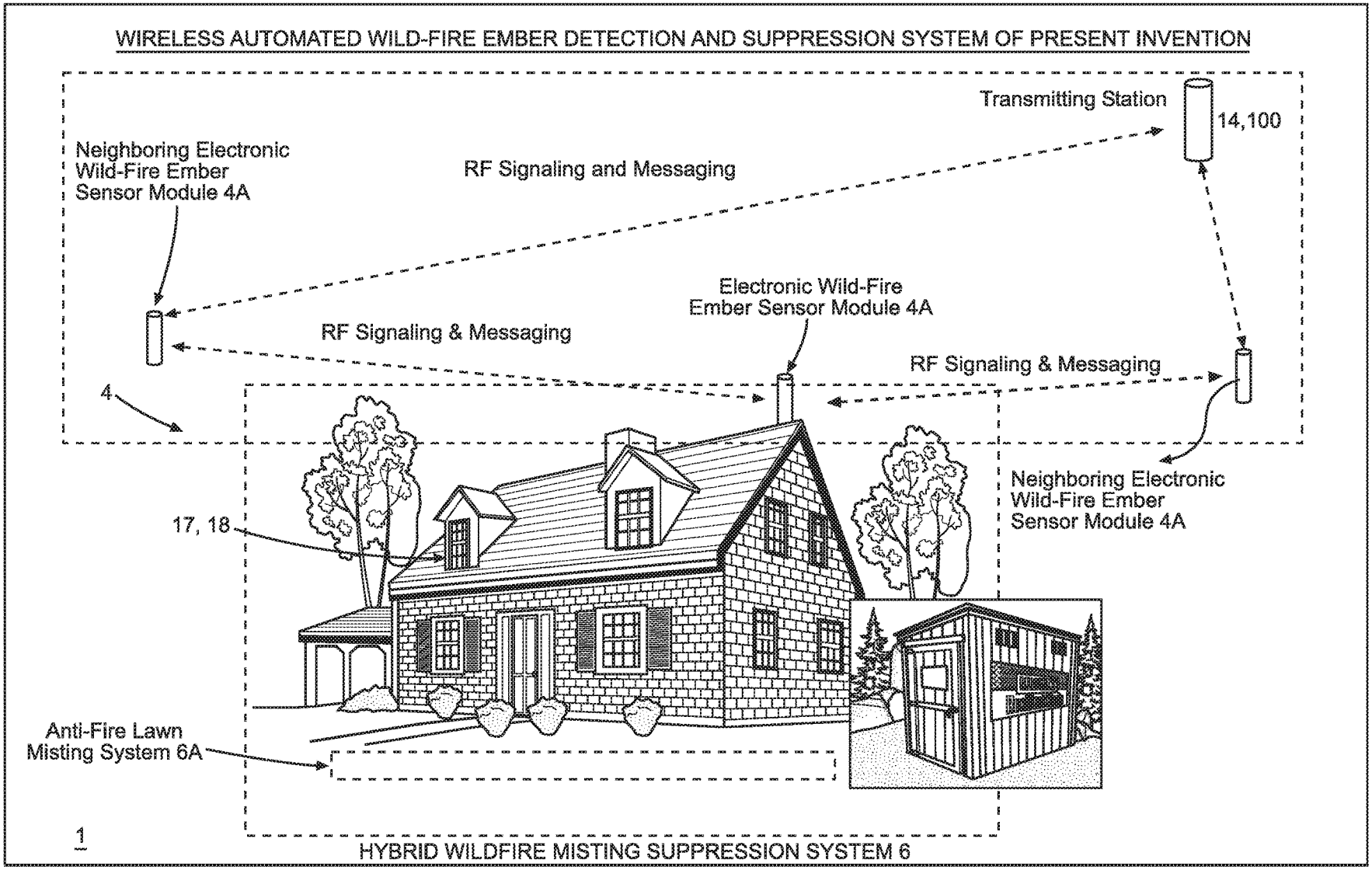
FIG. 10 is a schematic representation of the automated wireless wildfire ember detection and suppression system of present invention, showing a wildfire ember detection module mounted on the top of each building in the wireless network receiving wirefire alerts and messages from neighboring modules which can scout for wildfires and alert other modules in the network in terms of GPS coordinates so that the individual properties can timely prepare for any such wildfire outbreaks in the vicinity, using the hybrid wildfire misting system of the present invention shown in FIGS. 13A and 13B.
Figure 11:
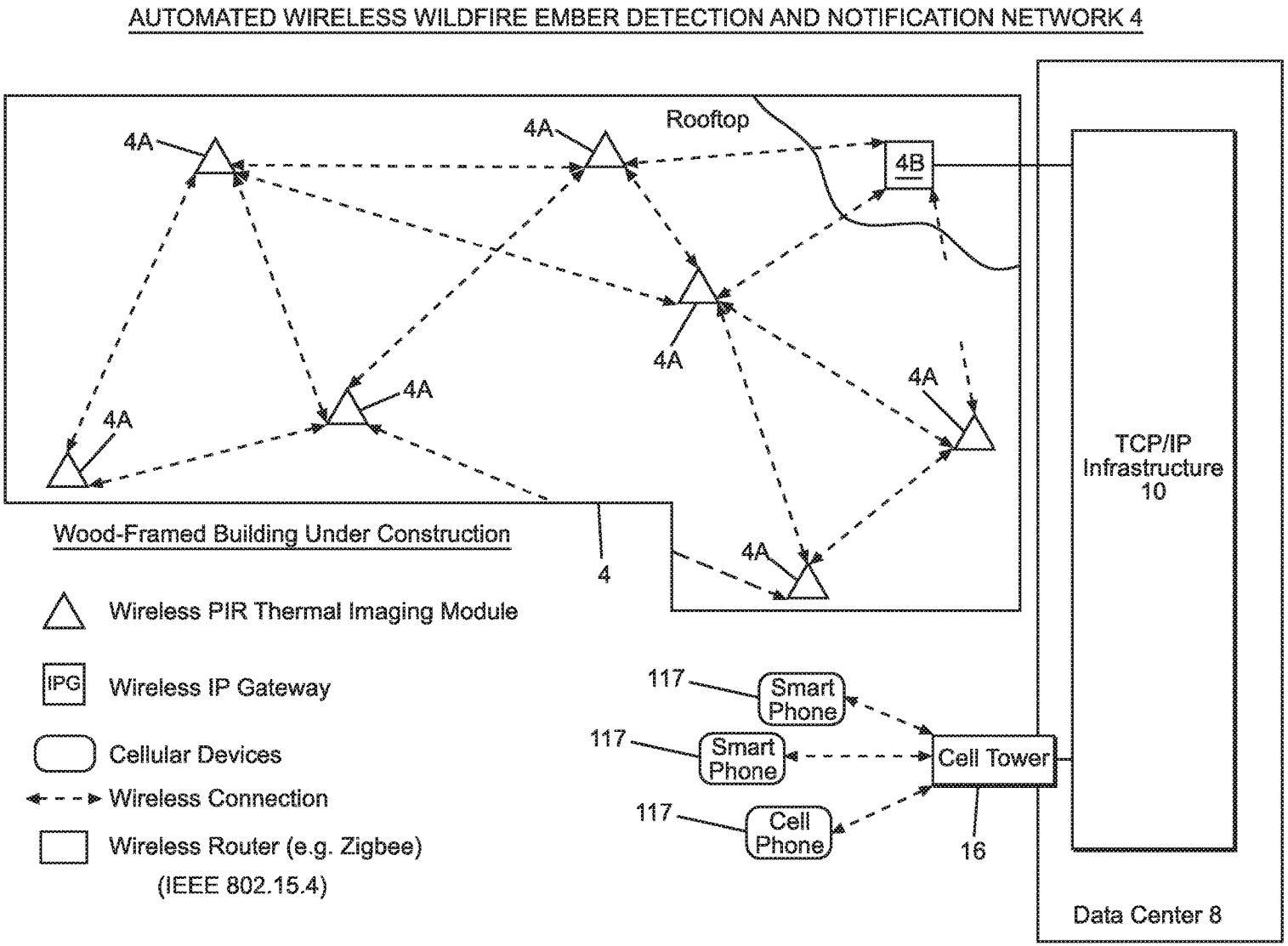
FIG. 11 is a schematic representation of the wireless GPS-tracked wirefire ember detection and notification network of the present invention integrated with the automated wirefire ember detection and suppression system of the present invention depicted in FIGS. 9 and 10.

Spatial intelligence captured using these remote data capture systems can be transmitted back to the automated wireless wildfire detection and notification network 4 shown in FIGS. 10 and 11 so that each automated wildfire ember detection module 4A is informed, and armed to control local anti-fire chemical misting equipment provided to the building on which the wildfire ember detection module 4A is mounted. In turn, each wildfire ember detection module 4A in the network illustrated in FIG. 11 is readily adapted to generate and transmit electronic control signals to activate the automated hybrid misting system 6 to begin (i) automatically misting the lawn and surround ground cover with anti-fire (AF) chemical liquid if and as needed, and/or (ii) automatically misting anti-fire chemical liquid about all airflow entry points of the building (e.g. gables, soffits, rafters, turbines on roof etc.), and all other building surfaces as may require or desired to adequately protect the building during a raging wildfire ember storm.

During such wildfire storms, it is expected that electrical power will be disrupted in the neighborhood, as will telecommunication network services, but that the automatic wildfire ember detection module 4A will have received notifications from the surrounding network about the presence of a raging wildfire, and in response, the module 4A will automatically command the local AF chemical liquid misting equipment to operate based on locally detected wildfire ember conditions, to dispense AF chemical liquid in a strategic manner so that misting clouds are generated when wildfire embers are flying through the air about the module 4A, striking the building and trying to find a way into the interior space of the wood framed building, via air vents and other passageways, to ignite a fire inside the building and burn it down to the ground.

The wildfire defense system 6 of the present invention will be programmed with artificial intelligence (AI) programs running inside the wildfire ember misting controller 6B, safely mounted within the wildfire-protected shed 50 or inside the building in a safe location.

One control strategy might involve the wildfire ember misting controller 6B working in conjunction with the automated wildfire ember detection module 4A automatically monitor and confirm that wildfire embers 17E are flying through the air around the building (e.g. date-stamped local wildfire ember alert) before it automatically commands the liquid pump system 6F to hydraulically pump anti-fire chemical liquid from supply tank 6E into the pipe manifold 6G and to the misting nozzles 6H located all about the building for generating a fog-like misting cloud, thereby providing unprecedented wildfire protection to the building as it is actually being attacked by a fierce and energetic wildfire ember storm.

Another control strategy might involve the wildfire ember misting controller 6B working in conjunction with the automated wildfire ember detection module 4A automatically monitor and confirm that flying wildfire embers have been detected by a neighboring wildfire ember detection module 4A, on a neighboring building located some predetermined distance away and occurring some time ago (e.g. date-stamped neighboring wildfire ember alert or event), before it automatically commands the liquid pump system 6F to hydraulically pump anti-fire chemical liquid from supply tank 6E into the pipe manifold 6G and to the misting nozzles 6H located all about the building for generating a fog-like misting cloud, thereby providing unprecedented wildfire protection to the building before it is actually attached by a fierce and energetic wildfire ember storm moving in the direction of the building under protection.

Regardless of AI control strategy running on the wildfire ember misting controller 6B, each automated wildfire ember detection module 4A (encased in a fire-protected housing) will support (i) real-time digital IR, thermal, and pyrometric image capture from its 360 degrees of viewing optics (i.e. 360 fields of view) supported by its image formation optics within its fire-protected housing 4A1, and (ii) real-time pixel processing of these digital (multi-spectral/color) images so as to automatically recognize the presence of fire, wildfire, and flying wild-fire ember using various image processing techniques performed in module 4A in a manner known in the image-processing based fire recognition arts. Upon such automated recognition of a "wildfire" or "flying wildfire ember" event, the module 4A will automatically generate and transmit a GPS-indexed message and command to the local wildfire ember misting controller 6B, as well as to other neighboring modules 4A active and operating on the wireless wildfire ember detection network 4 (provided it has not been disrupted by the wildfire storm) so as to assist other automated wildfire ember detection modules 4A in the neighboring region, in efforts to protect their designated properties against any particular wildfire storm moving through their regions.

It is also understood that the lithium-ion battery pack and controller 6C will have adequate charge to operate the system 6 for at least 24 hours without interruption, or recharging by its PV solar panel 6D, or external power supply, as the case may be. This way the system 6 of the present invention will be prepared to operate under very dangerous conditions created by a wildfire storming through a specified region, and provide the required degree of protection to save the building from the wildfire.

Specification of the Network Architecture of the System Network of the Present Invention FIG. 9 illustrates the network architecture of the system network 1 implemented as a stand-alone platform deployed on the Internet. As shown, the Internet-based system network 1 comprises: cellular phone and SMS messaging systems and email servers 16 operably connected to the TCP/IP infrastructure of the Internet 10; a network of mobile computing systems 11 running enterprise-level mobile application software 12, operably connected to the TCP/IP infrastructure of the Internet 10; an array of mobile GPS-tracked anti-fire (AF) liquid spraying/misting, each provided with GPS-tracking and having wireless internet connectivity with the TCP/IP infrastructure of the Internet 10, using various communication technologies (e.g. GSM, BlueTooth, WIFI, and other wireless networking protocols well known in the wireless communications arts); and one or more industrial-strength data center(s) 8, preferably mirrored with each other and running Border Gateway Protocol (BGP) between its router gateways, and operably connected to the TCP/IP infrastructure of the Internet.

As shown in FIG. 9, each data center 8 comprises: the cluster of communication servers 9A for supporting http and other TCP/IP based communication protocols on the Internet (and hosting Web sites); a cluster of application servers 9B; the cluster of RDBMS servers 9C configured within a distributed file storage and retrieval ecosystem/system, and interfaced around the TCP/IP infrastructure of the Internet well known in the art; the SMS gateway server 9D supporting integrated email and SMS messaging, handling and processing services that enable flexible messaging across the system network, supporting push notifications; and the cluster of email processing servers 9E.

Referring to FIG. 9, the cluster of communication servers 9A is accessed by web-enabled mobile computing clients 11 (e.g. smart phones, wireless tablet computers, desktop computers, computer workstations, etc.) used by many stakeholders accessing services supported by the system network 1. The cluster of application servers 9A implement many core and compositional object-oriented software modules supporting the system network 1. Typically, the cluster of RDBMS servers 9C use SQL to query and manage datasets residing in its distributed data storage environment, although non-relational data storage methods and technologies such as Apache's Hadoop non-relational distributed data storage system may be used as well.

As shown in FIG. 9, the system network architecture shows many different kinds of users supported by mobile computing devices 11 running the mobile application 12 of the present invention, namely: the plurality of mobile computing devices 11 running the mobile application 12, used by fire departments and firemen to access services supported by the system network 1; the plurality of mobile computing systems 11 running mobile application 12, used by insurance underwriters and agents to access services on the system network 1; the plurality of mobile computing systems 11 running mobile application 12, used by building architects and their firms to access the services supported by the system network 1; the plurality of mobile client systems 11 (e.g. mobile computers such as iPad, and other Internet-enabled computing devices with graphics display capabilities, etc.) used by spray-project technicians and administrators, and running a native mobile application 12 supported by server-side modules, and various GUIs, supporting client-side and server-side processes on the system network of the present invention; and a GPS-tracked anti-fire (AF) liquid misting systems 5 for spraying buildings and ground cover to provide protection and defense against wildfires.

In general, the system network 1 will be realized as an industrial-strength, carrier-class Internet-based network of object-oriented system design, deployed over a global data packet-switched communication network comprising numerous computing systems and networking components, as shown. As such, the information network of the present invention is often referred to herein as the "system" or "system network". The Internet-based system network can be implemented using any object-oriented integrated development environment (IDE) such as for example: the Java Platform, Enterprise Edition, or Java EE (formerly J2EE); Websphere IDE by IBM; Weblogic IDE by BEA; a non-Java IDE such as Microsoft's .NET IDE; or other suitably configured development and deployment environment well known in the art. Preferably, although not necessary, the entire system of the present invention would be designed according to object-oriented systems engineering (DOSE) methods using UML-based modeling tools such as ROSE by Rational Software, Inc. using an industry-standard Rational Unified Process (RUP) or Enterprise Unified Process (EUP), both well known in the art. Implementation programming languages can include C, Objective C, C, Java, PHP, Python, Google's GO, and other computer programming languages known in the art. Preferably, the system network is deployed as a three-tier server architecture with a double-firewall, and appropriate network switching and routing technologies well known in the art. In some deployments, private/public/hybrid cloud service providers, such Amazon Web Services (AWS), may be used to deploy Kubernetes, an open-source software container/cluster management/orchestration system, for automating deployment, scaling, and management of containerized software applications, such as the mobile enterprise-level application 12 of the present invention, described above.

Specification of the Automated Wildfire Ember Detection and Suppression System/Module of Present Invention FIG. 10 shows a wildfire ember detection module 4A mounted on the top of each building 300. Each wildfire ember detection module 4A is configured in the wireless wildfire ember detection and notification network 4, for (i) receiving wirefire alerts and messages from neighboring modules 4A, (ii) sensing and processing IR thermal images for automated detection of wildfires and wildfire embers in the field of views (FOVs) of the module, (iii) sending and recording the CO2 levels in the ambient air, (iv) measuring and recording the relative humidity (%) in the ambient air, (v) measuring and recording the temperature of the ambient air, and measuring and recording other parameters relating to the ambient environment which may be helpful in automated detection of wildfires and wildfire ember storms, so the anti-fire misting systems installed on property can be timely triggered to protect the building and property when a wildfire storm rages across the property. The advantage of being part of this network is that each module 4A can scout for wildfires and alert other modules in the network in terms of GPS coordinates so that the specific properties can timely prepare for any such wildfire outbreaks in the vicinity.

Figure 12B:
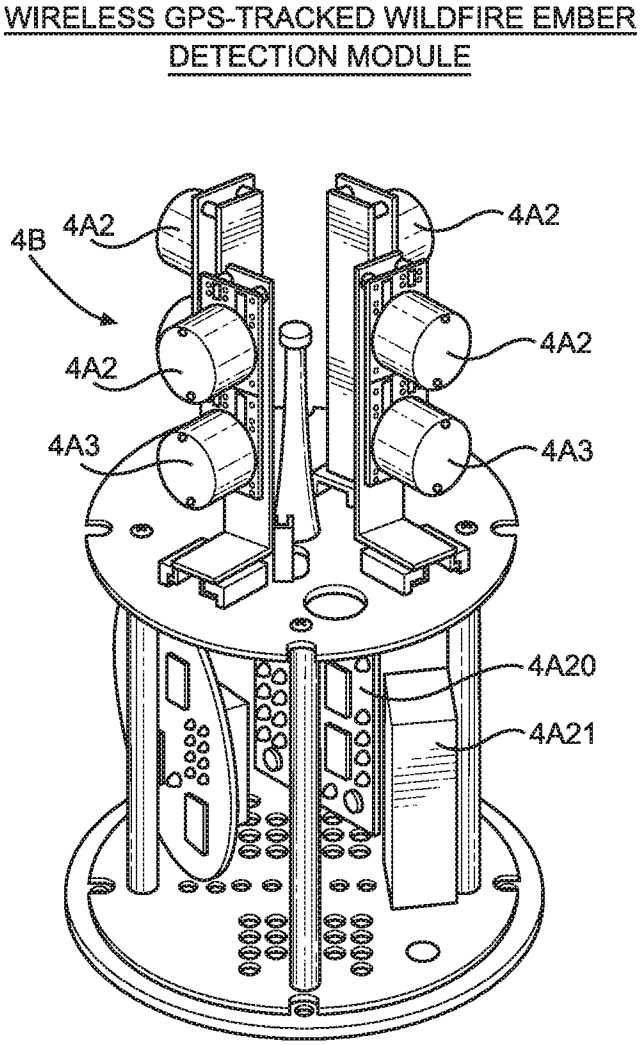
FIG. 12B is a perspective view of a wireless GPS-tracked wildfire ember detection module of FIG. 12A, with its fire-protective housing cover removed, showing its various sensors and signal and data processing and storage components represented in FIG. 12C.
Figure 12A:
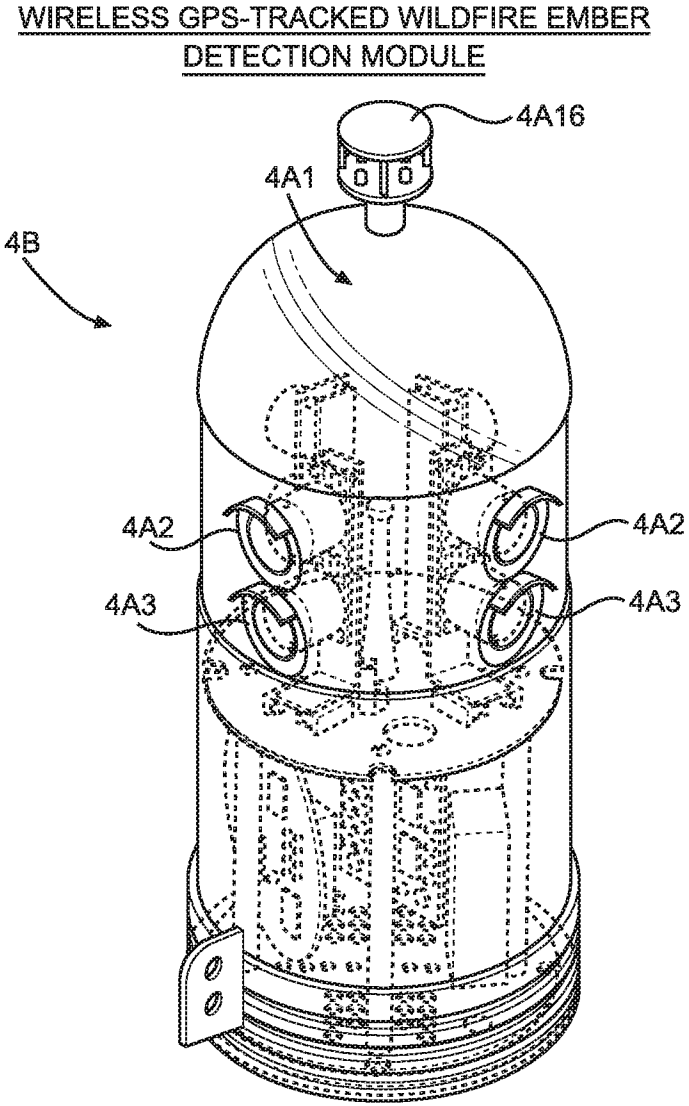
FIG. 12A is a perspective view of a wireless automated GPS-tracked wildfire ember detection module of the present invention, deployed in the wireless GPS-tracked wirefire ember detection and notification network of the present invention, shown in FIGS. 10 and 11.

Specification of the Wireless GPS-Tracked Wirefire Ember Detection and Notification Network Employing the Wirefire Ember Detection and Suppression Systems of the Present Invention FIG. 11 shows the wireless GPS-tracked wirefire ember detection and notification network 4 employing with the wirefire ember detection and suppression systems 4A depicted in FIGS. 9 and 10. As shown in FIGS. 12A and 12B, each wireless GPS-tracked wildfire ember detection module 4A, deployed in the wireless wirefire ember detection and notification network 4, shown in FIGS. 10 and 11, comprises: a fire-protective housing cover 4A1; and various sensors and signal and data processing and storage components 4A2 through 4A19, shown in schematic block diagram of FIG. 12C.

Figure 12C:
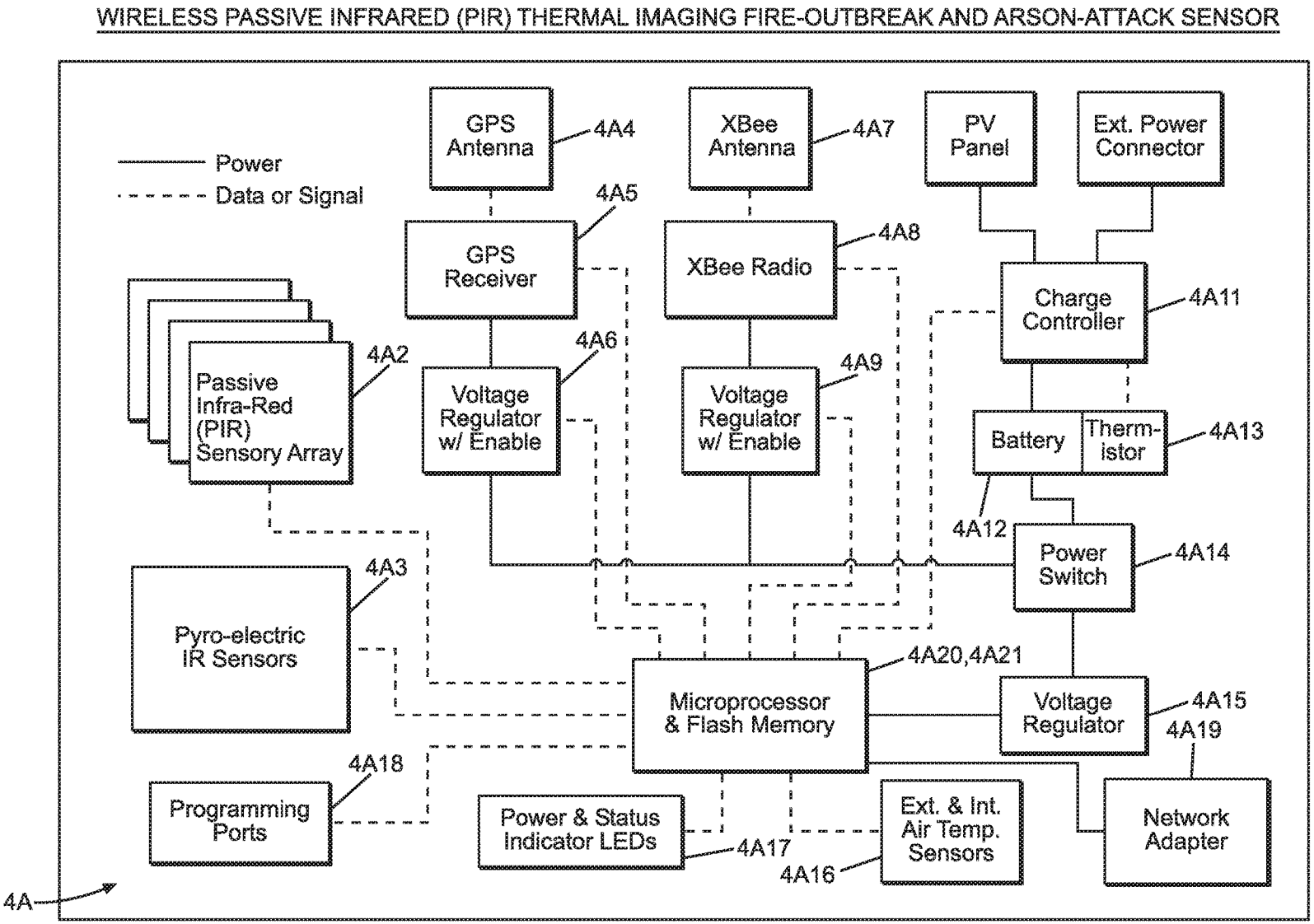
FIG. 12C is a schematic block diagram showing the components used to construct the wireless GPS-tracked wildfire ember detection module of the present invention, shown in FIGS. 10, 11, 12A and 12B.

As shown in FIG. 12C, the sensors and signal and data processing and storage components arranged and configured about a microprocessor 4A20 and flash memory (i.e. control subsystem) 4A21 include: one or more passive infra-red (PIR) thermal-imaging sensors 4A2 connected together with suitable IR optics to project IR signal reception field of view (FOV) before the IR receiving array; multiple pyrometric sensors 4A3 for detecting the spectral radiation of burning, organic substances such as wood, natural gas, gasoline and various plastics; a GPS antenna 4A4; a GPS signal receiver 4A5; voltage regulator 4A6; an Xbee antenna 4A7; an Xbee radio transceiver 4A8; a voltage regulator 4A9; an external power connector 4A10; a charge controller 4A11; a battery 4A12; thermistors 4A13; a power switch 4A14; a voltage regulator 4A15; external and internal temperature sensors 4A16; power and status indicator LEDs 4A17; programming ports 4A18; a digital/video camera 4A19; and other environment sensors adapted for collecting and assessing building intelligence, in accordance with the spirit of the present invention. Alternatively, the wildfire detection module 4A and wireless wildfire intelligence network 4 can be realized using the technical disclosure of U.S. Pat. No. 8,907,799, incorporated herein by reference.

In the illustrative embodiment, the wildfire ember detection system 4A supports a computing platform, network-connectivity (i.e. IP Address), and is provided with native application software installed on the system as client application software designed to communicate over the system network and cooperate with application server software running on the application servers of the system network, thereby fully enabling the functions and services supported by the system, as described above. In the illustrative embodiment, a wireless mess network is implemented using conventional IEEE 802.15.4-based networking technologies to interconnect these wireless subsystems into subnetworks and connect these subnetworks to the internet infrastructure of the system of the present invention.

Preferably, the optical bandwidth of the IR sensing arrays 4A2 used in the thermal sensors will be adequate to perform 360 degrees thermal-activity analysis operations, and automated detection of wildfire and wildfire embers. Specifically, thermal sensing in the range of the sensor can be similar to the array sensors installed in forward-looking infrared (FLIR) cameras, as well as those of other thermal imaging cameras, use detection of infrared radiation, typically emitted from a heat source (thermal radiation) such as fire, to create an image assembled for video output and other image processing operations to generate signals for use in early fire detection and elimination system of the present invention.

Pixel processing algorithms known to those skilled in the art will be used to automatically process captured and buffered pixels from different color channels and automatically determine the presence of fire, wildfire and flying embers within the field of view (FOV) of the wildfire ember detection module 4A. Reference can be made to "Automatic Fire Pixel Detection Using Image Processing: A Comparative Analysis of Rule-based and Machine Learning Methods" by Tom Loulouse et al, 2015, University of Corsica, France; and "Fast Detection of Deflagrations Using Image Processing" by Thomas Schroeder et al, Helmut Schmidt University, Hamburg, Germany, 2014.

The pyroelectric detectors 4A3 detect the typical spectral radiation of burning, organic substances such as wood, natural gas, gasoline and various plastics. To distinguish a flame from the sun or other intense light source such as light emissions from arc welding, and thus exclude a false alarm, the following independent criteria are considered: a typical flame has a flicker frequency of (1 . . . 5) Hz; a hydrocarbon flame produces the combustion gases carbon monoxide (CO) and carbon dioxide (CO2); and in addition, burning produces water which can also be detected in the infrared range. Each pyroelectric detector 4A3 is an infrared sensitive optoelectronic component specifically used for detecting electromagnetic radiation in a wavelength range from (2 to 14) μm. A receiver chip of a pyroelectric infrared detector consists of single-crystalline lithium tantalite. On the upper electrode of the crystal, an absorbing layer (black layer) is applied. When this layer interacts with infrared radiation, the pyroelectric layer heats up and surface charge arises. If the radiation is switched off, a charge of the opposite polarity originates. However, the charge is very low. Before the finite internal resistance of the crystal can equalize the charges, extremely low-noise and low leakage current field-effect transistors (JFET) or operational amplifier (Pomp) convert the charges into a signal voltage.

In general, most streams of digital intelligence captured by the wireless network 4 will be time and data stamped, as well as GPS-indexed by a local GPS receiver within the sensing module, so that the time and source of origin of each data package is recorded within the system database. The GPS referencing system supporting the system transmits GPS signals from satellites to the Earth's surface, and local GPS receivers located on each networked device or machine on the system network receive the GPS signals and compute locally GPS coordinates indicating the location of the networked device within the GPS referencing system.

When practicing the wireless network of the present invention, any low power wireless networking protocol of sufficient bandwidth can be used. In one illustrative embodiment, a Zigbee® wireless network would be deployed inside the wood-framed or mass timber building under construction, so as to build a wireless internetwork of a set of wireless PIR thermal-imaging fire outbreak detection systems deployed as a wireless subnetwork deployed within the building under construction. While Zigbee® technology, using the IEEE 802.15.1 standard, is illustrated in this schematic drawing, it is understood that any variety of wireless networking protocols including Zigbee®, WIFI and other wireless protocols can be used to practice various aspects of the present invention. Notably, Zigbee® offers low-power, redundancy and low cost which will be preferred in many, but certainly not all applications of the present invention. In connection therewith, it is understood that those skilled in the art will know how to make use of various conventional networking technologies to interconnect the various wireless subsystems and systems of the present invention, with the internet infrastructure employed by the system of the present invention.

The Automated and Remotely-Controllable Clean Wildfire Inhibitor Misting System of the Present Invention, Controlled by the Wireless Automated Wildfire Ember Detection and Notification Network As disclosed in Applicant's prior US Patent Applications, when treating combustible organic materials so they will not burn in the presence of a wildfire, it will be helpful in many instances to spray clean anti-fire chemical liquid over the target surfaces so that the droplets are relatively large and an adequate coating of anti-fire chemical dries over the treated surface. This way, when the chemically treated organic material is exposed to fire, the treated surface has adequate chemicals to break the free-radical chain reactions of the fire and thereby quickly suppress and/or extinguish the fire.

Figure 15:
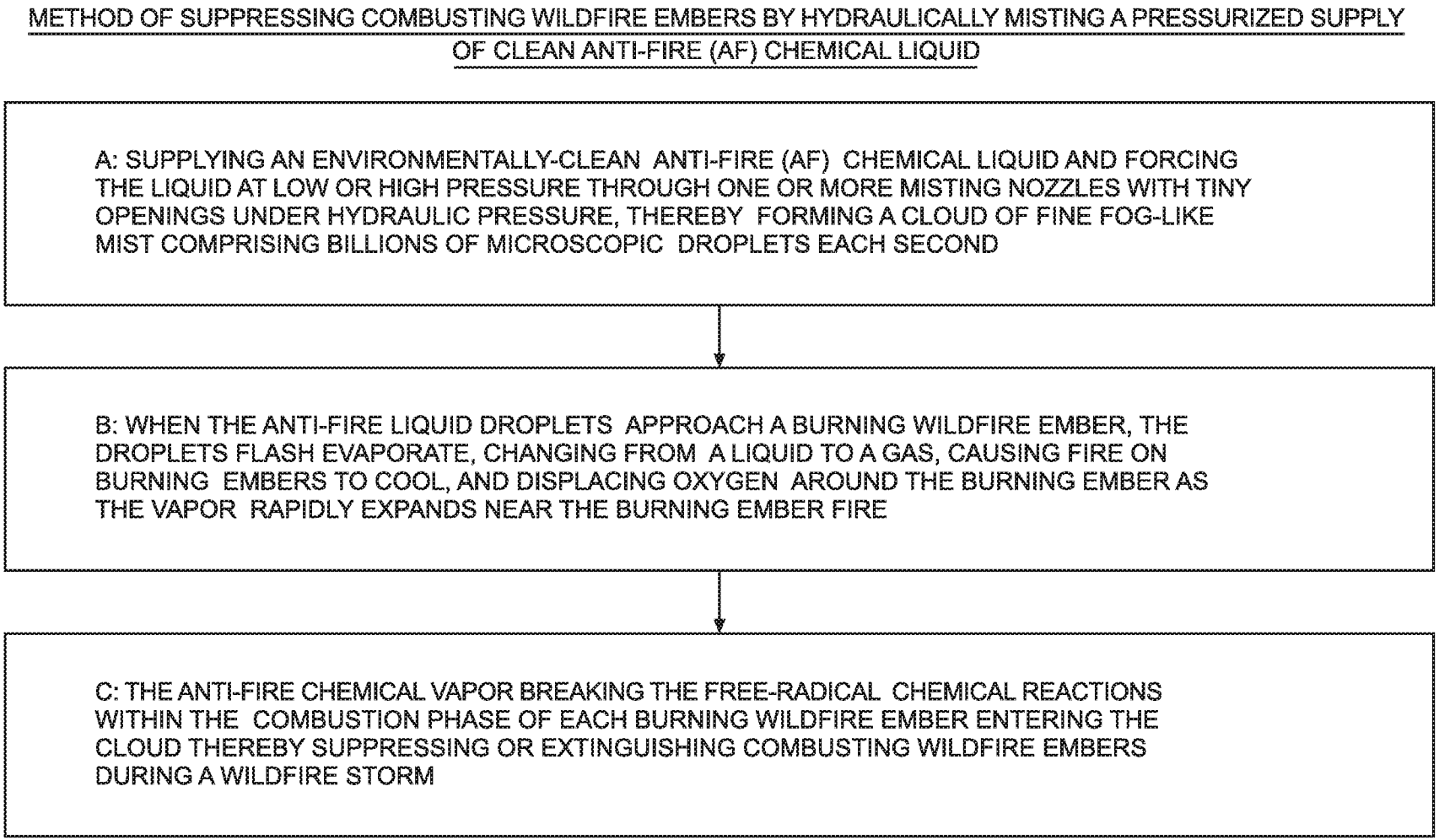
FIG. 15 is a schematic illustration describing a method of suppressing combusting wildfire embers using a hydraulic misting nozzle supplied with a pressurized supply of anti-fire (AF) liquid to produce a cloud of microscopic droplets for suppressing flying wildfire embers during a wildfire ember storm.

However, during wildfire storms, producing burning wildfire embers flying through dried heated air, driven by strong prevailing winds, it has been discovered that clean aqueous-based anti-fire (AF) chemical liquid, such as Hartindo AF31 clean anti-fire liquid, will perform as a more effective fire suppressant if provided to the burning fire in the form of a mist cloud, so that it can work on a wildfire and its embers, as described in the wildfire ember suppression process described in FIG. 15.

Figure 21A:
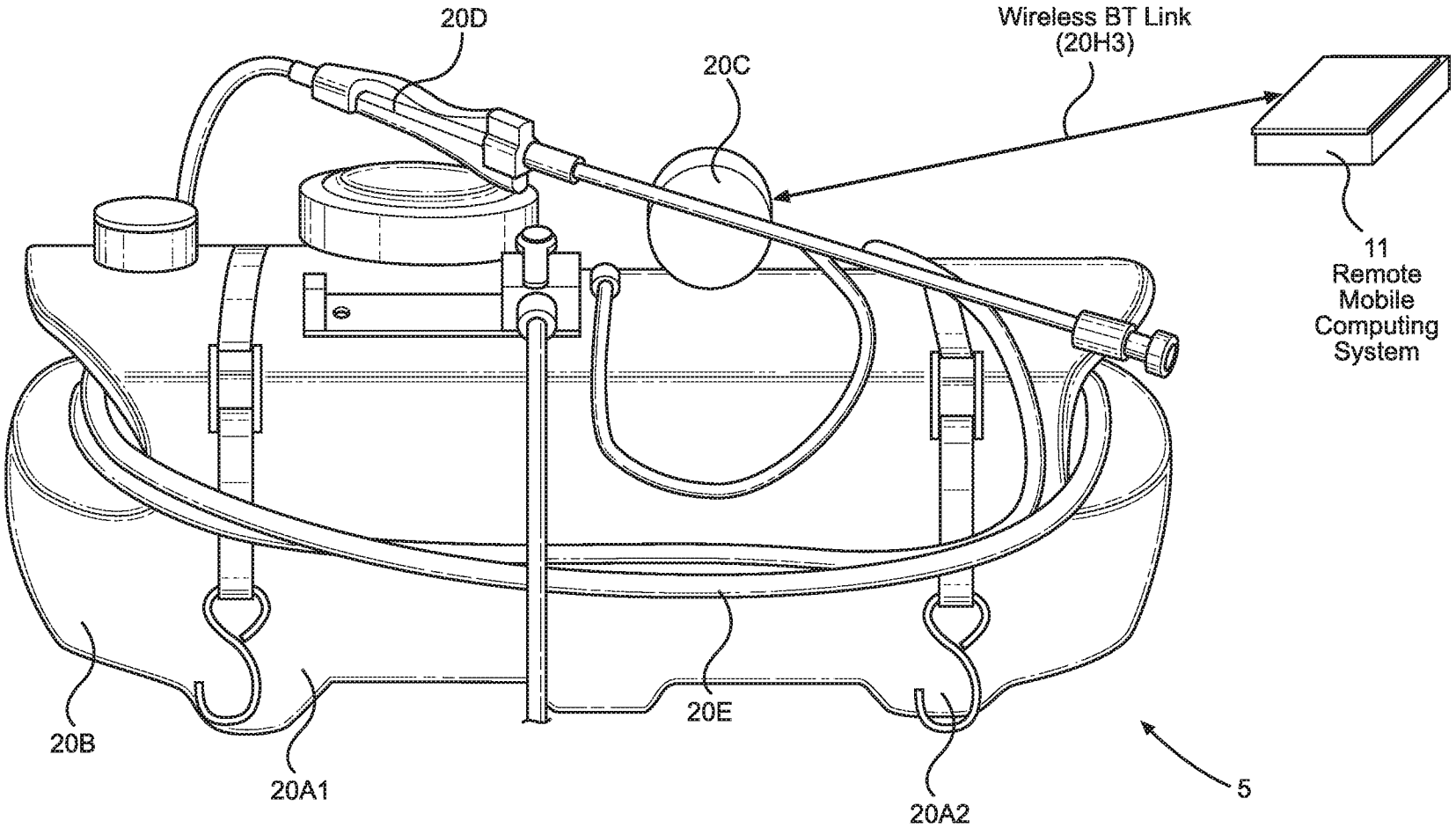
FIG. 21A is a perspective view of a mobile GPS-tracked anti-fire (AF) liquid misting system supported on a set of wheels, with integrated supply tank and rechargeable-battery operated electric spray pump, for deployment at private and public properties having building structures, for spraying the same with environmentally-clean anti-fire (AF) liquid in accordance with the principles of the present invention.
Figure 21B:
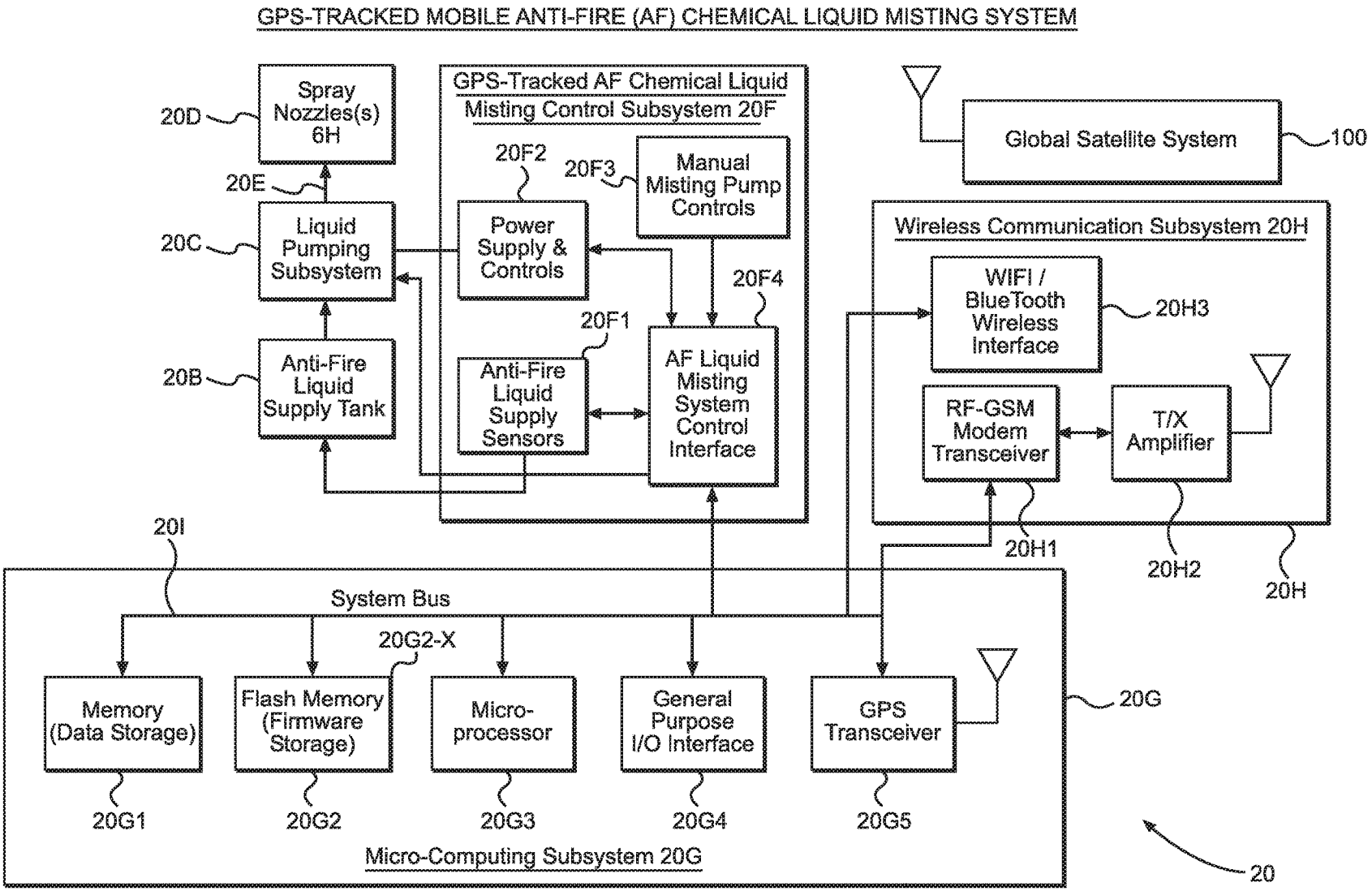
FIG. 21B is a schematic representation of the GPS-tracked mobile anti-fire (AF) chemical liquid misting system shown in FIG. 21A, comprising a GPS-tracked and remotely-monitored anti-fire (AF) liquid spray control subsystem interfaced with a micro-computing platform for monitoring the spraying of anti-fire chemical liquid from the system when located at specific GPS-indexed location coordinates, and automatically logging and recording such anti-fire liquid spraying application operations within the network database system.

While most mist producing apparatus disclosed herein operates on the principle of transmitting an anti-fire chemical liquid through a misting nozzle under low, medium or high hydraulic pressure, it is understood that when spraying anti-fire chemical liquids over the surfaces of organic material during fire-protection treating operations, then spray-type nozzles will be often used as provided on the mobile spraying apparatus 5 shown in FIGS. 21A and 21B. Using spray-type nozzles, it is possible to quickly deposit and form sufficient coatings of anti-fire chemical material on the treated surfaces, because spray-type nozzles produce liquid drops substantially larger in size than microscopic droplets formed by misting nozzles during misting operations, illustrated in FIGS. 15 through 19B.

Figure 13A:
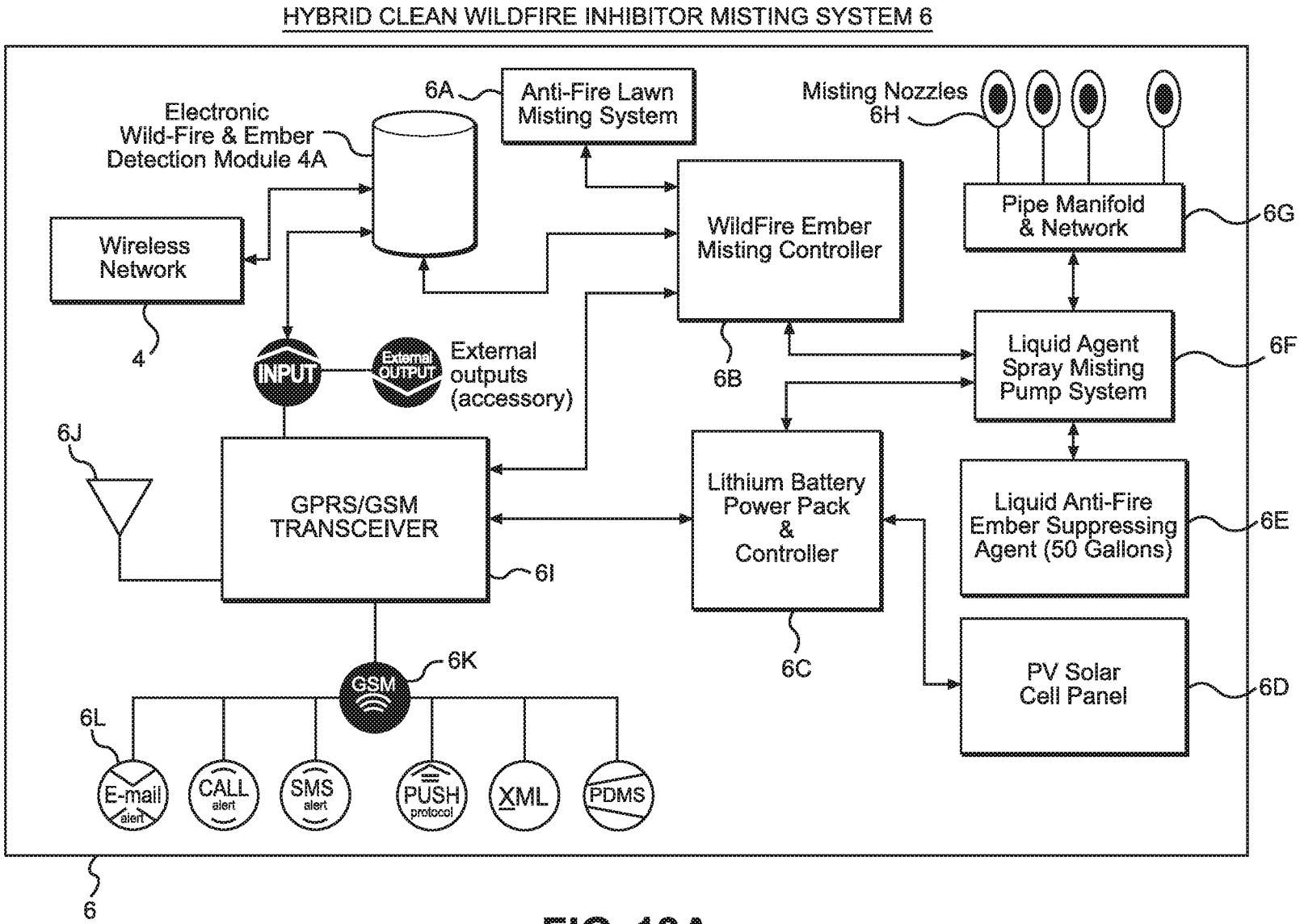
FIGS. 13A, 13B, and 13C taken together, set forth a schematic diagram showing automated wildfire inhibitor misting, yard spraying and building air-vent control system of the present invention, providing both an anti-fire chemical misting system for suppressing wildfire embers impacting a building as shown in FIG. 13A and a lawn and ground anti-fire chemical liquid misting system impacting the law and ground around the building as shown in FIG. 13A, both automatically controlled by an automated wildfire ember detection and notification network shown in FIGS. 10 through 12C, all being integrated into the system network shown in FIG. 9.
Figure 13B:
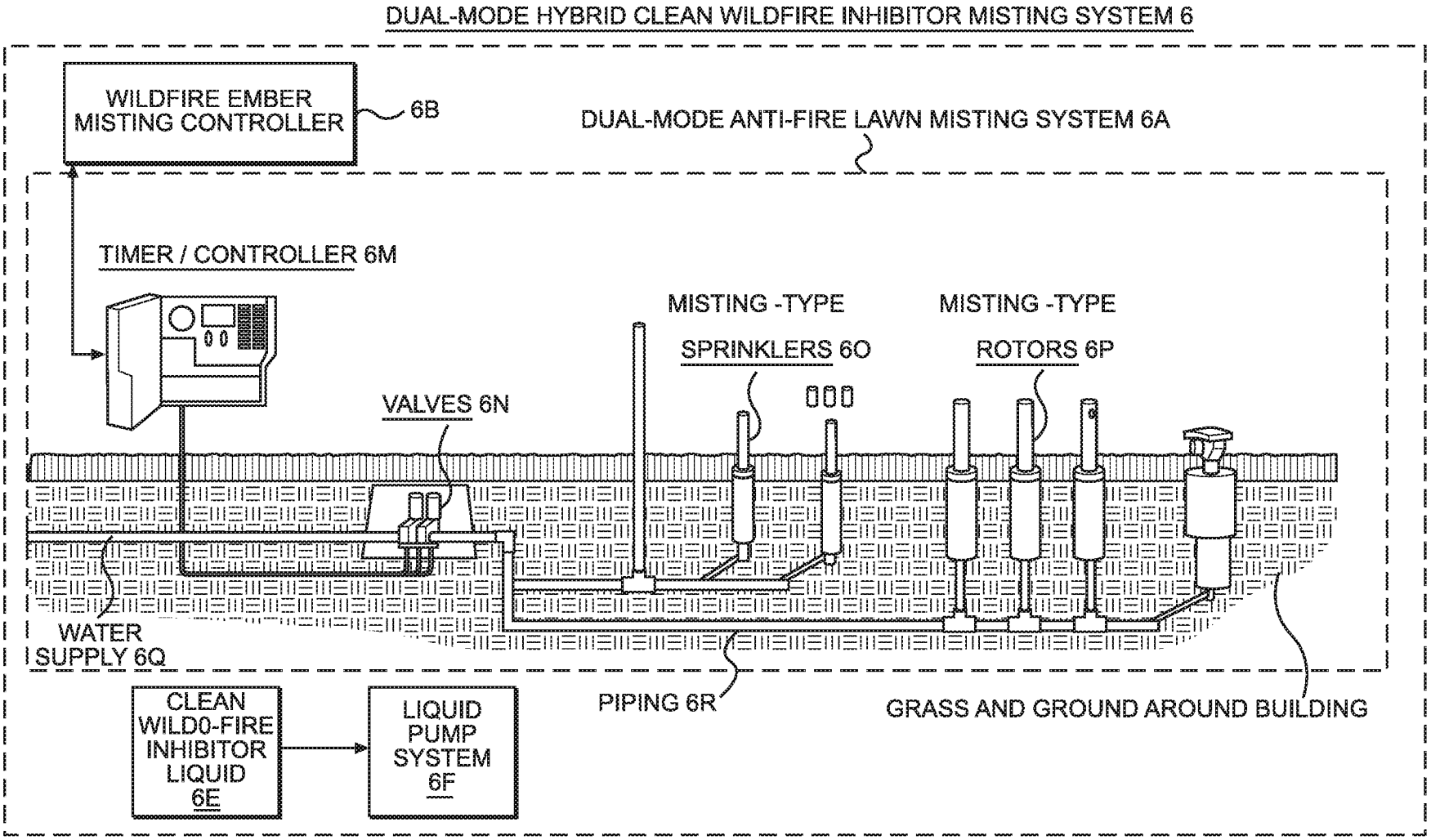

FIGS. 13A and 13B shows automated hybrid clean wildfire inhibitor misting system of the present invention 6, providing both an anti-fire chemical misting system for suppressing wildfire embers impacting a building as shown in FIG. 13A and a lawn and ground anti-fire chemical liquid misting system impacting the law and ground around the building as shown in FIG. 13A, both automatically controlled by an automated wildfire ember detection and notification network shown in FIGS. 10 through 12C. All of these system components are integrated into the system network shown in FIG. 9.

Figure 14:
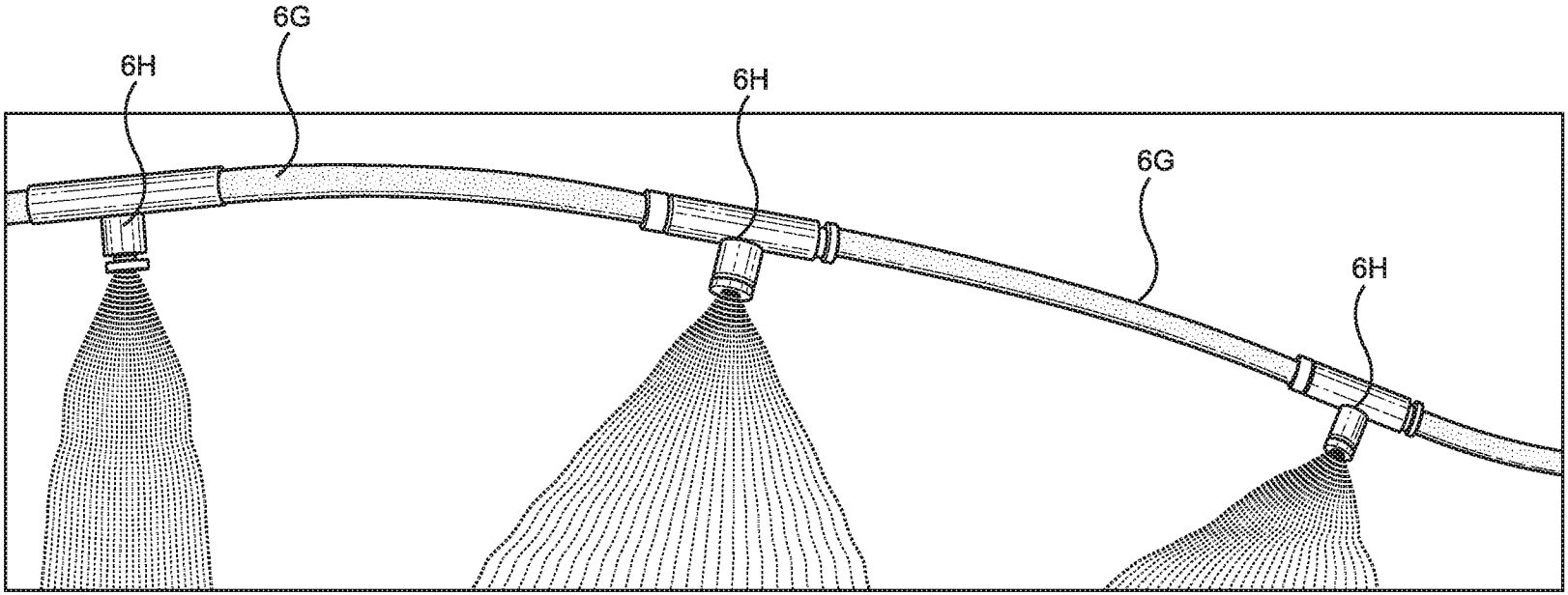
FIG. 14 is a perspective view of a section of piping and misting nozzles used in the automated hybrid wildfire inhibitor misting system shown in FIGS. 13A and 13B.

FIG. 14 shows a piping manifold 6G, a network of piping, and a set of misting nozzles 6H used to supply and produce anti-fire chemical misting droplets from the automated hybrid clean wildfire misting system 6 shown in FIGS. 13A and 13B.

As shown in FIG. 13A, automated multi-mode hybrid clean wildfire inhibitor misting system 6 comprises: an dual-mode anti-fire lawn and ground misting system 6A shown in FIG. 13B for either misting water from a main water supply, or misting environmentally-clean anti-fire chemical liquid (e.g. AF31 anti-fire chemical liquid from Hartindo Chemical) over lawns (e.g. dried out grass) and ground surfaces covered with organic material; a wildfire ember misting controller 6B (e.g. programmable microcontroller supported by a memory architecture) for controlling the various modes of the system 6; lithium battery pack and controller 6C for supplying electrical power to the electronic components in the system 6 including the DC or AC electric motor of hydraulic (e.g. diaphragm-type) liquid pumping system 6F; a photovoltaic solar cell panel 6D for recharging the lithium-ion battery back 6C while collecting sunlight with the PV solar panel 6D as solar conditions allow; a supply tank containing an adequate supply (e.g. 100 gallons) of a liquid anti-fire chemical liquid realizable using AF21 anti-fire chemical liquid from Hartindo Chemical; a liquid spray misting pump system 6F (e.g. self-priming DC or AC electrical-motor powered diaphragm liquid pump) for hydraulically pumping the anti-fire chemical liquid 6E from its supply tank (e.g. 50-100 gallons) to a plurality of misting nozzles 6H mounted all around a building being protected, and connected through adequate heat-resistant piping (e.g. ⅛", ¼" or ½" metal tubing, or high-heat resistant plastic tubing such as PET) extending over relatively short distances under adequate hydraulic pressure, to support sufficient flow rates of anti-fire chemical liquid during a wildfire ember storm, determined in a manner well known in the fluid hydraulic arts; a piping manifold 6G and piping network including a set of misting nozzles 6H as shown in FIGS. 14 through 19B for producing clean anti-fire (AF) chemical mist according to the method described in FIG. 15; a GPRS/GSM transceiver 6I with suitable antennas 6J, connected to the controller 6B, and adapted for transmitting and receiving digital data packets using GPRS and GSM communication protocols, over the system network 1 shown in FIG. 9, to support a suite of digital communication services and protocols specified herein; a suite of communication services and protocols 6L (e.g. email, SMS alert, PUSH protocol, XML, PDMS, and CALL alert) supported by GSM, for sending and receiving messages; and at least one electronic wirefire ember detection module 4A, with 360 degrees of sensing and associated field of views (FOVs), and in wireless communication with the wireless wildfire ember detection and notification network 4 of the present invention shown in FIGS. 1, 11, 12A, 12B, and 12C.

As shown in FIG. 13B, the lawn misting system 6A comprises: a water supply 6Q connected to a network of underground piping 6R; misting-type sprinklers 6O (e.g. misting nozzles) connected to the underground piping 6R; misting-type rotors 6P connected to the piping 6R; valves 6N connected to the underground piping 6R, the local water supply 6Q, and the liquid pumping system 6F, which is operably connected to the supply of clean wildfire inhibitor liquid 6E using piping; and a timer/controller 6M connected to the controllable valves 6N, and controlled by the wildfire ember misting controller 6B, which is managed by the automated wildfire ember detection and notification network 4, shown in FIG. 13A.

The dual-mode lawn misting system 6A shown in FIG. 6B has two modes of operation. During its first mode of operation, when no wildfire storm is detected, the lawn misting system 6A automatically mists the lawn with water supplied from the local water supply 6Q. During its second mode, when a wildfire storm is detected, the law misting system 6A automatically mists the lawn with an environmentally anti-fire (AF) liquid 6E supplied from a local supply of anti-fire (AF) liquid pumped from a pumping system 6F.

In the preferred embodiment the hybrid wildfire misting system 6 also has at least two modes operation: (i) a manual mode where a building/home owner or manager can manually activate and operate the anti-fire chemical liquid misting system 6 to protect either the building 17 and/or the lawn and ground surfaces around the building 17, as desired or required, based on intelligence in the possession of the human operator or manager; and (ii) an automated mode where the wildfire ember misting controller 6B, in cooperation with the local electronic wildfire and ember detection module 4A and associated wireless wildfire detection network 4, shown in FIGS. 10, 11, 12A, 12B and 12C, automatically activate and operate the anti-fire chemical liquid misting system 6 to protect both the building 17 and/or the lawn and ground surfaces around the building 17, as required, based on intelligence automatically collected by the wireless wildfire detection and notification network 4.

Figure 13C:
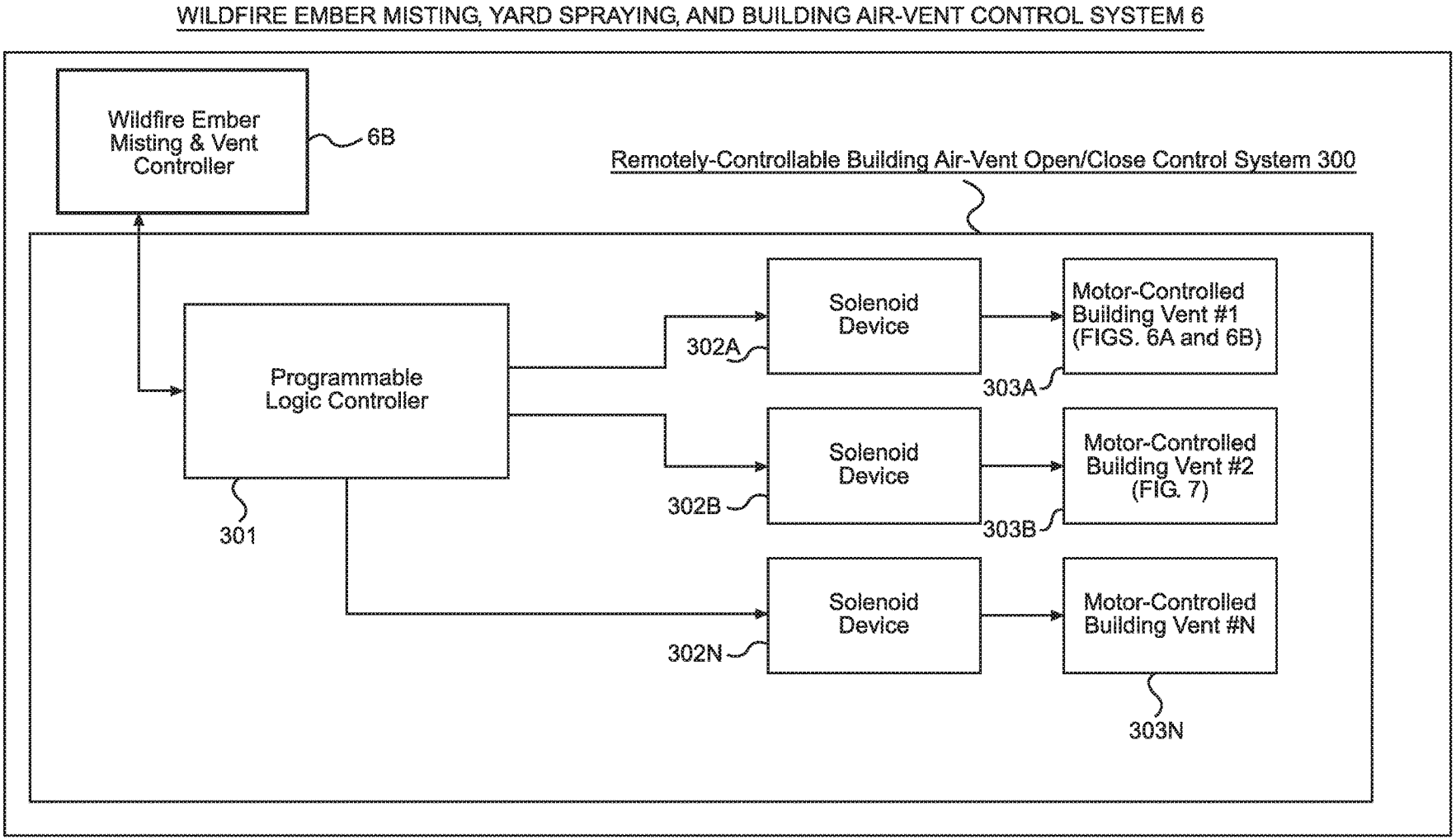

Specification of the Remotely-Controllable Building Air-Vent Open/Close Control System of the Present Invention As shown in FIGS. 13A and 13C, the remotely-controllable building air-vent open/close control system of the present invention 300 comprises a number of components, namely: a programmable logic controller (PLC) 301 or microprocessor with supporting memory architecture to support the functions of this system 300; a solenoid device 302A for each motor-controlled building vent #1 as shown in FIGS. 6A and 6B, or other home air-vent structure or device known in the art, or to be developed in the future; a solenoid device 302B for each motor-controlled building vent #1 as shown in FIGS. 7A and 6B, or other home air-vent structure or device known in the art, or to be developed in the future; and a solenoid device 302N for each motor-controlled building vent # N or other home air-vent or door or window structure or device known in the art, or to be developed in the future.

As shown in FIG. 13A, system 300 show in FIG. 13C and system 6A shown in FIG. 13B are both subsystems within the resultant control system shown in FIG. 13A, as all functions are remotely controllable via the mobile application 12 on computing device 11, via network connectivity through the internet infrastructure 10 shown in FIG. 9, and communicating through the GPRS/GSM transceiver 6I and its antenna 6J, supported by any of the listed GSM supported services 6K, indicated at 6L in FIG. 13A, including email, Call alert, SMS text, PUSH notification, WL, and PDMS, just to name a few.

It is also understood that the wildfire ember misting, yard spraying and building air-vent control system 6 can be integrated within any home or building automation system so that the services supported on system 6 can be accessed and commanded through such third-party automation systems.

Figure 22A:
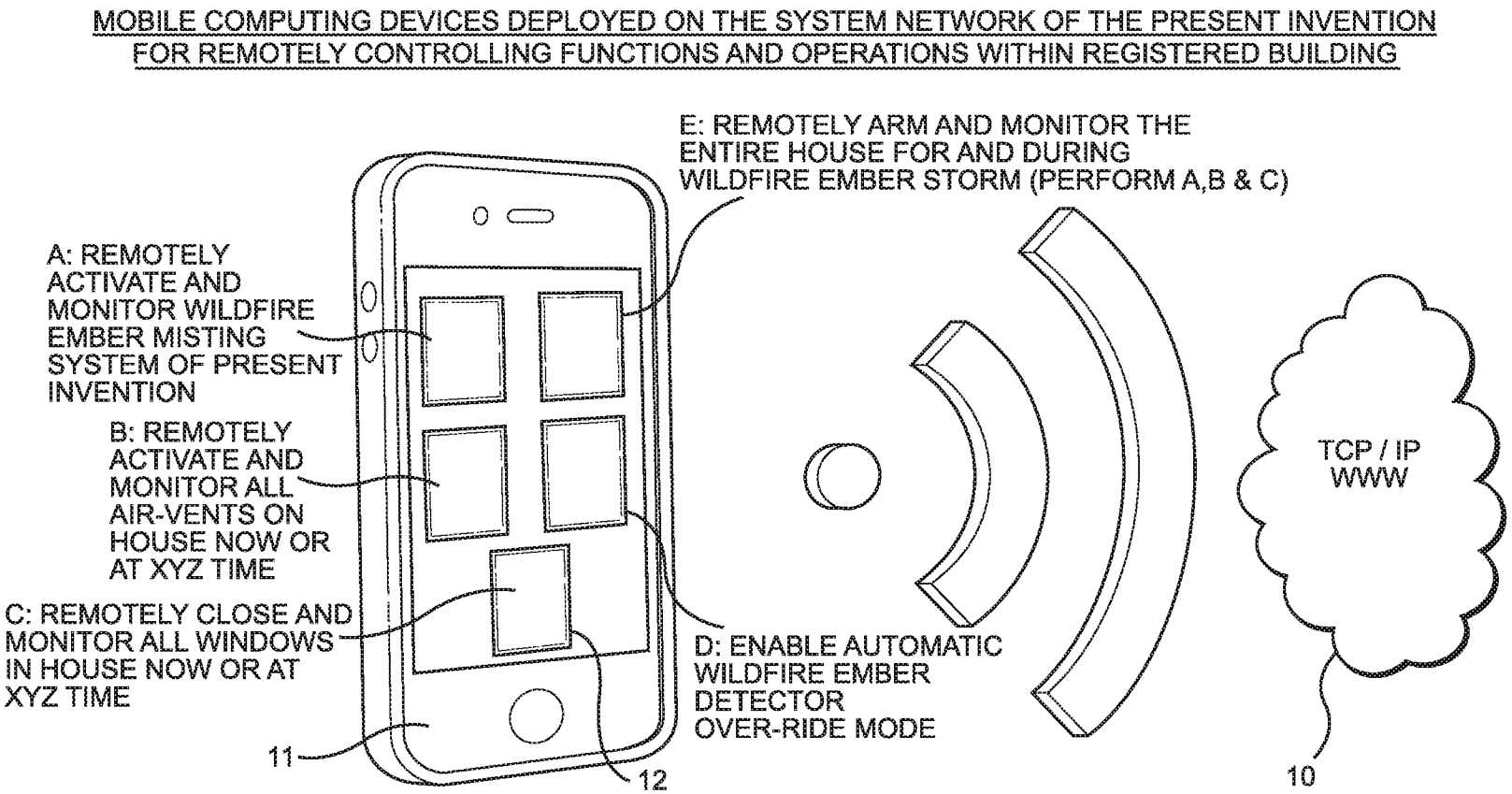
FIG. 22A is a perspective view of an exemplary mobile computing device deployed on the system network of the present invention, supporting the mobile application of the present invention deployed as a component of the system network of the present invention, and configured to support at least five (5) basis remote-control functions, namely (A) remotely activating/activating/monitoring the wildfire ember misting system of the present invention, (B) remotely activating/deactivating/monitoring all air vents on the house, (C) remotely close/open and monitor all windows in the house, (D) remotely enable the automatic wildfire ember detector in its override mode, rather than command mode, and (E) remotely arm and monitor the entire house (i.e. perform Commands A, B and C) for and during an expected wildfire ember storm.

Alternatively, the system 6 of the present invention can also be extended and adapted into a complete building/home automation system and the five functions listed in FIG. 22A will be available for remote control with other common building control functions such as indoor and outdoor lighting, AC and heating (HVAC/climate control) control, building security and alarming, water pumps and electricity control, music and video entertainment, home theater, satellite radio and other services well known in the art.

Preferably, modules 6I, 6K, 6B, 6C, 6E and 6F shown in FIG. 13A will be mounted and safely protected in the wildfire-protected shed or closet structure 50, disclosed in great technical detail in Applicant's copending U.S. patent application Ser. No. 15/925,796, incorporated herein by reference. In the manual mode, a touch-screen or touch-type control panel associated with the controller 6B is used by the operator to simply operate the system 6 in its manual mode, or automatically arm the system 6 to operate in its automated, artificial intelligence (AI) mode of operation.

Figure 22B:
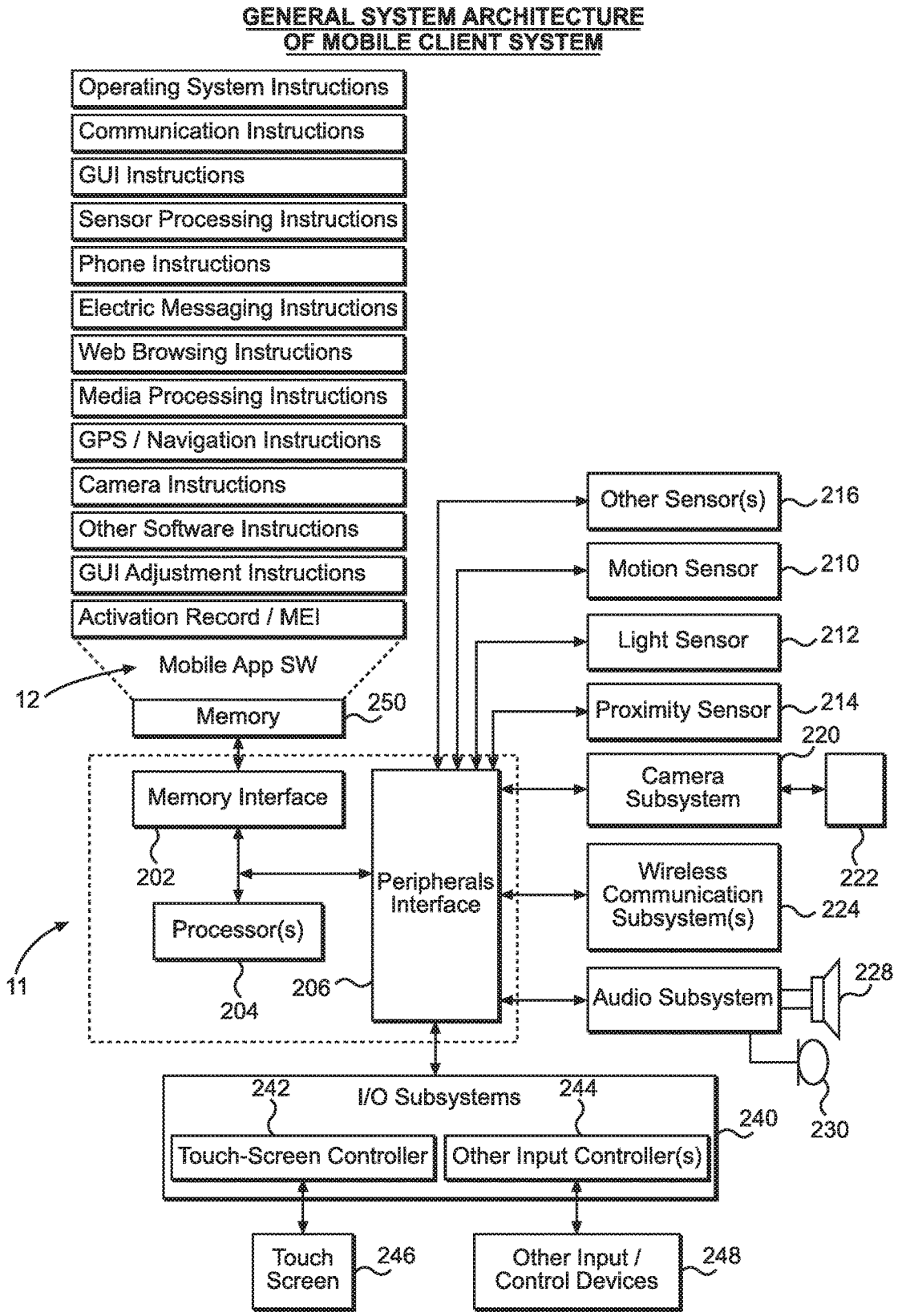
FIG. 22B shows a system diagram for an exemplary mobile client computer system deployed on the system network of the present invention.

The system 6 will be remotely controllable by the building manger/home-owner using a mobile computing system 11 running the mobile application 12, as shown and described in FIGS. 22A and 22B. Suitable graphical user interfaces (GUIs) will be supported on the mobile application 12 to enable the user to monitor and control the system 6 locally, or from a remote location, in real-time, provided the wireless communication infrastructure is not disrupted by a wildfire. In the case of active wildfires, the wildfire detection and notification network 4 should be accessible by a remote user provided with the mobile application 12. As the system 4 will continuously collect, record and monitor intelligence about specific regions of land and any wildfires detected in such regions, and advise any specific home/building owner of the status of any specific building before, during and after a wildfire.

The system 6 will include and supported automated mechanisms for remotely monitoring and reporting the amount of anti-fire chemical liquid 6E available and remaining for use in supporting anti-fire misting operations, as illustrated in FIG. 15, during an automatically detected wildfire ember storm. Preferably, adequate reserves of anti-fire chemical liquid 6E will be stored on each property before any given wildfire strike, to support several hours of wildfire ember suppression misting operations, which is typically expected during a wildfire storm before passes through and consumes the organic material that is desperately seeks to fuel its combustion process.

To provide adequate protection against flying wildfire embers combusting in a low humidity environment, the misting nozzles 64 will be mounted about the building 17 so as to provide adequate coverage over all air-inlet vents provided on the specific building being equipment with the wildfire misting system of the present invention, as well as on wood and other organic surfaces that might be vulnerable to hot wildfire embers during a wildfire ember storm, as illustrated in FIG. 6B. The misting or fog patterns of each misting nozzle 6H being used in the misting system 6 will be considered and exploited to provide the adequate misting protection required by the wildfire protection application at hand. Computer software tools may be developed and distributed to installers to assist in the design and installation of a hybrid wildfire misting system in accordance with the principles of the present invention.

In the illustrative embodiment, the clean anti-fire (AF) liquid to be used for wildfire ember misting operations is preferably Hartindo AF31 Total Fire Inhibitor, developed by Hartindo Chemicatama Industri of Jakarta, Indonesia, and commercially available from Newstar Chemicals (M) SDN BHD of Selangor Darul Ehsan, Malaysia, http://newstarchemicals.com/products.html. It is expected that service-oriented businesses will support the rapid design, installation and installation of the automated wildfire detection and misting suppression systems of the present invention, as well as the supplying and replenishing of clean anti-fire chemical liquid on each GPS-indexed property. It is expected that this can occur with the efficiency currently provided by conventional liquid propane supply companies around the country. Because of the reduced risk of loss of wood-framed or other buildings to wildfire, which the systems and method of the present invention will provide, while advancing the best practices for home and building property protection against wildfires, it is expected that fire insurance companies will embrace the best practices represented by the present invention, for reason of the great benefits such inventions will provide, predicted by Benjamin Franklin's time-honored principle of fire protection: "An ounce of prevention is worth a pound of cure."

When encountering the cloud of anti-fire liquid droplets, combustible wildfire embers will be suppressed or readily extinguished. The chemical molecules in the droplets formed with Hartindo AF31 liquid will interfere with the free radicals (H+, OH—, O) involved in the free-radical chemical reactions within the combustion phase of a fire, or wildfire embers, breaking these free-radical chemical reactions and extinguishing the fire's flames. Also, the droplets will vaporize when absorbing the radiant heat energy of the hot wildfire ember(s), rapidly expanding into a vapor, cooling down the embers, and displaying oxygen, causing the combustion phase of the embers to be suppressed if not extinguished, as illustrated in FIG. 15.

Specification of the Method of Suppressing Wildfire Embers in Accordance with the Present Invention Using a Misting Nozzle Supplied with a Hydraulically Pressurized Supply of Anti-Fire (AF) Liquid FIG. 15 describes a method of suppressing combusting wildfire embers using a hydraulic misting nozzle supplied with a pressurized supply of anti-fire (AF) chemical liquid so as to produce a cloud of microscopic droplets for suppressing flying wildfire embers, as described above.

As described in FIG. 15, the method comprises the steps of: (a) hydraulically pressurizing a supply of anti-fire chemical liquid 6E (e.g. AF31 anti-fire liquid from Hartindo Chemical) through the orifice or opening of a low, medium or high pressure misting nozzle 6H as shown, for example in FIGS. 16 through 19, thereby forming a cloud of fine fog-like mist comprising billions of microscopic droplets generated each second, for real-time fire suppression in the vicinity of the cloud; (b) when the anti-fire chemical liquid droplets approach and encounter a burning wildfire ember, the anti-fire chemical liquid droplets flash evaporating, changing from a liquid to a gas state, causing the fire (i.e. combustion phase) of the burning embers to flash cool, and displacing oxygen around the burning ember as the vapor rapidly expands near the burning ember; and (c) the anti-fire (AF) chemical vapor breaking (i.e. inhibiting) the free-radical chemical reactions within the combustion phase of each burning wildfire ember entering the cloud during a wildfire storm.

This method of wildfire ember suppression has the advantage of attacking flying wildfire embers in three different ways: (i) lowering the temperature of the burning ember; (ii) displacing O2 from the burning ember required during combustion; and (iii) breaking the free-radical chemical reactions within the combustion phase of each burning wildfire ember. This method ensures that embers during a wildfire storm are effectively extinguished within the cloud of microscopic anti-fire (AF) liquid droplets supported outside the air vents provided in the building 17, and those embers that may pass through this cloud of mist, will be filtered out by the ember filter blocks 17D mounted in each rafter bridge beam 17B shown in FIGS. 8 and 8A.

Many different types of misting nozzles 6H can be used in the system and method of suppressing wildfire embers according to the principles of the present invention. In FIGS. 16A through 19B, several exemplary misting nozzle designs are shown and described. While these misting nozzles are implemented typically using stainless steel because this is a durable and rugged material capable of handling high pressured with corrosive effects, alternatively, these misting nozzle designs can be realized using plastic material as well, in a manner well known in the art.

Figure 16B:
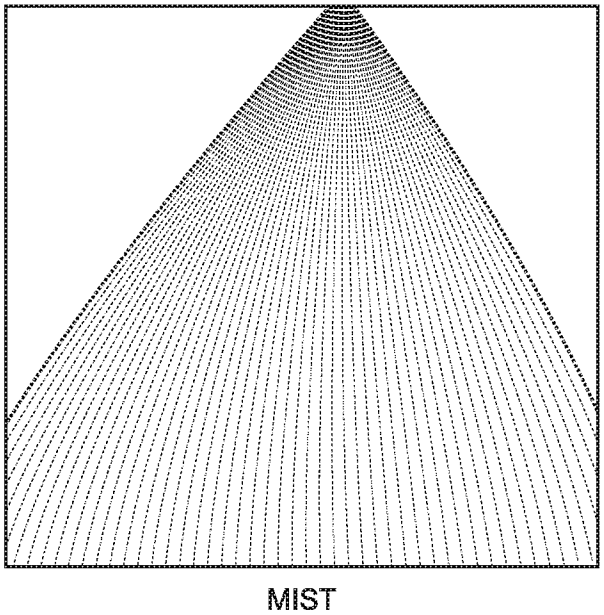
FIG. 16B is a schematic representation of an exemplary misting pattern produced from the nozzle specified in FIG. 16A.
Figure 16A:
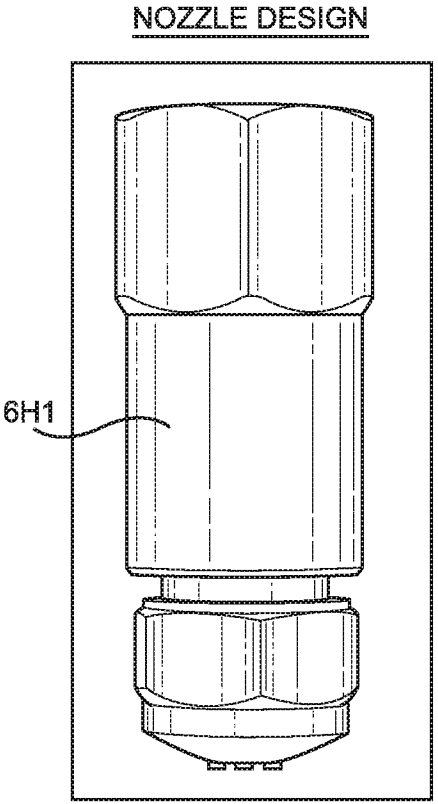
FIG. 16A is a schematic diagram of an UltraMist® misting nozzle from Bete Fog Nozzle, Inc. that can be used to practice the method of wildfire ember suppression illustrated in FIG. 15.

FIG. 16A shows an UltraMist® misting nozzle 6H1 commercially available from Bete Fog Nozzle, Inc. that can be used to practice the method of wildfire ember suppression illustrated in FIG. 15. As shown, the nozzle comprises: a stainless steel tip with a brass adapter body and 100 mess strainer for producing a very fine fog-like mist consisting of droplets under 60 microns over a hollow cone, medium angle at flow rates between 0.37 gallons per hour at 40 PSI to 16.4 gallons per hour at 1200 PSI, supplied using ⅛" and ¼" pipe sizes. FIG. 16B illustrates an exemplary misting pattern produced from the nozzle specified in FIG. 16A.

Figure 17B:
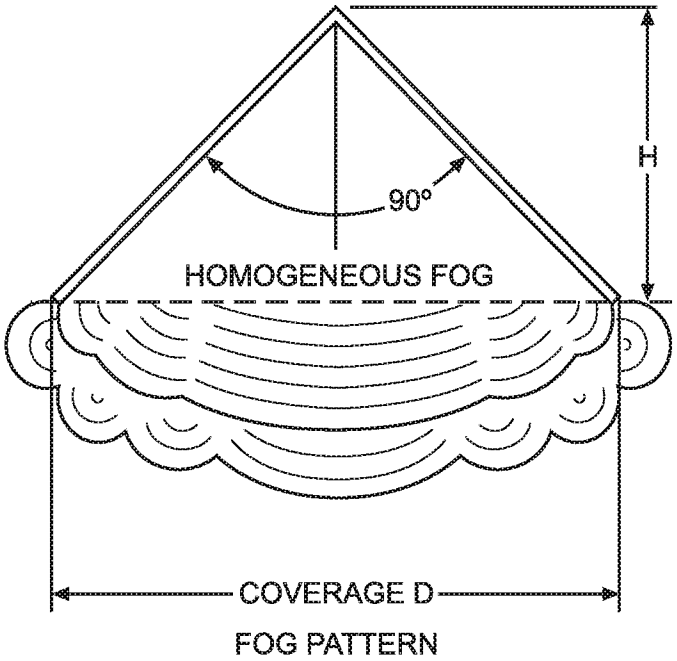
FIG. 17B is a schematic representation of an exemplary misting pattern produced from the nozzle specified in FIG. 17A.
Figure 17A:
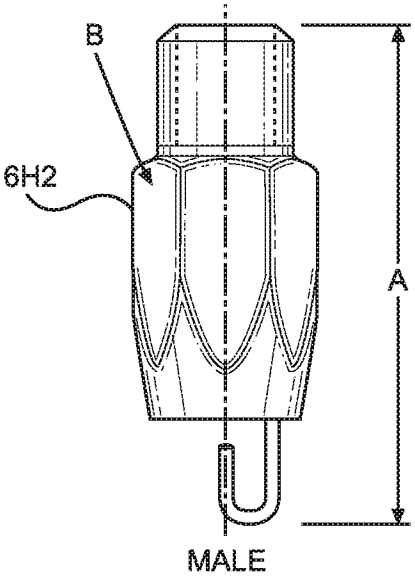
FIG. 17A is a schematic diagram of a fine hydraulic misting nozzle from Bete Fog Nozzle, Inc. that can be used to practice the method of wildfire ember suppression illustrated in FIG. 15.

FIG. 17A shows a fine atomization misting nozzle commercially available from Bete Fog Nozzle, Inc. that can be used to practice the method of wildfire ember suppression illustrated in FIG. 15, comprising a stainless body producing a laminar jet that impinges on a target pin generating a fine fog-like mist consisting of droplets under 60 microns over a cone shaped pattern, medium angle at flow rates between 0.034 gallons per hour at 10 PSI to 0.034 gallons per hour at 1200 PSI, supplied using ⅛" and ¼" males pipe sizes. FIG. 17B illustrates an exemplary misting pattern produced from the nozzle specified in FIG. 17A.

Figure 18B:
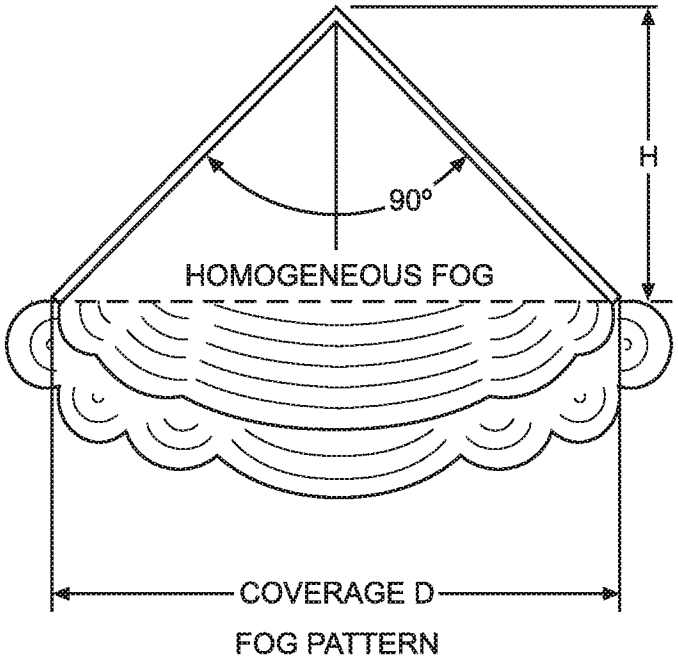
FIG. 18B is a schematic representation of an exemplary misting pattern produced from the nozzle specified in FIG. 18A.
Figure 18A:
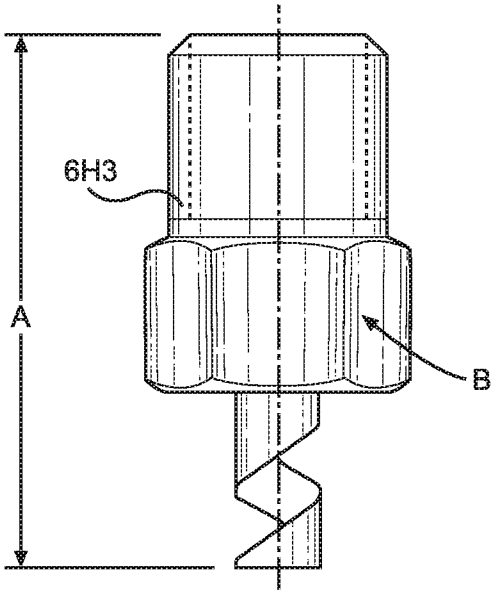
FIG. 18A is a schematic diagram of a low flow misting nozzle from Bete Fog Nozzle, Inc. that can be used to practice the method of wildfire ember suppression illustrated in FIG. 15, comprising a stainless steel tip with small spiral nozzles orifice diameters of 0.04" to 0.12" for producing a fine fog-like mist consisting of droplets over a hollow cone, medium angle at flow rates between 0.14 gallons per minute at 10 PSI to 3.84 gallons per minute at 100 PSI, supplied using ⅛" male pipe sizes.

FIG. 18A shows a low flow misting nozzle commercially available from Bete Fog Nozzle, Inc. that can be used to practice the method of wildfire ember suppression illustrated in FIG. 15, comprising a stainless steel tip with small spiral nozzles orifice diameters of 0.04" to 0.12" for producing a fine fog-like mist consisting of droplets over a hollow cone, medium angle at flow rates between 0.14 gallons per minute at 10 PSI to 3.84 gallons per minute at 100 PSI, supplied using ⅛" male pipe sizes. FIG. 18B illustrates an exemplary misting pattern produced from the nozzle specified in FIG. 18A.

Figure 19B:
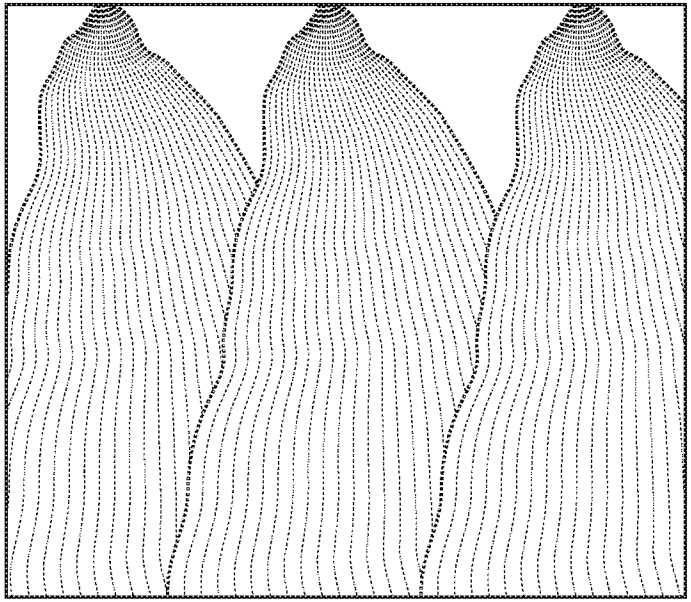
FIG. 19B is a schematic representation of an exemplary misting pattern produced from the nozzle specified in FIG. 19A.
Figure 19A:
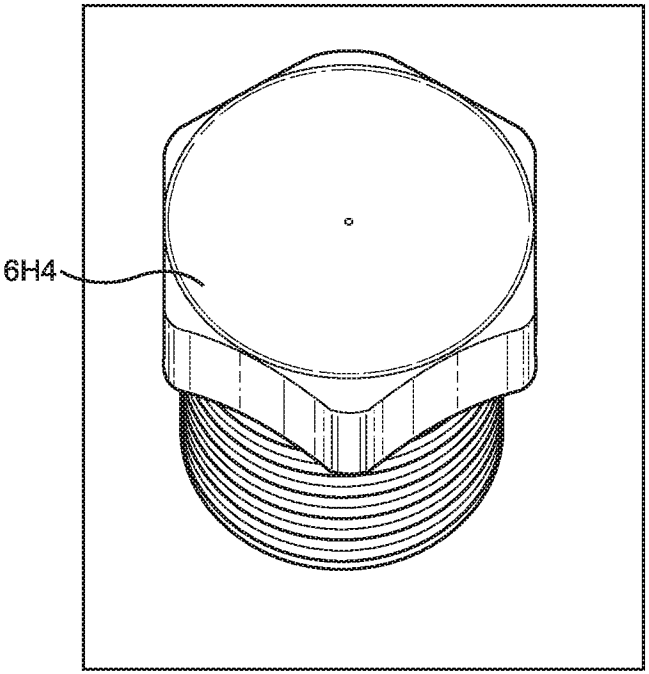
FIG. 19A is a schematic diagram of a MicroWhirl® fine atomization misting nozzle from Bete Fog Nozzle, Inc., described in U.S. Pat. No. 7,198,201, incorporated herein by reference, that can be used to practice the method of wildfire ember suppression illustrated in FIG. 15.

FIG. 19A shows a MicroWhirl® fine atomization misting nozzle commercially available from Bete Fog Nozzle, Inc., described in U.S. Pat. No. 7,198,201, incorporated herein by reference, that can be used to practice the method of wildfire ember suppression illustrated in FIG. 15, comprising a stainless steel for producing a very fine mist at low pressure or fog-like mist at high pressure, medium angle at flow rates between 0.009 gallons per minute at 100 PSI to 0.380 gallons per minute at 3000 PSI, supplied using ⅛" and ¼" male pipe sizes. FIG. 19B illustrates an exemplary misting pattern produced from the nozzle specified in FIG. 19A.

Figure 20:
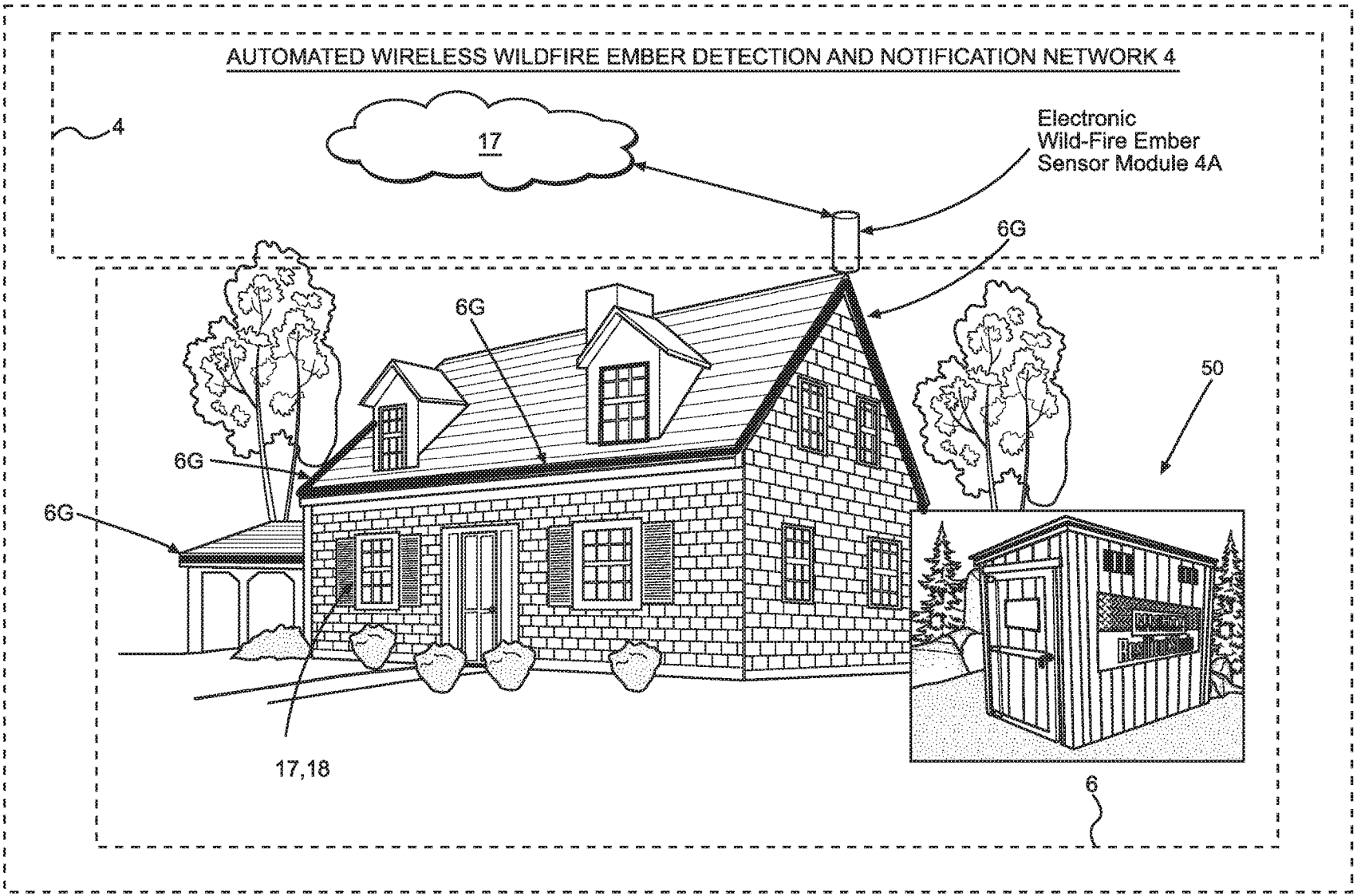
FIG. 20 is a schematic illustration of the wood-framed building shown in FIG. 10, about which is installed the hybrid clean wildfire misting system of the present invention shown in FIGS. 13A and 13B, controlled by the automated wildfire ember detection and suppression system of the present invention.
Figure 20A:
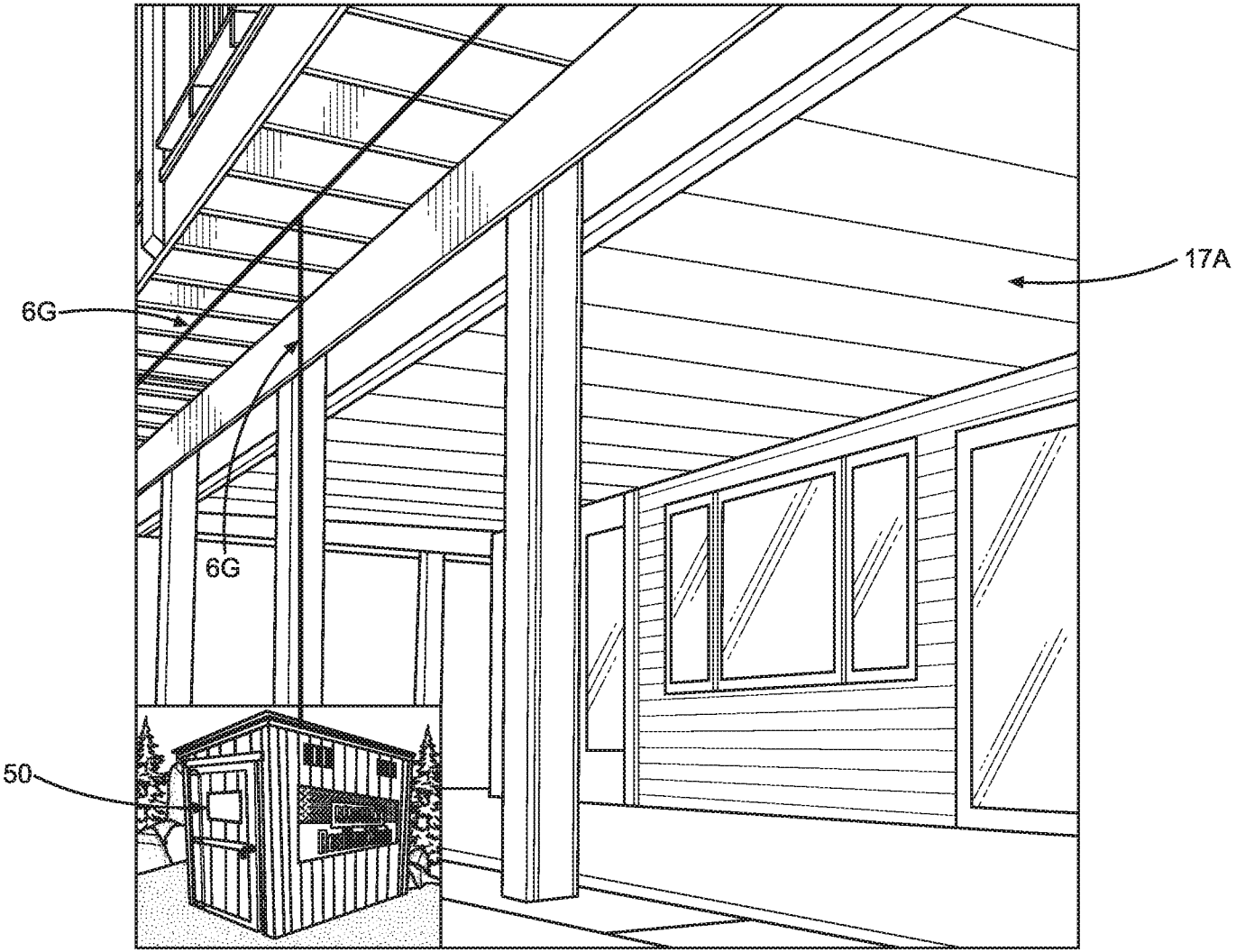
FIG. 20A is a schematic illustration of a wood deck system associated with the rear portion of the wood-framed building being protected by the automated wildfire ember detection and suppression system of the present invention.

Specification of Wood-Framed Building about which the Hybrid Clean Wildfire Inhibitor Misting System of the Present Invention is Installed FIG. 20 is a schematic illustration of the wood-framed building shown in FIG. 10, about which is installed the hybrid clean wildfire inhibitor misting system 6 shown in FIGS. 13A and 13B, controlled by the automated wildfire ember detection and suppression system 4. FIG. 20A shows a wood deck system 17A associated with the rear portion of the wood-framed building 17 being protected by the automated wildfire ember detection and suppression system of the present invention.

Specification of the Mobile GPS-Tracked Anti-Fire (AF) Liquid Misting System of the Present Invention FIG. 21A shows the mobile GPS-tracked anti-fire (AF) liquid misting system 5 supported on a set of wheels, with an integrated supply tank 20B and rechargeable-battery operated electric spray pump 20C, for deployment at private and public properties having building structures, for misting the same with environmentally-clean anti-fire (AF) chemical liquid in accordance with the principles of the present invention.

FIG. 21B shows the GPS-tracked mobile anti-fire (AF) chemical liquid misting system shown in FIG. 21A, comprising a GPS-tracked and remotely-monitored anti-fire (AF) liquid spray control subsystem interfaced with a microcomputing platform for monitoring the misting of anti-fire chemical liquid from the system when located at specific GPS-indexed location coordinates, and automatically logging and recording such clean AF misting application operations within the network database system 9C1.

FIG. 21A shows mobile GPS-tracked anti-fire (AF) liquid misting system 5 supported on a set of wheels 20A, having an integrated supply tank 20B and rechargeable-battery operated electric spray pump 20C, for deployment at private and public properties having building structures, for spraying the same with environmentally-clean anti-fire (AF)

liquid using a spray nozzle assembly 20D connected to the spray pump 20C by way of a flexible 20E.

FIG. 21B shows the GPS-tracked mobile anti-fire liquid spraying/misting system 5 of FIG. 6A as comprising a number of subcomponents, namely: a GPS-tracked and remotely-monitored anti-fire chemical liquid spray control subsystem 20F; a micro-computing platform or subsystem 20G interfaced with the GPS-tracked and remotely-monitored anti-fire chemical liquid spray control subsystem 20F by way of a system bus 201; and a wireless communication subsystem 20H interfaced to the micro-computing platform 20G via the system bus 201. As configured, the GPS-tracked mobile anti-fire liquid misting system 20 enables and supports (i) the remote monitoring of the spraying of anti-fire (AF) chemical liquid from the system 5 when located at specific GPS-indexed location coordinates, and (ii) the logging of all such GPS-indexed spray application operations, and recording the data transactions thereof within a local database maintained within the micro-computing platform 20G, as well as in the remote network database 9C1 maintained at the data center 8 of the system network 1.

As shown in FIG. 21B, the micro-computing platform 20G comprises: data storage memory 20G1; flash memory (firmware storage) 20G2; a programmable microprocessor 20G3; a general purpose I/O (GPIO) interface 20G4; a GPS transceiver circuit/chip with matched antenna structure 20G5; and the system bus 201 which interfaces these components together and provides the necessary addressing, data and control signal pathways supported within the system 5.

As shown in FIG. 21B, the wireless communication subsystem 20H comprises: an RF-GSM modem transceiver 20H1; a T/X amplifier 20H2 interfaced with the RF-GSM modem transceiver 20H1; and a WIFI and Bluetooth wireless interfaces 20H3.

As shown in FIG. 13, the GPS-tracked and remotely-controllable anti-fire (AF) chemical liquid spray control subsystem 20F comprises: anti-fire chemical liquid supply sensor(s) 20F1 installed in or on the anti-fire chemical liquid supply tank 20B to produce an electrical signal indicative of the volume or percentage of the AF liquid supply tank containing anti-fire chemical liquid at any instant in time, and providing such signals to the AF liquid misting system control interface 20F4; a power supply and controls 20F2 interfaced with the liquid pump spray subsystem 20C, and also the AF liquid misting system control interface 20F4; manually-operated spray pump controls interface 20F3, interfaced with the AF liquid misting system control interface 20F4; and the AF liquid misting system control interface 20F4 interfaced with the micro-computing subsystem 20G, via the system bus 201. The flash memory storage 20G2 contains microcode that represents a control program that runs on the microprocessor 20G3 and realizes the various GPS-specified anti-fire chemical liquid spray control, monitoring, data logging and management functions supported by the system 5.

In the preferred embodiment, the environmentally-clean anti-fire (AF) chemical liquid is preferably Hartindo AF31 Total Fire Inhibitor, developed by Hartindo Chemicatama Industri of Jakarta, Indonesia, and commercially-available from Newstar Chemicals (M) SDN. BHD of Selangor Darul Ehsan, Malaysia, http://newstarchemicals.com/products.html. When so treated, combustible products will prevent flames from spreading, and confine fire to the ignition source which can be readily extinguished, or go out by itself. In the presence of a flame, the chemical molecules in both dry and wet coatings, formed with Hartindo AF31 liquid, interferes with the free radicals (H+, OH—, O) involved in the free-radical chemical reactions within the combustion phase of a fire, and breaks these free-radical chemical reactions and extinguishes the fire's flames.

Specification of Method of Spraying Dried-Out/Burned-Out Lawn with Class-A Fire-Protected Green-Colored Lawn Spray to Prevent Lawn Combustion During Wildfire Storm Appearing on Parcel of Property with Building To prevent a burned-out/dried-out lawn from combusting during an approaching wildfire, the mobile liquid spraying system 5 described above can be filled with the environmentally clean anti-fire (AF) liquid 6E (i.e. AF21 AF liquid from Hartindo Chemical) and used to spray clean anti-fire (AF) chemical liquid over the dried out lawn. In the preferred embodiment, the environmentally-clean anti-fire (AF) chemical liquid is preferably Hartindo AF31 Total Fire Inhibitor, developed by Hartindo Chemicatama Industri of Jakarta, Indonesia, and commercially-available from Newstar Chemicals (M) SDN.

Alternatively, a bio-degradable, environmentally-clean (i.e. non-toxic) green-colored "grass paint" concentrate (e.g. commercially available as EnviroColor™ grass paint from EnviroColor of Cumming, Ga.) can be used to make an anti-fire (AF) green spray paint by adding 7 gallons of Hartindo AF31 anti-fire chemical liquid to 1 gallon of green-colored non-toxic biodegradable lawn paint concentrate, to produce a green-colored liquid formulation that can then be sprayed on the a dried-out lawn using the portable liquid spraying system 5 or like system. This clean anti-fire chemical lawn spray treatment should provide a significant defense against wildfires (i.e. a chemical wildfire break) by providing the dried grass with chemicals that break the free-radical chemical reactions in the combustion phase of a burning wildfire. The clean green paint spray coating may need to be reapplied every 4-8 weeks depending on the weather and moisture conditions. Different mixing ratios of Hartindo AF31 anti-fire chemical liquid to EnviroColor™ green paint concentrate (other than 7/1) may be used to provide dried out grass, with a stronger or weaker defense to wildfires and flying wildfire embers, without significantly compromising color while reducing the risks of wildfires to neighboring homes and buildings.

Similarly, Hartindo AF31 anti-fire chemical liquid can be mixed with EnviroColor brown mulch paint using similarly mixing ratios (e.g. 7/1) to provide mulch paint coverings that provide dried out grass with a stronger or weaker defense to wildfires and flying wildfire embers, and thereby reducing the risks of wildfires to neighboring homes and buildings.

Specification of System Architecture of an Exemplary Mobile Smartphone System Deployed on the System Network of the Present Invention FIG. 22A shows an exemplary mobile computing device deployed on the system network of the present invention, supporting (i) the mobile anti-fire spray management application of the present invention deployed as a component of the system network of the present invention as shown in FIG. 9, as well as (ii) conventional wildfire alert and notification systems as shown in FIGS. 10 through 12C. FIG. 22B shows a system diagram for an exemplary mobile client computer system 11 deployed on the system network 1 of the present invention.

FIG. 22B shows the system architecture of an exemplary mobile client computing system 11 that is deployed on the system network 1 and supporting the many services offered by system network servers 9A, 9B, 9C, 9D, 9E. As shown, the mobile smartphone device 11 can include a memory interface 202, one or more data processors, image processors and/or central processing units 204, and a peripherals interface 206. The memory interface 202, the one or more processors 204 and/or the peripherals interface 206 can be separate components or can be integrated in one or more integrated circuits. The various components in the mobile device can be coupled by one or more communication buses or signal lines. Sensors, devices, and subsystems can be coupled to the peripherals interface 206 to facilitate multiple functionalities. For example, a motion sensor 210, a light sensor 212, and a proximity sensor 214 can be coupled to the peripherals interface 206 to facilitate the orientation, lighting, and proximity functions. Other sensors 216 can also be connected to the peripherals interface 206, such as a positioning system (e.g. GPS receiver), a temperature sensor, a biometric sensor, a gyroscope, or other sensing device, to facilitate related functionalities. A camera subsystem 220 and an optical sensor 222, e.g. a charged coupled device (CCD) or a complementary metal-oxide semiconductor (CMOS) optical sensor, can be utilized to facilitate camera functions, such as recording photographs and video clips. Communication functions can be facilitated through one or more wireless communication subsystems 224, which can include radio frequency receivers and transmitters and/or optical (e.g. infrared) receivers and transmitters. The specific design and implementation of the communication subsystem 224 can depend on the communication network(s) over which the mobile device is intended to operate. For example, the mobile device 11 may include communication subsystems 224 designed to operate over a GSM network, a GPRS network, an EDGE network, a Wi-Fi or WiMax network, and a Bluetooth™ network. In particular, the wireless communication subsystems 224 may include hosting protocols such that the device 11 may be configured as a base station for other wireless devices. An audio subsystem 226 can be coupled to a speaker 228 and a microphone 230 to facilitate voice-enabled functions, such as voice recognition, voice replication, digital recording, and telephony functions. The I/O subsystem 240 can include a touch screen controller 242 and/or other input controller(s) 244. The touch-screen controller 242 can be coupled to a touch screen 246. The touch screen 246 and touch screen controller 242 can, for example, detect contact and movement or break thereof using any of a plurality of touch sensitivity technologies, including but not limited to capacitive, resistive, infrared, and surface acoustic wave technologies, as well as other proximity sensor arrays or other elements for determining one or more points of contact with the touch screen 246. The other input controller(s) 244 can be coupled to other input/control devices 248, such as one or more buttons, rocker switches, thumb-wheel, infrared port, USB port, and/or a pointer device such as a stylus. The one or more buttons (not shown) can include an up/down button for volume control of the speaker 228 and/or the microphone 230. Such buttons and controls can be implemented as a hardware objects, or touch-screen graphical interface objects, touched and controlled by the system user. Additional features of mobile smartphone device 11 can be found in U.S. Pat. No. 8,631,358 incorporated herein by reference in its entirety.

Figure 4A:
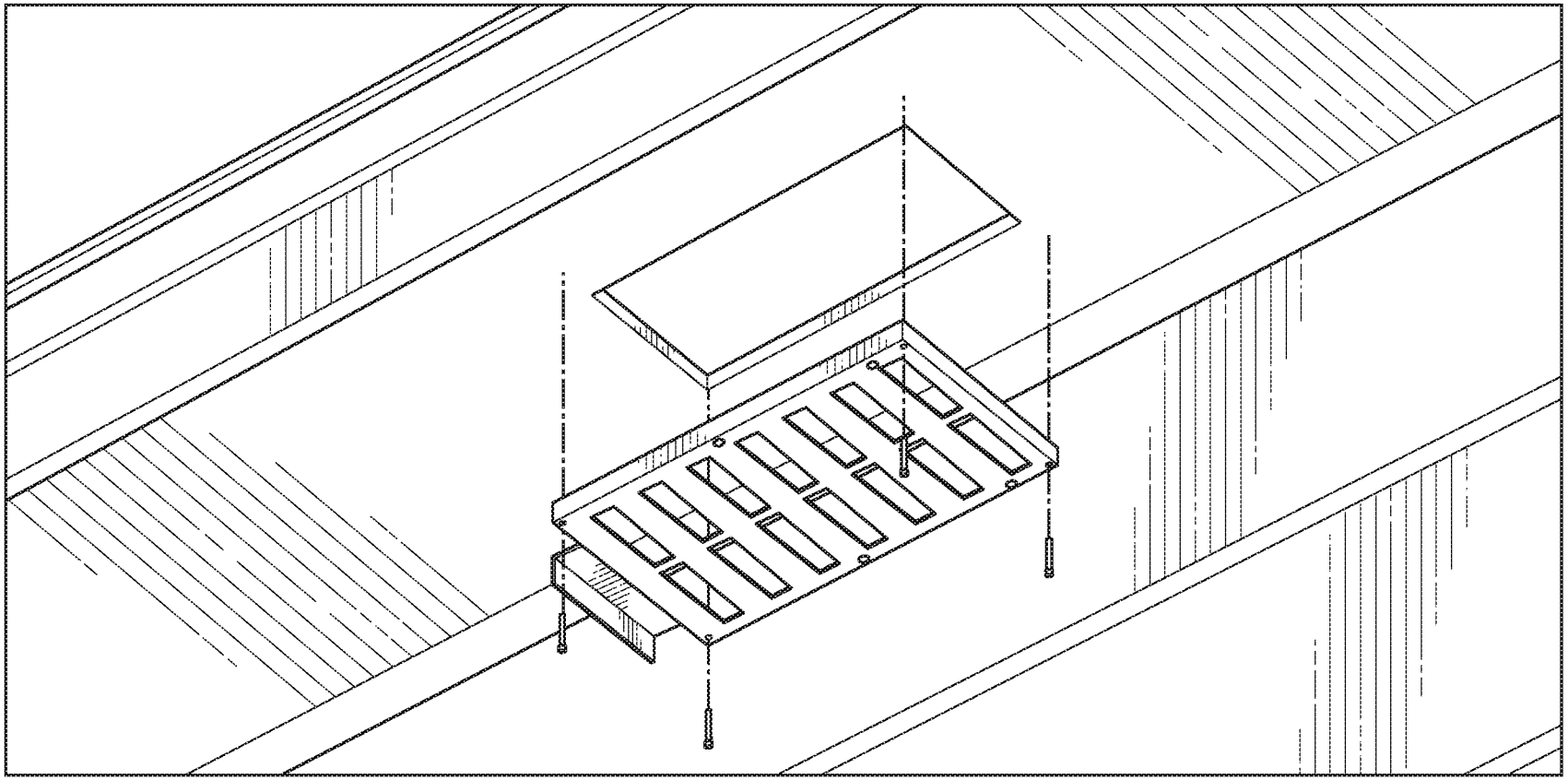
FIG. 4A (PRIOR ART)
FIG. 4A is a perspective view of a conventional soffit structure on a wood-framed house, showing the installation of a closable soffit vent device.
Figure 4B:
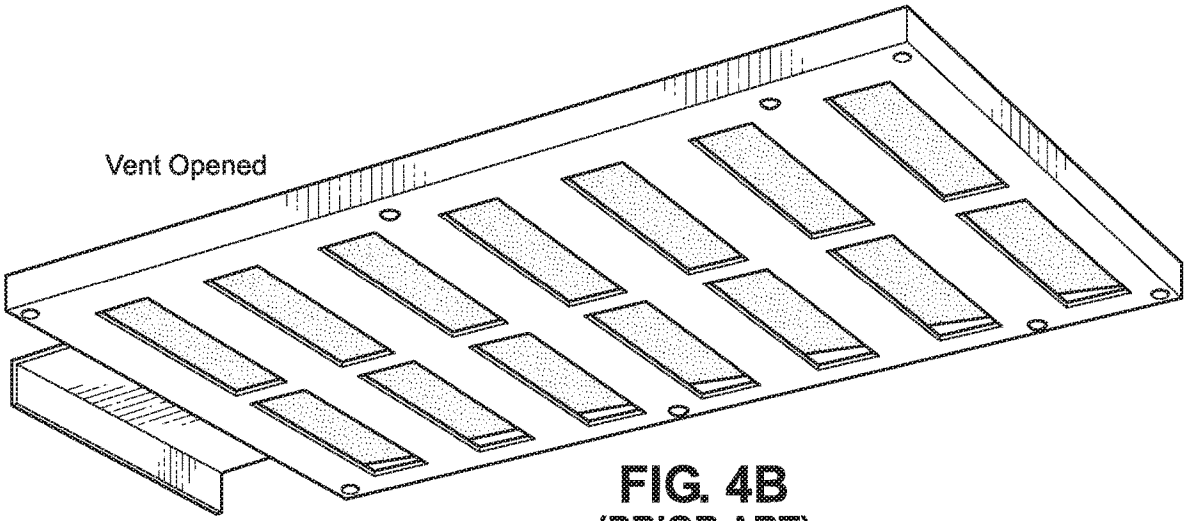
FIG. 4B (PRIOR ART)
FIG. 4B is a perspective view of the conventional closable soffit vent of FIG. 5A, shown arranged in its opened vent configuration.
Figure 4C:
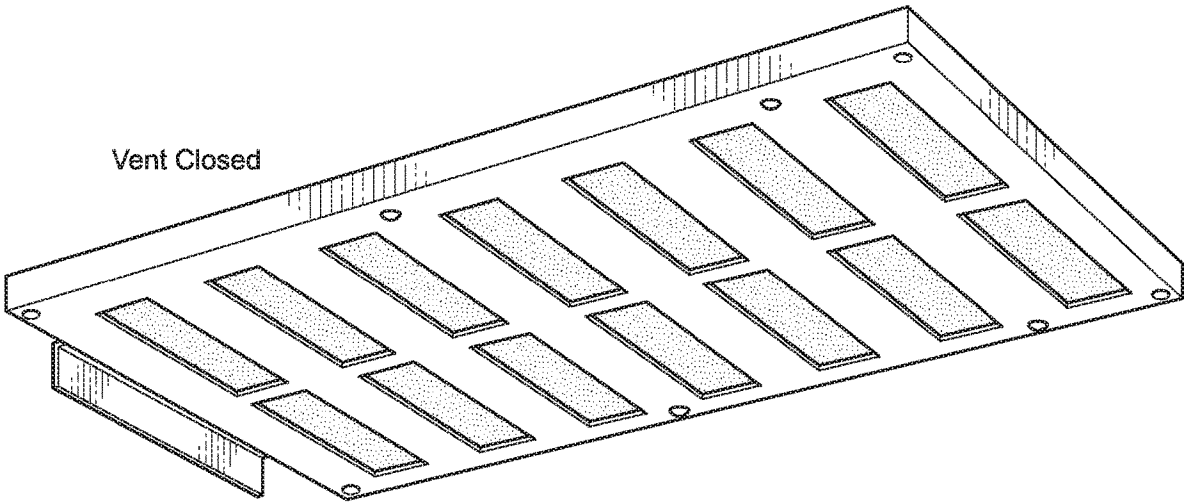
FIG. 4C (PRIOR ART)
FIG. 4C is a perspective view of the conventional closable soffit vent of FIG. 5A, shown arranged in its closed vent configuration.
Figure 5A:
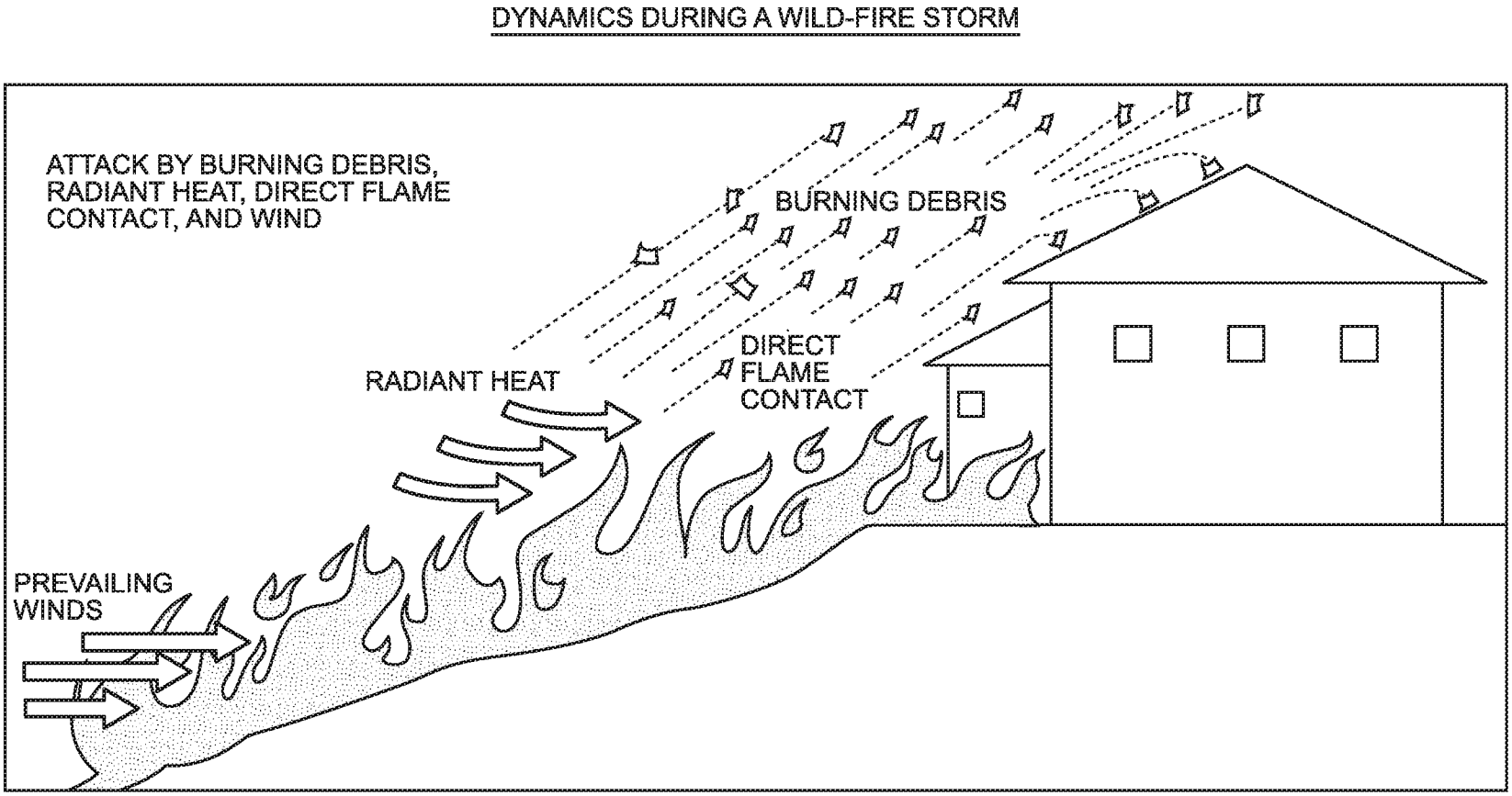
FIG. 5A (PRIOR ART)
FIG. 5A is a graphical illustration showing the impact and dynamics of a wildfire being driven by prevailing wind, with radiant heat and direct flames coming into contact with a conventional wood-framed building, while burning debris including wildfire embers are flying all around and into the wood-frame building during a wildfire storm.
Figure 5B:
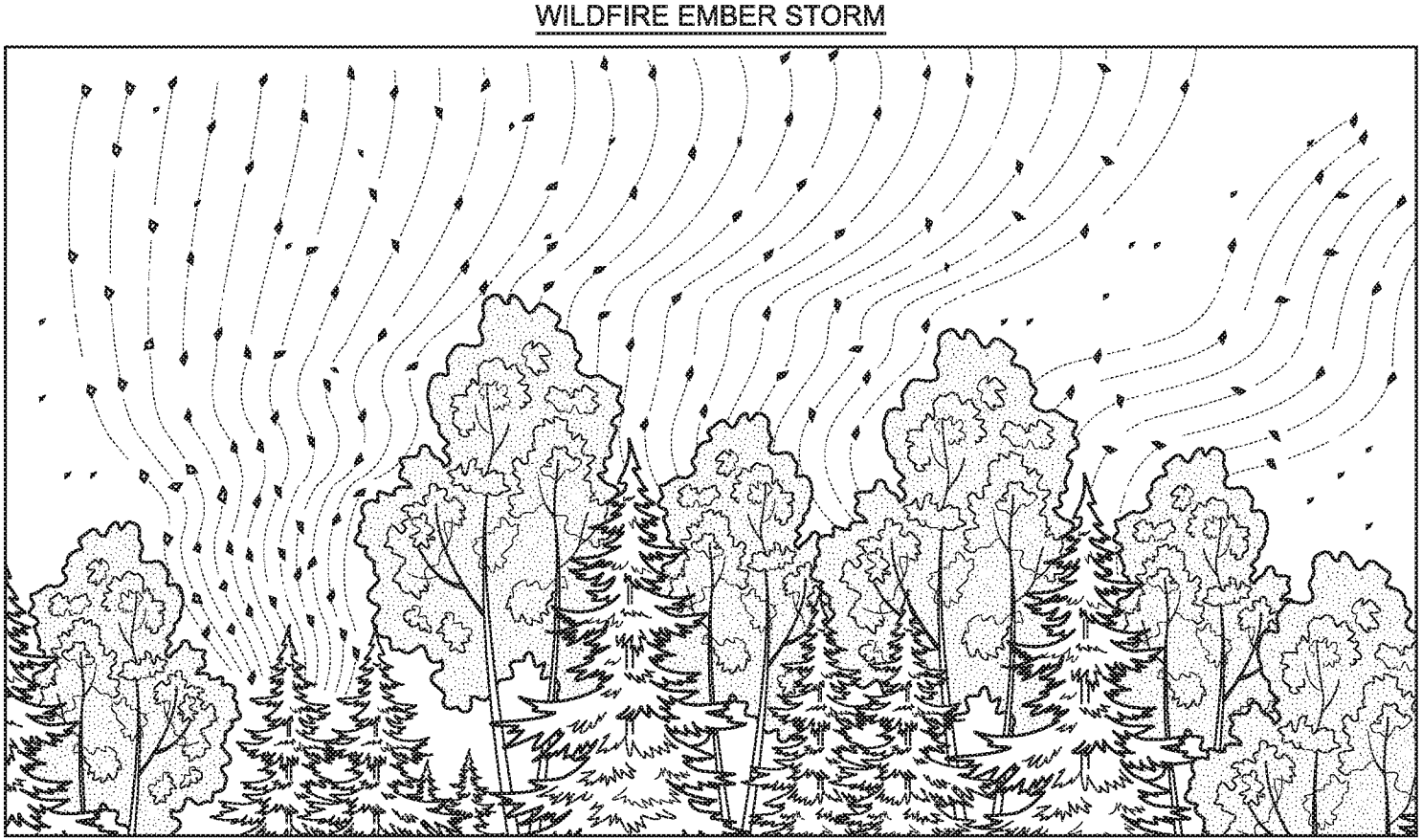
FIG. 5B (PRIOR ART)
FIG. 5B is a graphical illustration of a wildfire ember storm generated by a wildfire ranging across a wooded field, producing streams of burning/combusting embers of organic material that are flying through the air currents generated by the heat of the wildfire and prevailing winds.

Different Ways of Implementing the Mobile Client Machines and Devices on the System Network of the Present Invention In one illustrative embodiment, the enterprise-level system network is realized as a robust suite of hosted services delivered to Web-based client subsystems 1 using an application service provider (ASP) model. In this embodiment, the Web-enabled mobile application 12 can be realized using a web-browser application running on the operating system (OS) (e.g. Linux, Application IOS, etc.) of a mobile computing device 11 to support online modes of system operation, only. However, it is understood that some or all of the services provided by the system network 1 can be accessed using Java clients, or a native client application, running on the operating system of a client computing device, to support both online and limited off-line modes of system operation. In such embodiments, the native mobile application 12 would have access to local memory (e.g. a local RDBMS) on the client device 11, accessible during off-line modes of operation to enable consumers to use certain or many of the system functions supported by the system network during off-line/off-network modes of operation. It is also possible to store in the local RDBMS of the mobile computing device 11 most if not all relevant data collected by the mobile application for any particular fire-protection spray project, and to automatically synchronize the dataset for user's projects against the master datasets maintained in the system network database 9C1, within the data center 8 shown in FIG. 4. This way, when using a native application, during off-line modes of operation, the user will be able to access and review relevant information regarding any building spray project, and make necessary decisions, even while off-line (i.e. not having access to the system network).

As shown and described herein, the system network 1 has been designed for several different kinds of user roles including, for example, but not limited to: (i) public and private property owners, residents, fire departments, local, county, state and federal officials; and (ii) wildfire suppression administrators, contractors, technicians et al registered on the system network. Depending on which role, for which the user requests registration, the system network will request different sets of registration information, including name of user, address, contact information, etc. In the case of a web-based responsive application on the mobile computing device 11, once a user has successfully registered with the system network, the system network will automatically serve a native client GUI, or an HTML5 GUI, adapted for the registered user. Thereafter, when the user logs into the system network, using his/her account name and password, the system network will automatically generate and serve GUI screens described below for the role that the user has been registered with the system network.

In the illustrative embodiment, the client-side of the system network 1 can be realized as mobile web-browser application, or as a native application, each having a "responsive-design" and adapted to run on any client computing device (e.g. iPhone, iPad, Android or other Web-enabled computing device) 11 and designed for use by anyone interested in managing, monitoring and working to defend against the threat of wildfires.

Mobile Computing Devices Deployed on the System Network of the Present Invention for Remotely Controlling Functions and Operations within Registered Building FIG. 22A shows an exemplary mobile computing device deployed on the system network of the present invention 12. Using the mobile application of the present invention 11 deployed as a component of the system network shown in FIG. 9, the home owner or other authorized personnel can remotely control at least five basic remote-control functions of the system before or after they leave their home during a wildfire storm emergency evacuation, namely:

(A) remotely activating/activating/monitoring the wildfire ember misting system 6 shown in FIGS. 9 through 20A, either now or at a specified period of time;

(B) remotely activating/deactivating/monitoring all air vents 400, 500 on the house, as shown in FIGS. 6A, 6B and 7A, either now or a specified time;

(C) remotely close/open and monitor all windows 600 in the house as shown in FIG. 7B, either now or at a specified perform of time;

(D) remotely enable the automatic wildfire ember detector 4B in its over-ride mode rather than command mode, shown in FIGS. 11*m* 12A, 12*b* and 12C; and (E) remotely arm and monitor the entire house with all wildfire safety functions activated, in anticipation of an expected wildfire ember storm (i.e. perform Commands A, B and C), either now or at a specified time; and When set or activated in its command mode, the automatic wildfire ember detector 4A, in cooperation with its surrounding intelligence network 4, will not activate the wildfire ember misting system 6 until the detector senses sufficient IR thermal imaging data to confirm that wildfire embers of sufficient energy are present and moving in the vicinity of the house which it the detector 4A is protecting. This mode is designed to conserve discharge of anti-fire (i.e. free-radical chemical reaction interrupting) misting liquid for real and actual wildfire ember threats to the home. When operated in its over-ride mode, the wildfire ember detector 4A is overridden by the homeowner command and the homeowner's command to commence wildfire ember misting operations will rule. It is understood that variations, extensions and additions to these command will naturally occur in view of the present invention disclosure.

Modifications to the Present Invention which Readily Come to Mind

The illustrative embodiments disclose the use of clean anti-fire chemicals from Hartindo Chemicatama Industri, particular Hartindo AAF31, for clinging to the surfaces of wood, lumber, and timber, and other combustible matter, wherever wildfires may travel. However, it is understood that alternative clean anti-fire chemical liquids may be used to practice the various wildfire suppression methods according to the principles of the present invention.

While the shed structure shown herein was of a general trapezoidal geometry, it is understood that the size and dimensions of the shed structure can be virtually any size that may fit on one's yard, and transported using conventional means and/or carriers.

These and other variations and modifications will come to mind in view of the present invention disclosure.

While several modifications to the illustrative embodiments have been described above, it is understood that various other modifications to the illustrative embodiment of the present invention will readily occur to persons with ordinary skill in the art. All such modifications and variations are deemed to be within the scope and spirit of the present invention as defined by the accompanying Claims to Invention.

What is claimed is:

1. A wireless system network for monitoring wildfire ember suppression and home defense spray systems, comprising:

a plurality of wildfire ember suppression and home defense spray systems, each said wildfire ember suppression and home defense spray system includes an electronic circuit for automatically monitoring the level of environmentally-clean anti-fire (AF) liquid contained in a storage tank, and automatically generating electronic refill orders transmitted to a remote center, so that a service can automatically replenish the storage tank of each said wildfire ember suppression and home defense spray system when the level of environmentally-clean anti-fire (AF) liquid falls below a predetermined level in said storage tank.

2. The wireless system network of claim 1, which further comprises information servers for managing the supply, delivery and spray-application of said environmentally-clean anti-fire (AF) liquid by each said wildfire ember suppression and home defense spray system so as to reduce the risks of damage and/or destruction to property and life caused by wildfires.

3. The wireless system network of claim 2, which further comprises at least one mobile computing system configured for use in connection with each said wildfire ember suppression and home defense spray system, wherein each said mobile computing system has installed a mobile application supporting the following functions: (i) sending automatic notifications from a command center to home owners using said mobile application, and instructing said home owners to spray their property and homes at certain times with environmentally-clean anti-fire chemical liquid contained in the storage tanks of said wildfire ember suppression and home defense spray systems; (ii) each said wildfire ember suppression and home spray defense system automatically monitoring consumption of sprayed environmentally-clean anti-fire (AF) liquid and generating said electronic refill order so as to achieve compliance with a home spray-based wildfire-defense program, and reporting anti-fire (AF) liquid levels in the storage tank of each said wildfire ember suppression and home defense spray system; and (iii) showing the status of wildfire risk in a specified region, and recommended actions to the taken before wildfire outbreak.

4. The wireless system network of claim 3, which further comprises: a wireless network of wildfire ember detectors mounted on a network of buildings covering a significantly large area, so that early detection of a GPS-specified wildfire can be transmitted to other wildfire ember detectors on other buildings to provide (i) an awareness of any wildfires present in the vicinity, and (ii) automated preparation for a detected wildfire, by automatically triggering automated cloud misting operations of environmentally-clean anti-fire (AF) chemical liquid contained in said storage tanks so as to inhibit and suppress wildfire embers and fire when wildfire embers arrive on the premises of the protected buildings.

5. The wireless system network of claim 2, wherein each wildfire ember suppression and said home defense spray system is adapted for spraying a defensive path of environmentally-clean anti-fire (AF) liquid around wood-framed buildings out in front of wildfires so as to make sure that an environmentally-safe chemical fire break, created by the spray application of said environmentally-clean anti-fire (AF) liquid, may defend and help protect homes from the destructive forces of wildfires.

6. The wireless system network of claim 1, wherein said electronic circuit comprises a GPS-tracking and radio-controlled circuit for tracking the position of said wildfire ember suppression and home defense spray system, and monitoring the level of said anti-fire (AF) liquid contained in said storage tank.

7. A method of mitigating the damaging effects of wildfires, said method comprising the steps of:

(a) using a GPS-tracking mobile spraying system to spray environmentally-clean anti-fire (AF) chemical liquid on dry brush and/or vegetation around a neighborhood in advance of wildfire, so as to provide fire inhibiting properties to said dry bush and/or vegetation that does not depend on water to extinguish fire, such that, even after a month or two after spray application on said dry brush and/or vegetation around the neighborhood, the environmentally-clean anti-fire (AF) chemical in said environmentally-clean anti-fire (AF) chemical liquid continues to work by stalling the ability of a wildfire to advance and consume homes by combustion; and (b) said GPS-tracking mobile spraying system including a storage tank for storing said environmentally-clean anti-fire (AF) chemical liquid, and an electronic device for automatically tracking the GPS coordinates of the GPS-tracking mobile spraying system during spraying operations, and monitoring the level of environmentally-clean anti-fire (AF) chemical liquid contained in said storage tank, and automatically generating and transmitting electronic signals to a remote center, so that a third-party service can automatically replenish said storage tank of said GPS-tracking mobile spraying system when the level of environmentally-clean anti-fire (AF) chemical liquid falls below a predetermined level in said storage tank.

8. The method of claim 7, which further comprises during step (a), using a global positioning satellite (GPS) system and mobile communication techniques, so as to direct the spraying of said environmentally-clean anti-fire (AF) chemical liquid prior to the arrival of a wildfire on a specific parcel of property.

9. A wireless system network for supporting wildfire property defense, comprising:

a plurality of GPS-tracking mobile spraying systems deployed on a wireless communication network for supporting proactive defense of property from wildfire by spraying the property with environmentally-clean anti-fire (AF) liquid prior to the arrival of a wildfire;

wherein each said GPS-tracking mobile spraying system, includes an electronic device for (i) automatically tracking the spraying of the property with environmentally-clean anti-fire (AF) liquid contained in a storage tank, (ii) automatically monitoring the level of environmentally-clean anti-fire (AF) liquid in said storage tank, and (iii) generating and transmitting electronic signals to a remote center so that a service can automatically replenish said storage tank when the level of environmentally-clean anti-fire (AF) liquid falls below a predetermined level in said storage tank, to ensure each said GPS-tracking mobile spraying system is ready to spray environmentally-clean anti-fire (AF) liquid on said property before the incidence of wildfire, in a proactive manner.

10. The wireless system network of claim 9, wherein said GPS-tracking mobile spraying system comprises a GPS-guided aircraft for flying over GPS-specified property and spraying said environmentally-clean anti-fire liquid over said GPS-specified property.

11. The method of claim 9, wherein said GPS-tracking mobile spraying system comprises a GPS-guided ground-based vehicle for moving over GPS-specified property and spraying said environmentally-clean anti-fire liquid over said GPS-specified property.

* * * * *